US010710152B2

(12) United States Patent
Han et al.

(10) Patent No.: US 10,710,152 B2
(45) Date of Patent: Jul. 14, 2020

(54) MENISCUS FLOW CONTROL DEVICE AND MENISCUS FLOW CONTROL METHOD USING SAME

(71) Applicant: POSCO, Pohang-Si (KR)

(72) Inventors: Sang Woo Han, Pohang-Si (KR); Seon Yong Jin, Gwangyang-Si (KR); Hyun Jin Cho, Pohang-Si (KR)

(73) Assignee: POSCO, Pohang-si (KR)

( * ) Notice: Subject to any disclaimer, the term of this patent is extended or adjusted under 35 U.S.C. 154(b) by 403 days.

(21) Appl. No.: 15/528,199

(22) PCT Filed: Nov. 19, 2015

(86) PCT No.: PCT/KR2015/012463

§ 371 (c)(1),
(2) Date: May 19, 2017

(87) PCT Pub. No.: WO2016/080778

PCT Pub. Date: May 26, 2016

(65) Prior Publication Data

US 2017/0326626 A1 Nov. 16, 2017

(30) Foreign Application Priority Data

Nov. 19, 2014 (KR) ..... 10-2014-0161672
Aug. 10, 2015 (KR) ..... 10-2015-0112510
Sep. 10, 2015 (KR) ..... 10-2015-0128388

(51) Int. Cl.
*B22D 11/18* (2006.01)
*B22D 11/115* (2006.01)
*B22D 2/00* (2006.01)

(52) U.S. Cl.
CPC ..... *B22D 11/18* (2013.01); *B22D 2/003* (2013.01); *B22D 11/115* (2013.01); *B22D 11/182* (2013.01); *B22D 11/186* (2013.01)

(58) Field of Classification Search
CPC ..... B22D 2/00; B22D 2/003; B22D 11/115; B22D 11/18; B22D 11/182; B22D 11/186
(Continued)

(56) References Cited

FOREIGN PATENT DOCUMENTS

CN 1278197 12/2000
CN 1342110 3/2002
(Continued)

OTHER PUBLICATIONS

Emling, Breakout Prevention, Keeping Current II, Iron & Steelmaker, 1994, pp. 50-58.
(Continued)

*Primary Examiner* — Kevin P Kerns
(74) *Attorney, Agent, or Firm* — Cantor Colburn LLP

(57) ABSTRACT

Provided is a meniscus flow control device that includes: a meniscus flow detection unit for detecting, in a meniscus flow form of molten steel, relative temperature values for positions measured by temperature measurers, and relatively comparing the temperature values measured by the temperature measurers to thereby determine the flow state of the molten steel meniscus to be normal or abnormal; a magnetic field generation unit, installed outside a mold, for generating a magnetic field and controlling the flow of the molten steel by the magnetic field; and a flow control unit for maintaining the operation of the magnetic field generation unit in the current state when the meniscus flow state detected by the meniscus flow detection unit is determined to be normal, and for controlling the magnetic field generation unit to adjust the meniscus flow to be normal when the detected meniscus flow state is determined to be abnormal.

7 Claims, 32 Drawing Sheets

500 : 510a, 510b, 510c, 510d

(58) Field of Classification Search
USPC ..... 164/466, 467, 468, 502, 503, 504
See application file for complete search history.

(56) References Cited

FOREIGN PATENT DOCUMENTS

| | | |
|---|---|---|
| CN | 1958193 | 5/2007 |
| EP | 1166921 | 1/2002 |
| EP | 1021262 | 6/2004 |
| JP | 01262050 | 10/1989 |
| JP | 3275256 | 12/1991 |
| JP | 11077265 | 3/1999 |
| JP | 11090599 | 4/1999 |
| JP | 11090600 | 4/1999 |
| JP | 2001514078 | 9/2001 |
| JP | 03252769 | 2/2002 |
| JP | 2002206958 | 7/2002 |
| JP | 2003001386 | 1/2003 |
| JP | 2003181609 | 7/2003 |
| JP | 2004025202 | 1/2004 |
| JP | 2004066303 | 3/2004 |
| JP | 2004291060 | 10/2004 |
| JP | 2011011258 | 1/2011 |
| JP | 2012076094 | 4/2012 |
| JP | 2012139713 | 7/2012 |
| KR | 20010104718 | 11/2001 |
| KR | 20040038224 | 5/2004 |
| KR | 20090073495 | 7/2009 |
| KR | 20100094486 | 8/2010 |
| KR | 20120032923 | 4/2012 |
| KR | 20120044421 | 5/2012 |
| KR | 20120044423 | 5/2012 |
| KR | 20120044425 | 5/2012 |
| KR | 20120044433 | 5/2012 |
| KR | 20120057901 | 6/2012 |
| KR | 20130013738 | 2/2013 |
| KR | 101244323 | 3/2013 |
| KR | 20140014459 | 2/2014 |
| KR | 20170017358 | 2/2017 |
| KR | 20170018634 | 2/2017 |
| KR | 20170030894 | 3/2017 |
| WO | 0051763 | 9/2000 |
| WO | 2014017714 | 1/2014 |

OTHER PUBLICATIONS

European Search Report—European Application No. 15861026.1 dated Oct. 10, 2017, citing EP 1 021 262, EP 1 166 921, KR 2013 0013738, KR 2012 0044433, JP 3 252769, JP H03 275256, JP 2003 001386, Emling and Xia, et al.

Xia, et al., Investigation of mould thermal behaviour by means of mould instrumentation, Ironmaking and Steelmaking, 2004, pp. 364-370.

Chinese Office Action—Chinese Application No. 201580063117.7 dated Jan. 3, 2019, citing CN 1342110, WO 2014017714 and JP H01262050.

International Search Report—PCT/KR2015/012463 dated Mar. 31, 2016.

Chinese Office Action—Chinese Application No. 201580063117.7 dated Jun. 1, 2018, citing CN 1342110, WO 2014017714, KR 10-2013-0013738, CN 1278197 and CN 1958193.

Japanese Office Action—Japanese Application No. 2017-526857 dated Jul. 10, 2018, citing WO 00/051763, KR 10-2013-0013738 and WO 2014/017714.

PCT Written Opinion—PCT/KR2015/012463 dated May 23, 2017, citing KR 10-2001-0104718, KR 10-2013-0013738, and Kr 10-2014-0014459.

Korean Office Action—Korean Application No. 10-2014-0161672 dated Feb. 26, 2016, citing KR 10-2001-0104718 and KR 10-2014-0014459.

Korean Notice of Allowance—Korean Application No. 10-2014-0161672 dated Feb. 28, 2017, citing KR 10-2001-0104718, KR 10-2014-0014459, JP 2003-181609 and JP 3-252769.

Korean Office Action—Korean Application No. 10-2014-0161672 dated Aug. 24, 2016, citing KR 10-2001-0104718 and KR 10-2014-0014459.

Korean Office Action—Korean Application No. 10-2014-0161672 dated Oct. 12, 2016.

Korean Office Action—Korean Application No. 10-2015-0112510 dated Nov. 10, 2016, citing KR 10-2001-0104718 and JP 2012-139713.

Korean Office Action—Korean Application No. 10-2015-0112510 dated Apr. 26, 2017, citing KR 10-2001-0104718 and JP 2012-139713.

Korean Notice of Allowance—Korean Application No. 10-2015-0112510 dated Jun. 22, 2017, citing KR 10-2001-0104718, JP 2012-139713, KR 10-2014-0014459 and KR 10-2009-0073495.

Korean Office Action—Korean Application No. 10-2015-0128388 dated Nov. 29, 2016, citing KR 10-2001-0104718 and KR 10-2013-0013738.

Korean Office Action—Korean Application No. 10-2015-0128388 dated May 19, 2017, citing KR 10-2001-0104718 and KR 10-2013-0013738.

Japanese Office Action—Japanese Application No. 2017-526857 dated Dec. 10, 2019, citing WO 00/051763, KR 10-2013-0013738, WO 2014/017714, JP 03-275256, JP 2003-001386, JP 2001-514078, KR 2012-0044433, JP 01-262050, JP 11-077265 and JP 2004-291060.

Fig. 24

| Flow pattern type | | | | |
|---|---|---|---|---|
| First flow pattern type | $T_{E1}$ $T_C$ $T_{E2}$ | $T_1 \leqq \Delta T_{H-L} \leqq T_2$ | $T_{E1} > T_C$<br>$T_{E2} > T_C$ | $\Delta T_{E1-C} \leqq T_3$<br>$\Delta T_{E2-C} \leqq T_3$ |
| Second flow pattern type | $T_{E1}$ $T_C$ $T_{E2}$ | $T_1 \leqq \Delta T_{H-L} \leqq T_2$ | $T_{E1} \fallingdotseq T_C$<br>$T_{E2} \fallingdotseq T_C$ | $\Delta T_{E1-C} \leqq T_3$<br>$\Delta T_{E2-C} \leqq T_3$ |
| Third flow pattern type | $T_{E1}$ $T_C$ $T_{E2}$ | $T_1 \leqq \Delta T_{H-L} \geqq T_2$ | $T_{E1} > T_C$<br>$T_{E2} > T_C$ | $\Delta T_{E1-C} \leqq T_3$<br>$\Delta T_{E2-C} > T_3$<br>$T_3 < T_4 < \Delta T_{E2-C}$ |
| Fourth flow pattern type | $T_{E1}$ $T_C$ $T_{E2}$ | $T_1 \leqq \Delta T_{H-L} > T_2$ | $T_{E1} > T_C$<br>$T_{E2} > T_C$ | $\Delta T_{E1-C} \leqq T_3$<br>$\Delta T_{E2-C} > T_3$<br>$T_3 < \Delta T_{E2-C} \leqq T_4$ |
| Fifth flow pattern type | $T_{E1}$ $T_C$ $T_{E2}$ | $T_1 \leqq \Delta T_{H-L} > T_2$ | $T_{E1} < T_C$<br>$T_{E2} > T_C$ | $\Delta T_{E1-C} \leqq T_3$<br>$\Delta T_{E2-C} > T_3$<br>$T_3 < T_4 < \Delta T_{E2-C}$ |
| Sixth flow pattern type | $T_{E1}$ $T_C$ $T_{E2}$ | $T_1 \leqq \Delta T_{H-L} > T_2$ | $T_{E1} < T_C$<br>$T_{E2} > T_C$ | $\Delta T_{E1-C} \leqq T_3$<br>$\Delta T_{E2-C} > T_3$<br>$T_3 < \Delta T_{E2-C} \leqq T_4$ |
| Seventh flow pattern type | $T_{E1}$ $T_C$ $T_{E2}$ | $T_1 \leqq \Delta T_{H-L} \leqq T_2$ | $T_{E1} < T_C$<br>$T_{E2} < T_C$ | $\Delta T_{E1-C} < T_3$<br>$\Delta T_{E2-C} < T_3$ |
| Eighth flow pattern type | $T_{E1}$ $T_C$ $T_{E2}$ | $T_1 \leqq \Delta T_{H-L} > T_2$ | $T_{E1} < T_C$<br>$T_{E2} < T_C$ | $\Delta T_{E1-C} > T_3$<br>$\Delta T_{E2-C} > T_3$ |
| Ninth flow pattern type | $T_{E1}$ $T_C$ $T_{E2}$ | $T_1 > \Delta T_{H-L}$ | $T_{E1} \fallingdotseq T_C$<br>$T_{E2} \fallingdotseq T_C$ | $\Delta T_{E1-C} \leqq T_3$<br>$\Delta T_{E2-C} \leqq T_3$ |
| Tenth flow pattern type | $T_{E1}$ $T_C$ $T_{E2}$ | $T_1 \leqq \Delta T_{H-L} \leqq T_2$ | $T_{E1} < T_C$<br>$T_{E2} \fallingdotseq T_C$ | $\Delta T_{E1-C} \leqq T_3$<br>$\Delta T_{E2-C} \leqq T_3$ |

Double roll flow pattern

Single roll flow pattern

Fig. 29

| Flow pattern type | | Flow control type | | |
|---|---|---|---|---|
| First flow pattern type | 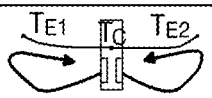 | First flow control type | Existing control condition maintenance | 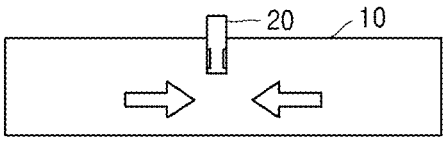 |
| Second flow pattern type | 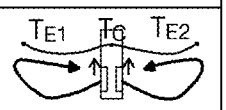 | | | |
| Third flow pattern type | 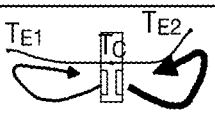 | Second flow control type | EMLS single side control | 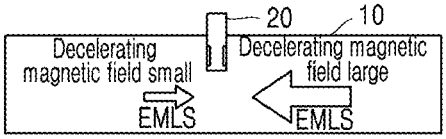 |
| Fourth flow pattern type | 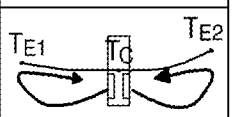 | | | |
| Fifth flow pattern type | 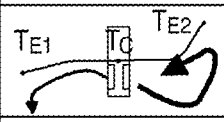 | Third flow control type | EMLS /LA single side control | 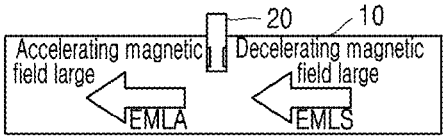 |
| Sixth flow pattern type | 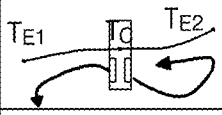 | | | |
| Seventh flow pattern type | 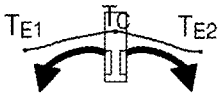 | Fourth flow control type | EMLA both side control | 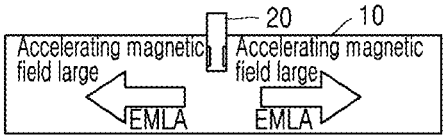 |
| Eighth flow pattern type | 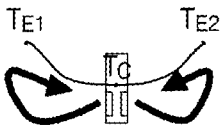 | Fifth flow control type | EMLS both side control | 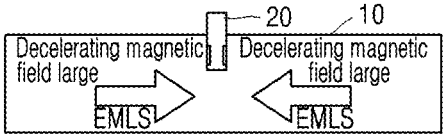 |
| Ninth flow pattern type | 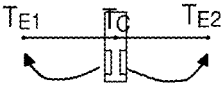 | Sixth flow control type | EMRS both side control | 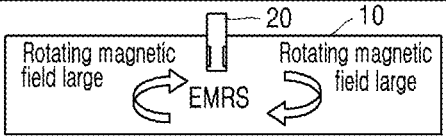 |
| Tenth flow pattern type | 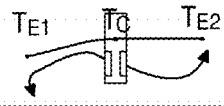 | Seventh flow control type | EMLS /LA single side control | 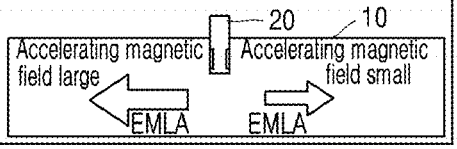 |

Coil Carrent Phase

500 : 510a, 510b, 510c, 510d

500 : 510a, 510b, 510c, 510d

500 : 510a, 510b, 510c, 510d

500 : 510a, 510b, 510c, 510d

MENISCUS FLOW CONTROL DEVICE AND MENISCUS FLOW CONTROL METHOD USING SAME

TECHNICAL FIELD

The present invention relates to a meniscus flow control device and a meniscus flow control method using the same, and more particularly, a meniscus flow control device that easily controls a flow of a molten steel meniscus within a mold and a meniscus flow control method using the same.

BACKGROUND ART

In general, a continuous casting process is a process in which molten steel is continuously injected into a mold having a predetermined shape, and then the molten steel that is semisolidified within the mold is continuously drawn to a lower side of the mold to manufacture semifinished products having various shapes such as a slab, a bloom, and a billet. Since cooling water circulates in the mold, the injected molten steel is semisolidified to form a predetermined shape. That is, the molten steel that is in a molten state is semisolidified by a primary cooling effect in the mold, and the non-solidified molten steel drawn from the mold is solidified by the cooling water sprayed from a secondary cooling bed installed at a lower portion of the mold to extend, thereby forming a slab that is completely solid state.

The primary cooling in the mold is the most important factor in determining of surface quality of the slab. That is, the primary cooling may be under the control of the flow of the molten steel within the mold. In general, a mold flux is applied on the molten steel meniscus to lubricate between the molten steel and an inner wall of the mold and maintain a temperature of the molten steel. However, when a fast flow or bias flow occurs on the molten steel meniscus within the mold, the mold flux may be inserted and mixed to cause defects of the slab.

Thus, to prevent the defects of the slab due to the flow of the meniscus from occurring, it is necessary to measure the flow of the molten steel meniscus within mold in real-time during the casting process. However, since the molten steel is maintained in a high-temperature state within the mold, it is difficult to measure a flow pattern (or a flow pattern or a flow form) of the meniscus in real-time. Also, since the mold flux is applied to the molten steel meniscus, it is difficult to allow a worker to confirm and observe the molten steel meniscus by using naked eyes or a camera.

A technology for measuring a height of a meniscus through an eddy current level meter (ECLM) using an electromagnetic induction coil to control the height of the meniscus by using the measured height as disclosed in Korean Patent Registration No. 10-1244323 is being used as a method for detecting a meniscus flow of molten steel within a mold. However, in the above-described method, since only a height of any one point is measured, it is impossible to measure the molten steel flow on the entire meniscus.

Also, since a slab varies in width according to a size of the desired slab, it is difficult to measure a meniscus form in real-time due to the varying slab.

DISCLOSURE OF THE INVENTION

Technical Problem

The present invention provides a meniscus flow control device that is capable of visualizing a flow of a molten steel meniscus within a mold to control a meniscus flow by using the visualized flow of the molten steel meniscus and a meniscus control method using the same.

The present invention provides a casting device that is capable of easily monitoring a normal or abnormal state of a meniscus flow to reduce an occurrence of defects with respect to the meniscus flow and a molten steel flow control method.

The present invention provides a meniscus flow control device that controls a method for controlling a flow of a meniscus according to a flow pattern of the molten steel meniscus within a mold to reduce an occurrence of defects of a slab due to the meniscus flow and a meniscus flow control method using the same.

The present invention provides a meniscus visualizing device that is capable of visualizing a meniscus form regardless of a width of a slab and a meniscus visualizing method using the same.

Technical Solution

A meniscus flow control device according to the present invention includes: a plurality of temperature measurers measuring a temperature in a width direction of a mold receiving molten steel therein at a plurality of positions; a meniscus flow detection unit detecting a relative temperature value for each position, which is measured by the plurality of temperature measurers in a meniscus flow form of the molten steel and relatively comparing the temperature values measured by the plurality of temperature measurers to determine whether a flow state of the molten steel meniscus is normal or abnormal; a magnetic field generation unit installed outside the mold to generate magnetic fields and thereby to control the flow of the molten steel; a flow control unit maintaining an operation of the magnetic field generation unit in the present state when it is determined that the meniscus flow state detected by the meniscus flow detection unit is normal and controlling the operation of the magnetic field generation unit to adjust the meniscus flow to be normal when it is determined that the detected meniscus flow state is abnormal.

The meniscus flow detection unit may relatively represent the temperature values measured by the plurality of temperature measurers to the temperature value for each position of the molten steel meniscus to detect the flow form of the molten steel meniscus.

The meniscus flow detection unit may calculate temperature differences between the temperatures of the plurality of temperature measurers and compare whether the calculated temperature differences are in a reference temperature range to determine the flow state of the molten steel meniscus to be normal or abnormal.

The meniscus flow detection unit may calculate temperature differences with the rest temperature measurers with respect to the plurality of temperature measurers and compare the temperature differences to the reference temperature range to determine the meniscus flow state to be normal or abnormal.

The meniscus flow detection unit may determine the meniscus flow state to be normal when all the temperature difference values with the rest temperature measurers with respect to the plurality of temperature measurers are in the reference temperature range and determine the meniscus flow state to be abnormal when at least one temperature difference value of the temperature difference values with the rest temperature measurers with respect to the plurality of temperature measurers is out of the reference temperature range.

The meniscus flow detection unit may calculate temperature differences between the temperature measurers, which are disposed at both ends, of the plurality of temperature measurers and compare whether each of the calculated temperature differences between the temperature measurers, which are disposed at both ends, is in a reference temperature range to determine the flow state of the molten steel meniscus to be normal or abnormal.

The meniscus flow detection unit may calculate a temperature difference between the temperature measurer, which is disposed at a center, and the temperature measurer, which is installed at one end, of the plurality of temperature measurers and a temperature difference between the temperature measurer, which is disposed at the center, and the temperature measurer, which is installed at the other end, of the plurality of temperature measurers, compare the temperature difference between the temperature measurer, which is disposed at the center, and the temperature measurer, which is installed at one end to a reference temperature range, and compare the temperature difference between the temperature measurer, which is disposed at the center, and the temperature measurer, which is installed at the other end to the reference temperature range to determine the flow state of the molten steel meniscus to be normal or abnormal.

The meniscus flow detection unit may determine the flow state of the molten steel to be normal when all the temperature difference between the temperature measurer, which is disposed at the center, and the temperature measurer, which is installed at one end, and the temperature difference between the temperature measurer, which is disposed at the center, and the temperature measurer, which is installed at the other end are in the reference temperature range and determine the flow state of the molten steel to be abnormal when at least one of the temperature difference between the temperature measurer, which is disposed at the center, and the temperature measurer, which is installed at one end, and the temperature difference between the temperature measurer, which is disposed at the center, and the temperature measurer, which is installed at the other end is out of the reference temperature range.

The meniscus flow detection unit may calculate a mean temperature with respect to the temperatures of the plurality of temperature measurers, calculates a difference between the temperature of the temperature measurer, which is disposed at one end, of the plurality of temperature measurers and the mean temperature and a difference between the temperature of the temperature measurer, which is disposed at the other end, of the plurality of temperature measurers and the mean temperature, and compare the temperature differences between the temperature measurers, which are disposed at the one end and the other end, and the mean temperature to a reference temperature range to determine the flow state of the molten steel meniscus to be normal or abnormal.

The meniscus flow detection unit may determine the flow state of the meniscus to be normal when all the temperature difference between the mean temperature and the temperature of the temperature measurer, which is disposed at the one end, and the temperature difference between the mean temperature and the temperature of the temperature measurer, which is disposed at the one end, are in the reference temperature range and determine the flow state of the meniscus to be abnormal when at least one of the temperature difference between the mean temperature and the temperature of the temperature measurer, which is disposed at the one end, and the temperature difference between the mean temperature and the temperature of the temperature measurer, which is disposed at the one end, is out of the reference temperature range.

The meniscus flow detection unit may measure temperatures of the temperature measurer, which is disposed at a center, and the temperature measurers, which are disposed at one end and the other end, of the plurality of temperature measurers installed to be arranged in the width direction of the mold during casting of a slab, calculate a time-series mean temperature of the temperature measurer, which is disposed at the center, calculates each of temperature differences between the time-series mean temperature and the temperatures of the temperature measurers, which are disposed at the one end and the other end, and compare each of the temperature differences between the time-series mean temperature and the temperatures of the temperature measurers, which are disposed at the one end and the other end, to a reference temperature range to determine the flow state of the molten steel meniscus to be normal or abnormal.

The meniscus flow detection unit may measure the temperature measurer, which is disposed at the center, from an initial casting time point at which the molten steel is discharged from the mold to calculate a time-series mean temperature in real-time and determine the flow state of the molten steel by using the temperatures of the temperature measurers, which are disposed at the one end and the other end, after calculating the time-series mean temperature of the temperature measurer, which is disposed at the center, till a predetermined time point.

The meniscus flow detection unit may determine the flow state of the meniscus to be normal when all the temperature difference between the time-series mean temperature of the temperature measurer, which is disposed at the center, and the temperature of the temperature measurer, which is disposed at the one end, and the temperature difference between the time-series mean temperature of the temperature measurer, which is disposed at the center, and the temperature of the temperature measurer, which is disposed at the other end, are in the reference temperature range and determine the flow state of the meniscus to be abnormal when at least one of the temperature difference between the time-series mean temperature of the temperature measurer, which is disposed at the center, and the temperature of the temperature measurer, which is disposed at the one end, and the temperature difference between the time-series mean temperature of the temperature measurer, which is disposed at the center, and the temperature of the temperature measurer, which is disposed at the other end, is out of the reference temperature range.

The meniscus flow detection unit may measure temperatures of the temperature measurer, which is disposed at one end, the temperature measurer, which is installed just adjacent to the one end, the temperature measurer, which is disposed at the other end, and the temperature measurer, which is installed just adjacent to the other end, of the plurality of temperature measurers arranged in the width direction of the mold during the casting of the slab, calculate a first temperature difference that is a temperature difference between the temperature of the temperature measurer, which is disposed at the one end, and the temperature of the temperature measurer, which is disposed just adjacent to the one end, calculates a second temperature difference that is a temperature difference between the temperature of the temperature measurer, which is disposed at the other end, and the temperature of the temperature measurer, which is disposed just adjacent to the other end, and compare each of the first and second temperature differences to a reference temperature range to determine the flow state of the molten steel meniscus to be normal or abnormal.

The meniscus flow detection unit may determine the meniscus flow state to be normal when all the first and second temperature differences are in the reference temperature range and determine the meniscus flow state to be abnormal when at least one of the first and second temperature differences is out of the reference temperature range.

The flow control unit may confirm a position of the temperature measurer in which the calculated temperature difference is out of the reference temperature range and control an operation of the magnetic field generation unit corresponding to the temperature measurer in which the calculated temperature difference is out of the reference temperature range to adjust at least one of a movement direction, intensity, and moving speed of the magnetic fields.

The flow control unit may detect a difference between the calculated temperature difference and the reference temperature range to confirm whether the calculated temperature difference is less than or exceeds the reference temperature range, adjust intensity of current applied to the magnetic field generation unit according to the difference between the calculated temperature difference and the reference temperature range, and move the magnetic fields to the magnetic field generation unit in the same direction as or a direction opposite to a direction in which the molten steel is discharged from the nozzle installed in the mold according to whether the calculated temperature difference is less than or exceeds the reference temperature range.

The meniscus flow control device may further include a flow pattern classification unit analyzing the meniscus flow form detected by the flow detection unit to classify the meniscus flow form into one flow pattern type of the plurality of previously stored flow pattern types, wherein the flow pattern classification unit may store a plurality of flow control types according to the plurality of flow pattern types stored in the flow pattern classification unit and select one flow control type according to the classified flow pattern type of the plurality of flow control types to control an operation of the magnetic field generation unit.

The flow pattern classification unit may include: a flow pattern type storage part in which the plurality of flow pattern types are stored; and a pattern classification part comparing temperature data including the meniscus flow form detected by the meniscus flow detection unit to temperature data including the plurality of previously stored flow pattern types to classify the detected meniscus flow form into one flow pattern type of the plurality of previously stored flow pattern types.

The plurality of flow pattern types stored in the flow pattern type storage part may be classified into different kinds of flow pattern types according to a temperature for each position of the meniscus and a temperature distribution of the meniscus, and the plurality of flow pattern types may include at least one normal flow pattern in which possibility of occurrence of defects due to the meniscus flow is low and a plurality of abnormal flow patterns in which the possibility of the occurrence of the defects due to the meniscus flow is high.

The flow control unit may include: a flow control type storage part in which the plurality of flow control types are stored so that control conditions of the magnetic field generation unit are changed according to the plurality of flow pattern types stored in the flow pattern type storage part to control the meniscus flow; a flow control type selection part selecting one flow control type from the plurality of flow control types stored in the flow control type storage part according to the classified flow pattern type; and an electromagnetic control part controlling power applied to the magnetic field generation unit according to the flow control type selected by the flow control type selection part to control a movement direction of the magnetic fields.

The mold may include first and second long sides facing each other and first and second short sides disposed between the first and second long sides and installed to be spaced apart from each other and to face each other, the plurality of temperature measurers may be respectively installed at the first and second long sides and the first and second short sides of the mold, the nozzle through which the molten steel may be discharged to the mold is installed at a central position of each of the first and second long sides of the mold, the magnetic field generation unit may be installed to be arranged in an extension direction of the first long side and include first and second magnetic field generation parts installed symmetrical to each other with respect to the nozzle and the third and fourth magnetic field generation parts installed to be arranged in an extension direction of the second long side and installed symmetrical to each other with respect to the nozzle, and the electromagnetic control part may be connected to the first to fourth magnetic filed generation parts to control power applied to each of the first to fourth magnetic field generation parts according to the flow control type selected by the flow control type selection part and thereby to control the movement direction of the magnetic fields at each of the first to fourth magnetic field generation parts.

The flow control unit may maintain the magnetic field movement direction of each of the first to fourth magnetic field generation parts when the detected meniscus flow form is classified into the normal flow pattern and controls the magnetic field movement direction of each of the first to fourth magnetic field generation parts so that the detected meniscus flow form becomes the normal flow pattern when the detected meniscus flow form is classified into one of the plurality of abnormal flow patterns.

The flow control unit may control the magnetic field movement direction of each of the first to fourth magnetic field generation parts and current density applied to each of the first to fourth magnetic field generation parts according to the magnetic field movement direction and current density conditions of the selected flow control type.

The plurality of temperature measurers may be installed to be spaced the same interval from each other at positions higher than the molten steel meniscus received in the mold.

The temperature measurers may be installed at a height of 50 mm or less from the meniscus.

A spaced distance between the temperature measurers, which are disposed on a fixed width area of the mold, of the plurality of temperature measurers may be greater than that between the temperature measurers disposed on a variable width area disposed outside the fixed width area.

The plurality of temperature measurers may be installed at a height of 50 mm or less upward and downward from the meniscus of the molten steel.

The mold may include a pair of long sides spaced apart and facing each other and a pair of short sides facing each other on both sides of the long sides, and the plurality of temperature measurers may be disposed on the long sides.

A spaced distance between the temperature measurers disposed on the fixed width area may range from 55 to 300 mm.

A spaced distance between the temperature measurers disposed on the variable width area may range from 10 to 50 mm.

The spaced distances between the plurality of temperature measurers may be gradually reduced outward from a center in the width direction of the long sides.

The spaced distances between the temperature measurers disposed on the fixed width area may be gradually reduced outward.

The spaced distances between the temperature measurers disposed on the variable width area may be gradually reduced outward.

A meniscus flow control method according to the present invention includes: measuring temperatures at a plurality of positions in a width direction of a molten steel meniscus by using a plurality of temperature measurers installed to be arranged in a width direction of a mold; relatively analyzing the measured to temperatures according to the positions to detect a meniscus flow form of the molten steel and relatively comparing the temperature values measured by the plurality of temperature measurers to each other to determine a flow state of the molten steel meniscus to be normal or abnormal; and maintaining an operation of a magnetic field generation unit installed outside the mold to the present state when it is determined that the flow state of the molten steel is normal and controlling the operation of the magnetic field generation unit to adjust magnetic fields when it is determined that the flow state of the meniscus is abnormal, thereby adjusting the meniscus flow to be normal.

The relatively analyzing of the measured temperatures according to the positions to detect the meniscus flow form of the molten steel may include relatively comparing the plurality of temperature values to represent the temperature values as relative heights for respective positions of the molten steel meniscus and thereby to detect the meniscus flow form of the molten steel.

The determining the flow state of the molten steel meniscus to be normal or abnormal may include calculating temperature differences between the temperatures of the plurality of temperature measurers and comparing whether the calculated temperature differences are in a reference temperature range to determine the flow state of the molten steel meniscus to be normal or abnormal.

The calculating of the temperature differences between the temperatures of the plurality of temperature measurers and comparing whether the calculated temperature differences are in the reference temperature range may include calculating temperature differences with the rest temperature measurers with respect to the plurality of temperature measurers and including the temperature differences to the reference temperature range to determine the meniscus flow state to be normal or abnormal.

The meniscus flow detection unit may determine the meniscus flow state to be normal when all the temperature difference values with the rest temperature measurers with respect to the plurality of temperature measurers are in the reference temperature range and determine the meniscus flow state to be abnormal when at least one temperature difference value of the temperature difference values with the rest temperature measurers with respect to the plurality of temperature measurers is out of the reference temperature range.

The determining of the flow state of the molten steel meniscus to be normal or abnormal may include: measuring the temperatures in real-time by using the temperature measurers, which are disposed at both ends, of the plurality of temperature measurers; and calculating temperature differences between the temperature measurers, which are disposed at both the ends, and comparing whether each of the calculated temperature differences between the temperature measurers, which are disposed at both the ends, is in a reference temperature range to determine the flow state of the molten steel meniscus to be normal or abnormal.

The determining of the flow state of the molten steel meniscus to be normal or abnormal may include: measuring temperatures in real-time by using the temperature measurer, which is disposed at a center, the temperature measurer, which is installed at one end, and the temperature measurer, which is installed at the other end, of the plurality of temperature measurers; and comparing the temperature difference between the temperature measurer, which is disposed at the center, and the temperature measurer, which is installed at one end to a reference temperature range and comparing the temperature difference between the temperature measurer, which is disposed at the center, and the temperature measurer, which is installed at the other end to the reference temperature range to determine the flow state of the molten steel meniscus to be normal or abnormal.

When all the temperature difference between the temperature measurer, which is disposed at the center, and the temperature measurer, which is installed at one end, and the temperature difference between the temperature measurer, which is disposed at the center, and the temperature measurer, which is installed at the other end are in the reference temperature range, the flow state of the molten steel may be determined to be normal, and when at least one of the temperature difference between the temperature measurer, which is disposed at the center, and the temperature measurer, which is installed at one end, and the temperature difference between the temperature measurer, which is disposed at the center, and the temperature measurer, which is installed at the other end is out of the reference temperature range, the flow state of the molten steel may be determined to be abnormal.

The determining of the flow state of the molten steel meniscus to be normal or abnormal may include: measuring the temperatures in real time by using the plurality of temperature measurers; calculating a mean temperature with respect to the temperatures of the plurality of temperature measurers; calculating a difference between the temperature of the temperature measurer, which is disposed at one end, and the mean temperature and a difference between the temperature of the temperature measurer, which is disposed at the other end, and the mean temperature, of the plurality of temperature measurers; and comparing the difference between the temperature of each of the temperature measurers, which are disposed at the one end and the other end, and the mean temperature to compare a reference temperature range to determine the flow state of the molten steel meniscus to be normal or abnormal.

When all the temperature difference between the mean temperature and the temperature of the temperature measurer, which is disposed at the one end, and the temperature difference between the mean temperature and the temperature of the temperature measurer, which is disposed at the one end, are in the reference temperature range, the flow state of the meniscus may be determined to be normal, and when at least one of the temperature difference between the mean temperature and the temperature of the temperature measurer, which is disposed at the one end, and the temperature difference between the mean temperature and the temperature of the temperature measurer, which is disposed at the one end, is out of the reference temperature range, the flow state of the meniscus may be determined to be abnormal.

The determining of the flow state of the molten steel meniscus to be normal or abnormal may include: measuring the temperatures of the temperature measurer, which is disposed at a center, and the temperature measurers, which are disposed at one end and the other end, of the plurality of temperature measurers in real-time; calculating a time-series mean temperature of the temperature measurer, which is disposed at the center; calculating each of temperature differences between the time-series mean temperature and the temperatures of the temperature measurers, which are disposed at the one end and the other end; and comparing each of the temperature differences between the time-series mean temperature and the temperatures of the temperature measurers, which are disposed at the one end and the other end, to a reference temperature range to determine the flow state of the molten steel meniscus to be normal or abnormal.

The calculating of the time-series mean temperature of the temperature measurer, which is disposed at the center, may include: measuring the temperature measurer, which is disposed at the center, from an initial casting time point at which the molten steel is discharged from the mold to calculate a time-series mean temperature in real-time; and determining the flow state of the molten steel by using the temperatures of the temperature measurers, which are disposed at the one end and the other end, after calculating the time-series mean temperature of the temperature measurer, which is disposed at the center, till a predetermined time point.

When all the temperature difference between the time-series mean temperature of the temperature measurer, which is disposed at the center, and the temperature of the temperature measurer, which is disposed at the one end, and the temperature difference between the time-series mean temperature of the temperature measurer, which is disposed at the center, and the temperature of the temperature measurer, which is disposed at the other end, are in the reference temperature range, the flow state of the meniscus may be determined to be normal, and when at least one of the temperature difference between the time-series mean temperature of the temperature measurer, which is disposed at the center, and the temperature of the temperature measurer, which is disposed at the one end, and the temperature difference between the time-series mean temperature of the temperature measurer, which is disposed at the center, and the temperature of the temperature measurer, which is disposed at the other end, is out of the reference temperature range, the flow state of the meniscus may be determined to be abnormal.

The determining of the flow state of the molten steel meniscus to be normal or abnormal may include: measuring the temperatures of the temperature measurer, which is disposed at one end, the temperature measurer, which is installed just adjacent to the one end, the temperature measurer, which is disposed at the other end, and the temperature measurer, which is installed just adjacent to the other end, of the plurality of temperature measurers; calculating a first temperature difference that is a temperature difference between the temperature of the temperature measurer, which is disposed at the one end, and the temperature of the temperature measurer, which is disposed just adjacent to the one end; calculating a second temperature difference that is a temperature difference between the temperature of the temperature measurer, which is disposed at the other end, and the temperature of the temperature measurer, which is disposed just adjacent to the other end; and comparing each of the first and second temperature differences to a reference temperature range to determine the flow state of the molten steel meniscus to be normal or abnormal.

When all the first and second temperature differences are in the reference temperature range, the meniscus flow state may be determined to be normal, and when at least one of the first and second temperature differences is out of the reference temperature range, the meniscus flow state may be determined to be abnormal.

The reference temperature range may be a temperature difference value in which a defect rate is 80% or less.

The reference temperature range may range from 15° C. to 70° C.

The adjusting of the meniscus flow to be normal may include: confirming a position of the temperature measurer in which the calculated temperature difference is out of the reference temperature range; and controlling an operation of the magnetic field generation unit corresponding to the temperature measurer in which the calculated temperature difference is out of the reference temperature range to adjust at least one of a movement direction, intensity, and moving speed of the magnetic fields.

The controlling of the operation of the magnetic field generation unit corresponding to the temperature measurer in which the calculated temperature difference is out of the reference temperature range may include: detecting a difference between the calculated temperature difference and the reference temperature range to confirm whether the calculated temperature difference is less than or exceeds the reference temperature range; adjusting intensity of current applied to the magnetic field generation unit according to the difference between the calculated temperature difference and the reference temperature range; and moving the magnetic fields to the magnetic field generation unit in the same direction as or a direction opposite to a direction in which the molten steel is discharged from the nozzle installed in the mold according to whether the calculated temperature difference is less than or exceeds the reference temperature range.

The meniscus flow control method may further include: classifying the detected meniscus flow form into one flow pattern type of the plurality of stored flow pattern types; selecting one of the plurality of previously stored flow control types according to the classified flow pattern type to select the flow control type; and controlling magnetic field formation in the magnetic field generation unit installed outside the mold according to the selected flow control type.

The classifying of the detected meniscus flow form into one flow pattern type of the plurality of previously stored flow pattern types may include: classifying the plurality of flow pattern types which are capable of occurring during a casting process; comparing the plurality of previously stored flow pattern types to the meniscus flow form; classifying temperature data including the detected meniscus flow form into one flow pattern type of the plurality of previously stored flow pattern types.

The plurality of previously stored flow pattern types may include at least one normal flow pattern in which possibility of occurrence of defects due to the meniscus flow is low and a plurality of abnormal flow patterns in which the possibility of the occurrence of the defects due to the meniscus flow is high.

The controlling of the magnetic field formation of the magnetic field generation unit according to the classified flow pattern type may include selecting a corresponding flow control type for each of the plurality of flow pattern types, of the plurality of flow control types and applying power to the magnetic field generation unit according to the selected flow control type to control a magnetic field movement direction of the magnetic field generation unit.

The controlling of the magnetic field formation of the magnetic field generation unit according to the classified flow pattern type may include controlling the magnetic field movement direction and current density of the magnetic field generation unit according to conditions of the magnetic field movement direction and the current density of the selected flow control type.

The mold may include first and second long sides facing each other and first and second short sides disposed between the first and second long sides and installed to be spaced apart from each other and to face each other, the plurality of temperature measurers are respectively installed at the first and second long sides and the first and second short sides of the mold, the nozzle through which the molten steel is discharged to the mold may be installed at a central position of each of the first and second long sides of the mold, the magnetic field generation unit may be installed to be arranged in an extension direction of the first long side and include first and second magnetic field generation parts installed symmetrical to each other with respect to the nozzle and the third and fourth magnetic field generation parts installed to be arranged in an extension direction of the second long side and installed symmetrical to each other with respect to the nozzle, and the magnetic field generation unit may be controlled in operation to adjust the magnetic fields and control power applied to the first to fourth magnetic field generation parts according to the selected flow control type and thereby control the movement direction of the magnetic fields in the first to fourth magnetic field generation parts so that the meniscus flow is normal.

In the detected meniscus flow form, a normal flow pattern and an abnormal flow pattern may be classified according to a temperature deviation between a maximum temperature and a minimum temperature of the plurality of temperature values detected at a plurality of positions on the meniscus of each of the one side and the other side of the nozzle, whether the temperatures at both edges of the meniscus are higher or lower than that at a center of the meniscus, and a difference between the temperature at each of both the edges and the temperature at the center, and the plurality of flow pattern types may be classified into abnormal flow pattern types different from each other according to the temperature deviation between the maximum temperature and the minimum temperature, whether the temperatures at both the edges of the meniscus are higher or lower than that at the center of the meniscus, and the difference between the temperature at each of both the edges and the temperature at the center in temperature data of each of the plurality of flow patterns.

When the temperature deviation that is a difference value between the maximum temperature and the minimum temperature of the temperature values of the detected meniscus flow form satisfies a preset reference deviation, the temperature at each of both the edges of the meniscus is equal to or greater than that at the center, each of first and second temperature deviations that are difference values between the temperatures at both the edges of the meniscus and the temperature at the center is less than a reference value, it may be classified into the normal flow pattern, and when the meniscus temperature deviation is out of the reference deviation, each of the first and second temperature deviations is less than the center temperature, or at least one of the first and second temperature deviations exceeds a preset reference value, it may be classified into the abnormal flow pattern.

When the detected meniscus flow form is classified into one of the plurality of abnormal flow patterns, if at least one of the temperatures at both the ends of the detected meniscus flow form is higher than that at the center, in the first to fourth magnetic field generation parts, the magnetic fields of the magnetic field generation part corresponding to an area in which the temperature at each of both the edges is higher than that at the center may be adjusted to move to the nozzle, thereby decelerating a molten steel flow speed.

When the detected meniscus flow form is classified into one of the plurality of abnormal flow patterns, if at least one of the temperatures at both the ends of the detected meniscus flow form is lower than that at the center, in the first to fourth magnetic field generation parts, the magnetic fields of the magnetic field generation part corresponding to an area in which the temperature at each of both the edges is lower than that at the center may be adjusted to move outside from the nozzle, thereby accelerating the molten steel flow speed.

The more the temperature difference between the temperature at each of both the edges and the temperature at the center increases, the more the current density applied to at least one of the first to fourth magnetic field generation parts may increase to increase acceleration or deceleration of the molten steel.

When the detected meniscus flow form is classified into one of the plurality of abnormal flow patterns, if the difference value between the temperature at each of both the edges and the temperature at the center of the detected meniscus flow form is less than the lowest limit value of the reference deviation, the magnetic field movement direction in each of the first to fourth magnetic field generation parts may be different to rotate the molten steel.

Advantageous Effects

According to the embodiments of the present invention, the plurality of temperature measurers may be installed on the mold to detect the temperature for each position in the width direction of the meniscus and relatively represent the temperature and thereby to convert the temperature into the relative height for each position of the molten steel meniscus, thereby detecting the meniscus flow form. Also, the evaluation method or reference for determining the meniscus flow state may be provided in plurality, and the meniscus flow state may be determined in real-time by using one of the plurality of methods and references. Also, the operation of the magnetic field generation unit may be controlled according to the meniscus flow state that is determined in real-time to control the meniscus to the flow state in which the occurrence of the defects is less or absent. Thus, although the mold flux is applied on the molten steel meniscus during the slab casting, the flow of the meniscus may be detected in real-time and then controlled through the meniscus control device according to the embodiment of the present invention and the meniscus flow control method using the same. Thus, the occurrence of the defects due to the meniscus flow may be reduced to improve the quality of the slab.

Also, the plurality of temperature measurers may be installed on the mold to detect the temperature for each position in the width direction of the meniscus and relatively represent the temperatures and thereby to convert the temperature into the relative height for each position of the molten steel meniscus, thereby detecting the meniscus flow form. Also, the detected meniscus flow form may be classified to one of the plurality of previously stored flow pattern types, and the magnetic fields within the mold may be controlled according to the classified flow pattern type to control the flow of the molten steel that is operating to a normal flow pattern in which the possibility of the occurrence of the defects of the slab is less or absent.

Also, in the embodiments of the present invention, the plurality of temperature measurers may be installed to be spaced different distances from each other on the front surface of the copper plate, which sets a width of the mold, in the fixed width area and the variable width area of the slab width. Therefore, the temperatures of the molten steel may be detected regardless of the set values in the width direction of the slab and relatively represented to convert the temperature into the relative height for each position of the molten steel meniscus, thereby visualizing the form of the meniscus.

BRIEF DESCRIPTION OF THE DRAWINGS

FIG. 24 is a view illustrating a plurality of flow pattern types that are previously stored or set in a flow pattern type storage part according to an embodiment of the present invention.

FIG. 29 is a view illustrating the plurality of flow pattern types that are previously stored or set in the flow pattern type storage part and according to an embodiment of the present invention and a plurality of flow control types according to the plurality of flow pattern types.

MODE FOR CARRYING OUT THE INVENTION

Figure 1:
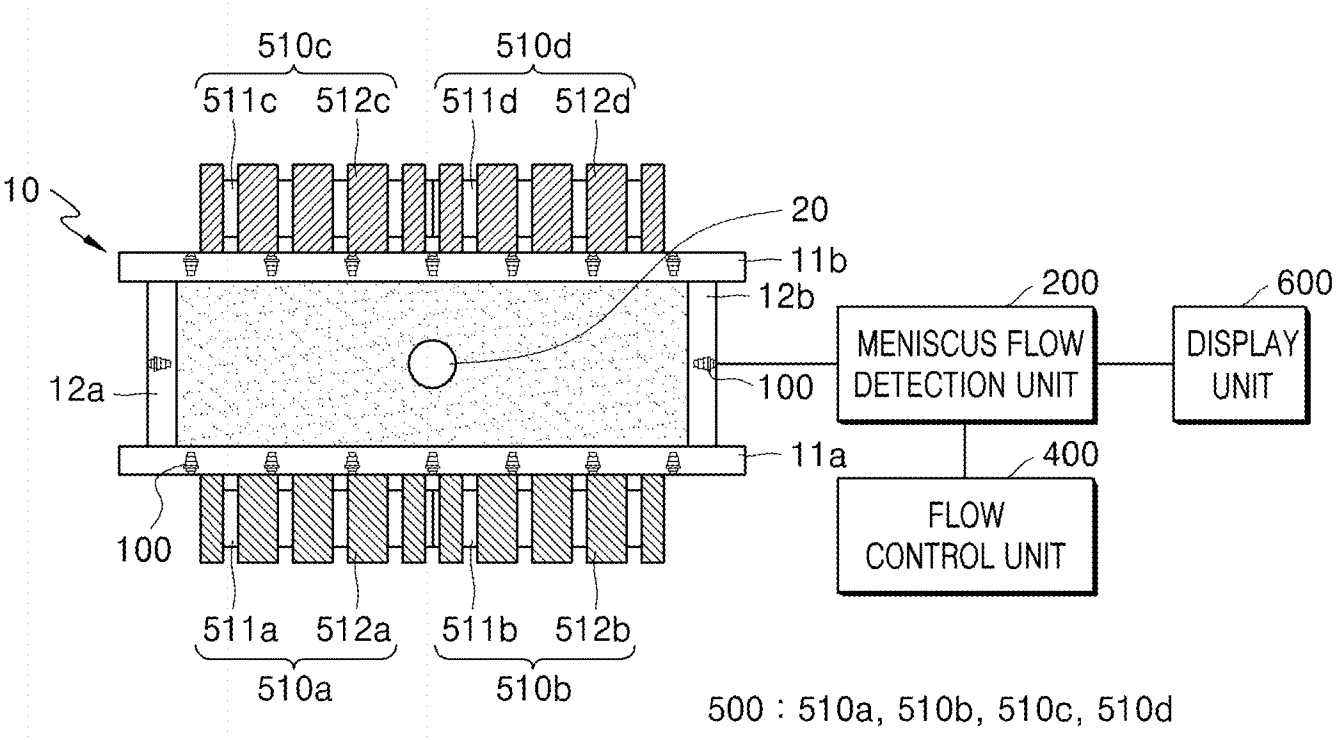
FIG. 1 is a conceptual view of a meniscus flow control device installed in a mold according to a first embodiment of the present invention.

Hereinafter, exemplary embodiments of the present invention will be described in detail with reference to the accompanying drawings. The present invention may, however, be embodied in different forms and should not be construed as limited to the embodiments set forth herein. Rather, these embodiments are provided so that the present invention will be thorough and complete, and will fully convey the scope of the present invention to those skilled in the art. In the figures, like reference numerals refer to like elements throughout.

A general casting facility includes a mold 10 receiving molten steel from a nozzle 20 to perform primary cooling, a tundish disposed above the mold 10 to temporarily store the molten steel, a nozzle installed to supply the molten steel within the tundish to the mold, and a secondary cooling bed installed below the mold 10 to inject cooling water onto a semisolidified slab drawn from the mold 10 to cool the slab. Here, the secondary cooling bed may be a component installed so that a plurality of segments extend in a direction of the mold.

Since the tundish, the nozzle 20, and the secondary cooling bed are the same as components of the general casting facility, their detailed descriptions will be omitted.

A flow of the molten steel within the mold 10 is generated by the molten steel discharged through both discharge holes of the nozzle 20, and thus, a flow is generated on a top surface of the molten steel, i.e., on a molten steel meniscus. As a result, quality of the slab is determined by a flow form of the molten steel or the meniscus. Thus, it is necessary to detect the flow of the molten steel meniscus within the mold 10 in real-time and thereby to control the flow of the molten steel in real-time. That is, when it is determined that the flow of the meniscus is abnormal during the casting of the slab, it is necessary to control and normalize the flow of the meniscus.

Thus, the present invention provides a meniscus flow control device that detects the flow state of the molten steel meniscus within the mold 10 in real-time and control the flow of the meniscus according to the flow state.

Figure 2:
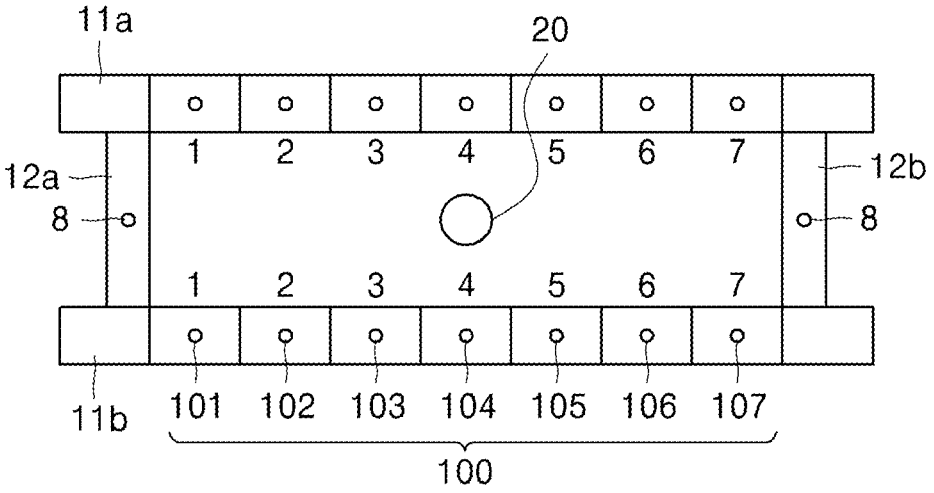
FIG. 2 is a top view illustrating a state in which temperature measurers constituting the meniscus flow control device according to the first embodiment are respectively installed on a pair of long sides and a pair of short sides of the mold.
Figure 3:
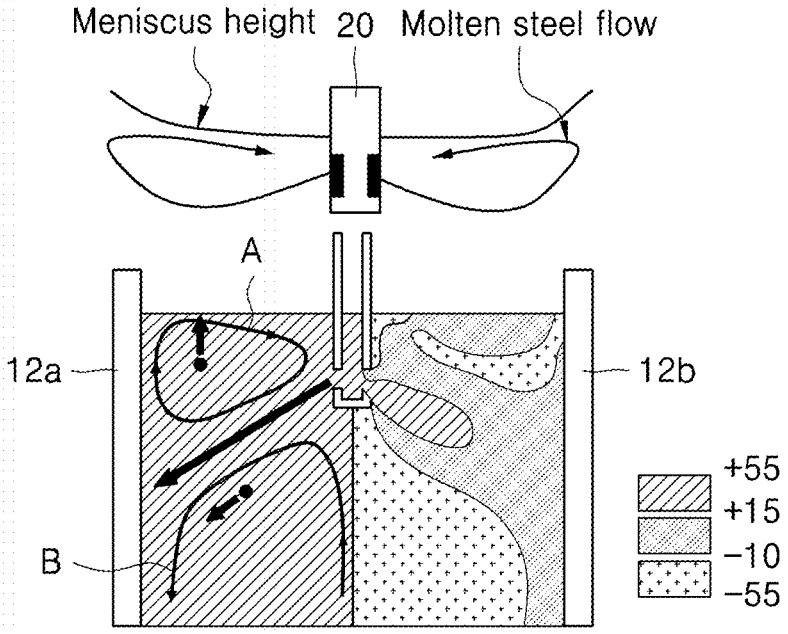
FIG. 3 is a view illustrating a double-roll flow pattern of molten steel.
Figure 4:
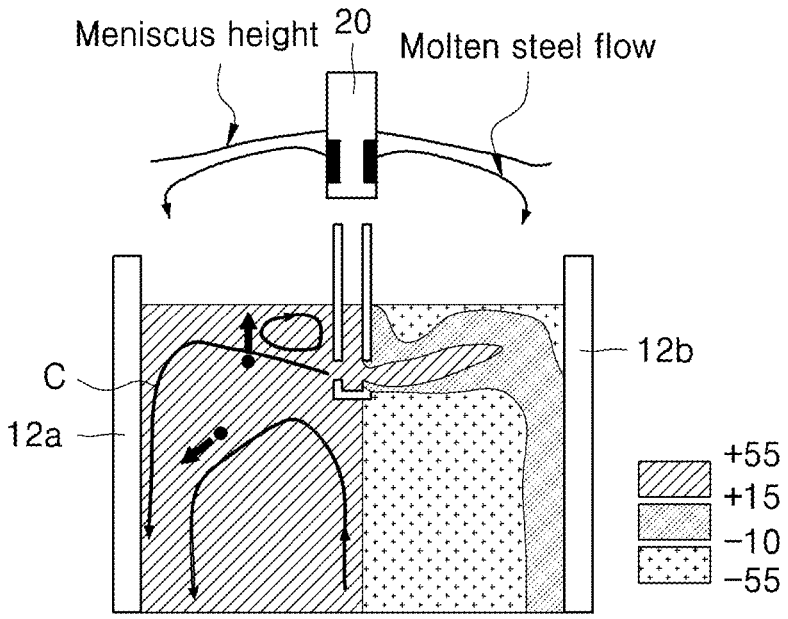
FIG. 4 is a view illustrating a single-roll flow pattern.
Figure 5:
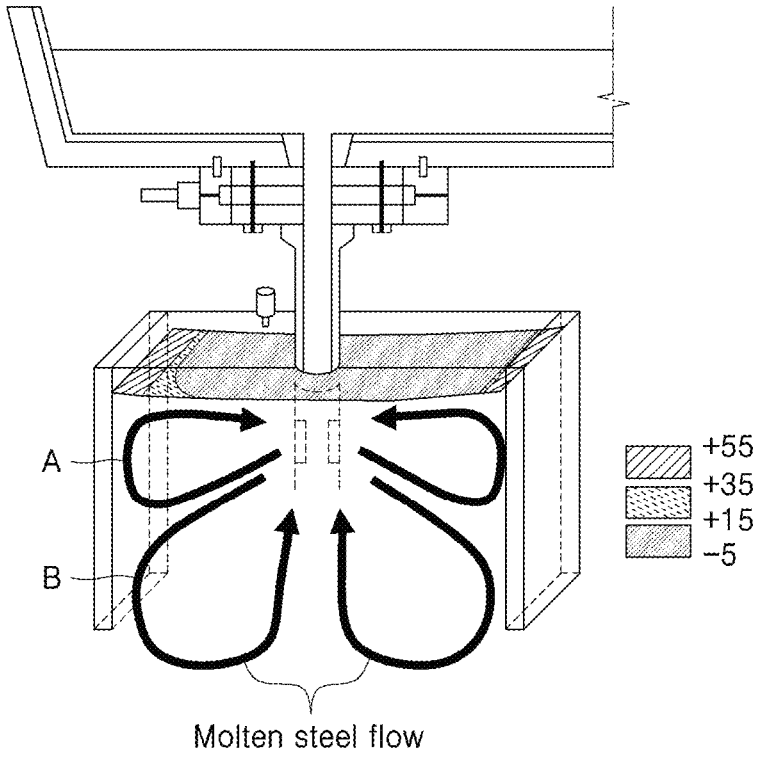
FIGS. 5 and 6 are views illustrating an example of a normal meniscus flow.
Figure 6:
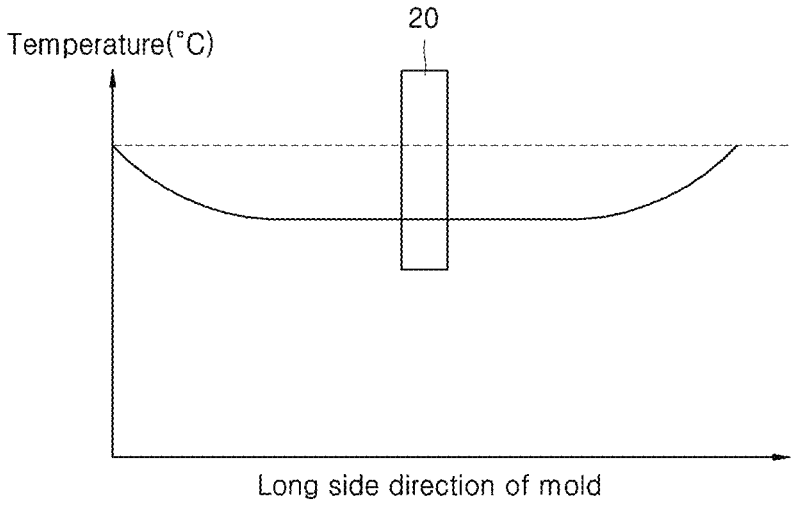
Figure 7:
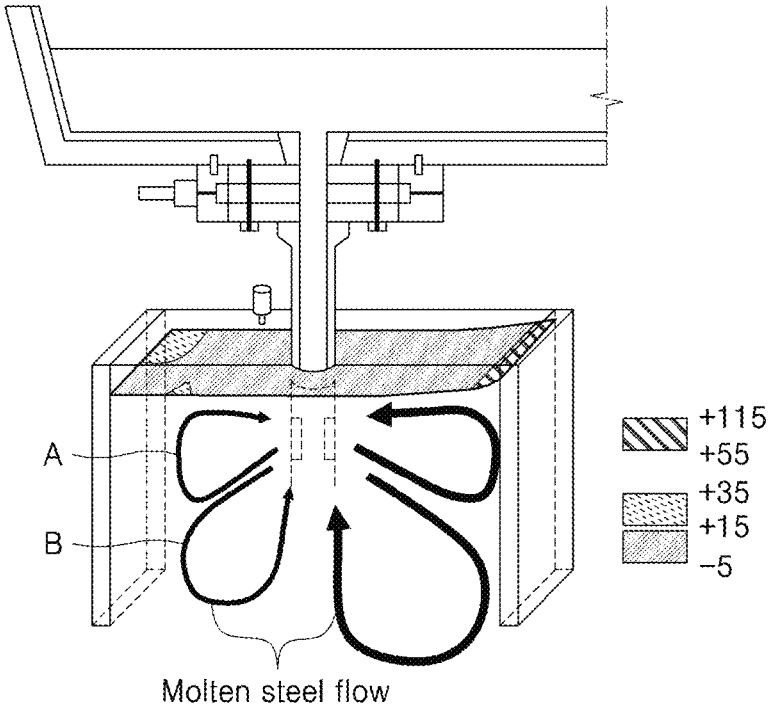
FIGS. 7 and 8 are views illustrating an example of an abnormal meniscus flow.
Figure 8:
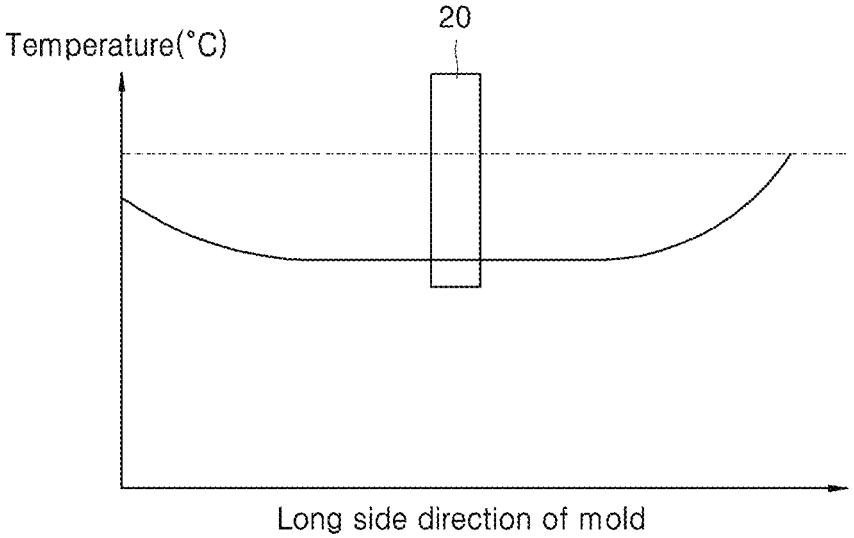
Figure 9:
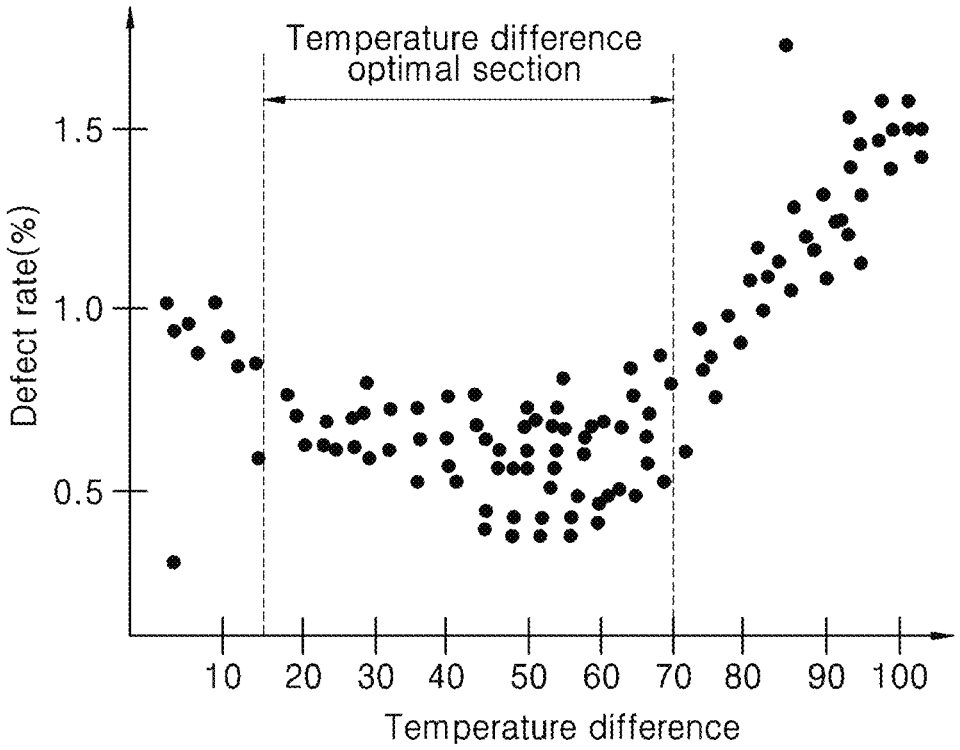
FIG. 9 is a graph illustrating a slab defect rate due to a difference in temperature of the temperature measurers.

FIG. 1 is a conceptual view of a meniscus flow control device installed in a mold according to a first embodiment of the present invention. FIG. 2 is a top view illustrating a state in which temperature measurers constituting the meniscus flow control device according to the first embodiment are installed on a pair of long sides and a pair of short sides of the mold. FIG. 3 is a view illustrating a double-roll flow pattern of molten steel, and FIG. 4 is a view illustrating a single-roll flow pattern. FIGS. 5 and 6 are views illustrating an example of a normal meniscus flow. FIGS. 7 and 8 are views illustrating an example of an abnormal meniscus flow. FIG. 9 is a graph illustrating a slab defect rate due to a difference in temperature of the temperature measurers.

Referring to FIG. 1, a casting facility including a meniscus flow control device according to a first embodiment of the present invention includes a mold 10 receiving molten steel from a nozzle 20 to cool the molten steel, a plurality of temperature measurers 100 arranged and installed to be spaced apart from each other on the mold 10 in a width direction of the mold 10 to measure a temperature at each position, a magnetic field generation unit 500 installed outside the mold 10 to generate magnetic fields for allowing the molten steel within the mold 10 to flow, a meniscus flow detection unit 200 detecting a flow of the meniscus received in the mold 10, and a flow control unit 400 controlling an operation of the magnetic field generation unit 500 according to a state of the meniscus detected by the meniscus flow detection unit 200 to adjust the flow of the meniscus, and thereby to control the molten steel meniscus so that the meniscus has the form of a normal flow pattern.

Also, although not shown, the casting facility includes a tundish disposed above the mold 10 to temporarily store the molten steel and a secondary cooling bed installed below the mold 10 to inject cooling water onto a semisolidified slab drawn from the mold 10 and thereby to cool the slab. Here, the secondary cooling bed may be a component installed so that a plurality of segments extend in a direction of the mold.

Since the tundish, the nozzle 20, and the secondary cooling bed are the same as components of the general casting facility, their detailed descriptions will be omitted.

The mold 10 receives the molten steel supplied from the nozzle 20 to primarily cool the molten steel, thereby solidifying the molten steel in a predetermined slab shape. As illustrated in FIGS. 1 and 2, the mold 10 includes two long sides 11*a* and 11*b* disposed to be spaced a predetermined distance from each other and face each other and two short sides 12*a* and 12*b* disposed to be spaced a predetermined distance from each other and face each other between the two long sides 11*a* and 11*b*. Here, each of the long sides 11*a* and 11*b* and the short sides 12*a* and 12*b* may be made of, for example, copper. Thus, the mold 10 has a predetermined space for receiving the molten steel between the two long sides 11*a* and 11*b* and the two short sides 12*a* and 12*b*. Also, the nozzle 20 is disposed at a central portion defined by the two long sides 11*a* and 11*b* and the two short sides 12*a* and 12*b* of the mold 10. The molten steel supplied from the nozzle 20 is symmetrically supplied outward from the central portion of the mold 10 to generate a discharge stream having a specific flow phenomenon according to operation conditions. The molten steel may be received in the mold 10 so that a space having a predetermined width is defined in an upper portion of the mold 10, and a mold flux may be applied to the meniscus. A top surface of the molten steel, i.e., a surface of the molten steel is the meniscus.

The plurality of temperature measurers 100 measure a temperature of the molten steel or the molten steel meniscus received in the mold 10 during the present operation. As illustrated in FIGS. 1 and 2, the plurality of temperature measurers 100 are installed to be spaced apart from each other and arranged in a width direction of the mold 10. Here, the plurality of temperature measurers 100 are installed at heights of ±50 mm from the meniscus. Also, the plurality of temperature measurers 100 may be spaced an equal distance from each other, for example, spaced a distance of 100 mm to 150 mm from each other. The plurality of temperature measurers 100 are installed to be spaced apart from each other and arranged in the width direction at each of the pair of long sides and the pair of short sides. Also, the temperature measurers 100 are installed in the upper portion of the mold 10 and disposed above the meniscus. That is, the temperature measurers 100 are installed at position higher 50 mm or less than the meniscus at each of the pair of long sides and the pair of short sides. Preferably, the temperature measurers 100 are installed at positions higher by 10 mm upward than the meniscus, more preferably, at points higher by 4.5 mm than the meniscus.

Although thermocouples are used as the temperature measurers 100 in an embodiment, the embodiment of the present invention is not limited thereto. For example, various units that are capable of measuring a temperature may be used.

When the molten steel is discharged from both the discharge holes of the nozzle 20, a flow of the molten steel and the meniscus within the mold 10 varies. Here, the flow of the molten steel and the meniscus varies by various reasons such as whether both the discharge holes of the nozzle 20 are blocked, whether external air is inserted and mixed through a sliding gate controlling communication with the nozzle 20 between the tundish and the mold 10, whether an inert gas (for example, Ar) supplied to the nozzle 20 is controlled, and wearing of the nozzle 20.

In general, when both the discharge holes of the nozzle 20 are not blocked, the mixing through the sliding gate does not occur, the wearing of the nozzle 20 does not occur, and the inert gas is controllable, the molten steel or the meniscus is in a normal flow state. That is, when the molten steel is discharged from both the discharge holes of the nozzle 20, the discharge stream of the molten steel collides with walls of the short sides 12*a* and 12*b* of the mold 10 to generate a strong double-roll flow in which the molten steel is vertically branched along the short sides 12*a* and 12*b* to strongly flow (see reference symbols A and B of FIG. 3, and see FIG. 5). Here, the molten steel branched to flow upward flows from the positions of the short sides 12*a* and 12*b* of the mold 10 in the direction of the nozzle 20. Here, since the molten steel discharge stream collides with both the short sides 12*a* and 12*b*, heights of both edges of the meniscus are higher than those of other areas (see FIGS. 3, 5, and 6). Here, differences between the heights of both the edges of the meniscus and heights of the other areas may be height differences at which defects of the slab do not occur, or a defect rate of the slab is less than a reference value. That is, the flow of the molten steel is in a very stable flow state in which the defects do not occurs, or the defect rate is less than the reference value due to securing of a suitable meniscus speed and a temperature.

However, for another example, when the external air is inserted and mixed through the sliding gate controlling the communication of the nozzle 20 between the tundish and the mold 10, an amount of Ar supplied to the nozzle 20 is not controlled, and the wearing of the nozzle 20 occurs, a single-roll flow and a bias flow patterns having a flow C, in which the molten steel discharged from the nozzle 20 flows downward, occurs (see FIG. 4). Slag may be inserted and mixed due to this flow to cause the defects.

For another example, when one discharge hole of both the discharge holes of the nozzle 20 is blocked, the bias flow of the molten steel is serious, and a flow having a vortex shape occurs. Thus, as illustrated in FIG. 7, an asymmetric flow in which a height of the meniscus at one edge thereof is higher than that of the meniscus at the other edge thereof occurs (see FIGS. 7 and 8). This flow form very increases possibility of an occurrence of the defects of the slab.

The meniscus flow detection unit 200 according to the first embodiment analyzes the temperatures measured by the plurality of temperature measurers 100 to detect the meniscus flow as described above, thereby determining whether the detected meniscus flow is normal or abnormal. That is, the meniscus flow detection unit 200 compares and analyzes the temperature measurement values respectively measured by the plurality of temperature measurers 100 to detect a meniscus flow form or state. That is, the temperature measurement values respectively measured by the plurality of temperature measurers 100 are relatively compared to each other to determine whether the present flow state of the meniscus is normal or abnormal, thereby detecting the flow form. Particularly, a plurality of evaluation methods for evaluating the meniscus flow to be normal or abnormal are provided according to the first embodiment of the present invention.

The magnetic field generation unit 500 generates magnetic fields to allow the molten steel to flow by the magnetic fields and is controlled by the flow control unit 400. The magnetic field generation unit 500 includes a plurality of magnetic field generation parts 510*a*, 510*b*, 510*c*, and 510*d*. Referring to FIG. 1, the magnetic field generation parts 510*a*, 510*b*, 510*c*, and 510*d* are provided in plurality and installed outside the mold 10. In an embodiment, the four magnetic field generation parts 510*a*, 510*b*, 510*c*, and 510*d* are provided and installed outside the pair of long sides 11*a* and 11*b* of the mold 10. In detail, two magnetic field generation parts (hereinafter, referred to as a first magnetic generation part 510*a* and a second magnetic field generation part 510*b*) are installed outside the first long side 11*a*. The first magnetic generation part 510*a* and the second magnetic field generation part 510*b* are installed to be arranged along the extension direction of the first long side 11*a*. Also, two magnetic field generation parts (hereinafter, referred to as a third first magnetic generation part 510*c* and a fourth magnetic field generation part 510*d*) are installed outside the second long side 11*b*. The third magnetic generation part 510*c* and the fourth magnetic field generation part 510*d* are installed to be arranged along the extension direction of the second long side 11*b*. That is, the first magnetic generation part 510*a* and the third magnetic generation part 510*c* are installed to face each other in one direction with respect to the nozzle 20 disposed at a center of the width direction of the mold 10 outside the mold 10, and the second magnetic generation part 510*b* and the fourth magnetic generation part 510*d* are installed to face each other in the other direction.

The first to fourth magnetic generation parts 510*a*, 510*b*, 510*c*, and 510*d* have the same component and shape. The first to fourth magnetic generation parts 510*a*, 510*b*, 510*c*, and 510*d* includes core members 511*a*, 511*b*, 511*c*, and 511*d* extending in a direction of the long sides 11*a* and 11*b* of the mold 10 and a plurality of coil members 512*a*, 512*b*, 512*c*, and 512*d*, each of which is wound around outer surfaces of the core members 511*a*, 511*b*, 511*c*, and 511*d*, and spaced apart from each other in the extension direction of the core members 511*a*, 511*b*, 511*c*, and 511*d*, respectively. Here, the coil members 512*a*, 512*b*, 512*c*, and 512*d* are members in which a coil is wound in a spiral shape. The plurality of coil members 512*a*, 512*b*, 512*c*, and 512*d* are installed on one core member 511*a*, 511*b*, 511*c*, or 511*d*.

The magnetic field generation unit 500 according to an embodiment of the present invention is a general EMS. Also, the magnetic field generation unit 500 is not specifically limited in controlling of a moving direction, rotation, accelerating force, and decelerating force of the magnetic fields and is driven through the same driving method as the general EMS.

The flow control unit 400 controls power or current applied to the magnetic field generation unit 500 according to the meniscus flow pattern to adjust magnetic fields within the molten steel to realize a normal flow pattern. That is, the flow control unit 400 controls an operation of each of the magnetic field generation parts 510*a*, 510*b*, 510*c*, and 510*d* according to the meniscus flow detected by the meniscus flow detection unit 200 to adjust a flow direction and flow speed of the molten steel. Here, the current applied to each of the magnetic field generation parts 510*a*, 510*b*, 510*c*, and 510*d* is controlled according to the meniscus flow form and a temperature difference of the meniscus to adjust at least one of the moving direction, strength (intensity), and the moving speed of the magnetic fields.

For example, there is an applying method in which the magnetic fields horizontally moving along the direction of the long sides 11*a* and 11*b* of the mold 10 move from the short sides 12*a* and 12*b* of the mold 10 in a direction in which the nozzle 20 is disposed, i.e., in a direction opposite to a direction in which the molten steel is discharged from the nozzle 20 to give breaking force to the discharge stream of the molten steel in the nozzle 20. This flow adjustment is called an electromagnetic level stabilizer "EMLS", an "EMLS mode", or magnetic field applying by the "EMLS". When the magnetic fields are formed in the magnetic field generation unit 500 in the EMLS mode, the molten steel flow speed of the molten steel meniscus within the mold 10 may be reduced.

There is a method for giving the acceleration force of the molten steel discharged from the nozzle 20 as another magnetic field applying method. There is a method in which the magnetic fields horizontally moving along the direction of the long sides 11*a* and 11*b* of the mold 10 move from the nozzle 20 in a direction of the short sides 12*a* and 12*b* of the mold 20, i.e., in the same direction as the molten steel discharge direction of the nozzle 20 to give the acceleration force to the molten steel discharge stream. Generally, this method is called an electromagnetic level accelerator "EMLA", an "EMLA mode", or a "method for applying magnetic fields by the EMLA mode". When the magnetic field generation unit 500 generates magnetic fields in the above-described EMLA mode, the molten steel discharge stream is accelerated from the nozzle 20. Thus, the discharge stream collides with walls of the short sides 12*a* and 12*b* of the mold 10, and then, the molten steel is vertically branched along the short sides 12*a* and 12*b*. Here, the molten steel branched to flow upward flows from the positions of the short sides 12*a* and 12*b* of the mold 10 in the direction of the nozzle 20 on the molten steel meniscus.

There is a method in which the molten steel within the mold 10 horizontally rotates by using the nozzle 20 as a center as further another magnetic field applying method. In detail, there is a method in which the magnetic fields horizontally moving along the long sides 11*a* and 11*b* of the mold 10 move in opposite directions along the relative long sides to generate a molten steel flow that horizontally rotates along a solidification interface. In general, this is called an "EMRS", an "EMRS mode", a "magnetic field applying method by the EMRS mode".

The method for applying the magnetic fields by the EMLS, EMLA, and EMRS mode, which are described above, will be described in detail according to a second embodiment.

Hereinafter, an evaluation method of the meniscus flow in the meniscus flow detection unit according to the first embodiment of the present invention and a method for controlling a flow in the flow control unit according to the evaluated results will be described.

As illustrated in FIGS. 1 and 2, a plurality of temperature measurers 100 are installed along an extension direction of a pair of long sides (a first long side 11*a* and a second long side 11*b*) and a pair of short sides (a first short side 12*a* and a second short side 12*b*) of a mold 10, respectively. In the first embodiment, seven temperature measurers are installed along the extension direction of the first and second long sides 11*a* and 11*b*, and one temperature measurer is installed on each of the first and second short sides 12*a* and 12*b*. In FIG. 2, reference numerals 1 to 7 written along the extension direction of each of the first and second long sides 11*a* and 11*b* represent numbers of the plurality of temperature measurers 100, respectively. That is, the plurality of temperature measurers 100 that are respectively installed at the first and second long sides 11*a* and 11*b* of the mold 10 are called first to seventh temperature measurers in order, for example, from a left side to a right side. Also, the reference numeral 8 written in the first and second short sides 12*a* and 12*b* represents the number of the temperature measurer installed at the first and second short sides 12*a* and 12*b*. In addition, the plurality of temperature measurers 100 that are respectively installed at the first and second short sides 12*a* and 12*b* of the mold 10 can be called eighth temperature measurers. According to arrangement of the plurality of temperature measurers, in a width direction of each of the first and second long sides 11*a* and 11*b* or a slab, the temperature measurers disposed at both edges or both ends are first and seventh temperature measurers, and the temperature measurer disposed at a center is a fourth temperature measurer.

For example, in the first embodiment, a structure in which the seven temperature measurers are respectively installed at the first and second long sides 11*a* and 11*b*, and one temperature measurer is installed at each of the first and second short sides 12*a* and 12*b* is described. However, the embodiment is not limited thereto. For example, seven or more temperature measurers may be installed at each of the first and second long sides 11*a* and 11*b*, and the plurality of temperature measurers may be installed at each of the first and second short sides 12*a* and 12*b*.

As described above, the plurality of temperature measurers 100 are installed at the first and second long sides 11*a* and 11*b* and first and second short sides 12*a* and 12*b* of the mold 10 to measure a temperature for each position. Here, the measured temperature is different according to a height of the meniscus. That is, the meniscus varies in height according to positions due to slopping of the molten steel within the mold 10. A temperature value measured at a position at which the height of the meniscus is relatively high is greater than that measured at different positions. This is done because the more a distance between the height of the molten steel meniscus and the temperature measurer 100 decreases, the more the temperature measured by the temperature measurer 100 increases, whereas the distance increases, the temperature decreases. In other words, when the temperature is measured in real-time, if a temperature measured by one temperature measurer 100 increases, the meniscus increases in height, and thus, the distance between the meniscus and the one temperature measurer 100 decreases, whereas, if the temperature measured by the one temperature measurer 100 decreases, the meniscus decreases in height, and thus, the distance between the meniscus and the one temperature measurer 100 increases. Thus, a form (or a type) of the entire meniscus may be detected by using a difference in temperature measured by the plurality of temperature measurers 100. That is, the temperature values measured by the plurality of temperature measurers 100 disposed to be arranged in a width direction of the mold 10 or the meniscus are represented for each position. Here, since the temperatures are different according to heights of the meniscus. Thus, when the temperature values are relatively compared to each other, the relative heights of the meniscus may be detected. Thus, when the temperature values measured by the plurality of temperature measurers 100 are relatively compared to each other, the height of the meniscus for each position may be relatively determined to detect the meniscus flow form.

Figure 21:
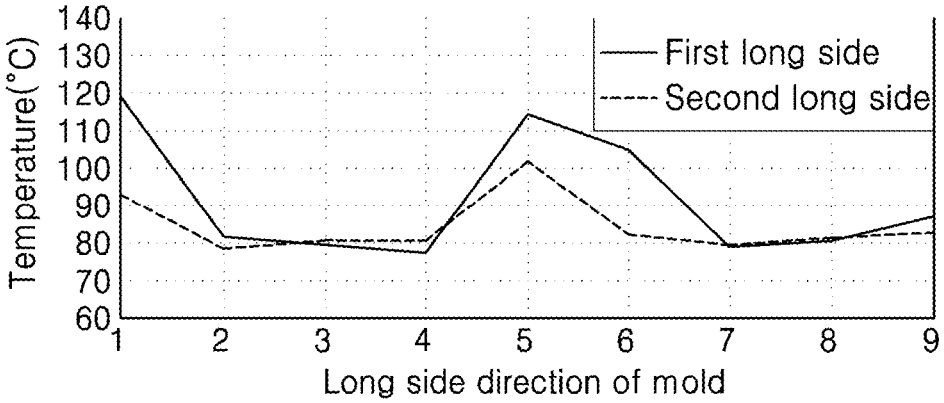
FIG. 21 is a graph visualizing a meniscus flow form detected by relatively representing temperatures for respective positions at the pair of long sides and the pair of short sides, which are measured by the plurality of measurers.
Figure 22:
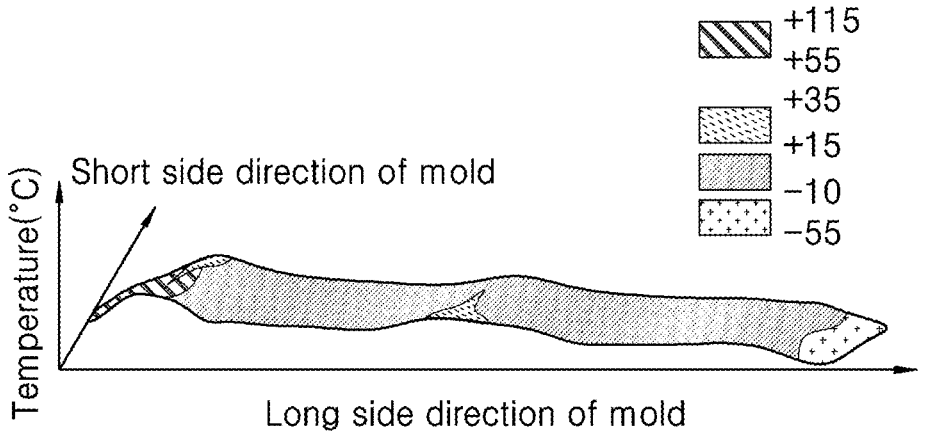
FIG. 22 is a three-dimensionally visualizing image.

Also, when the position-variable temperatures in each of the directions of the first and second long sides 11*a* and 11*b* of the mold 10 are shown by using a graph, for example, the temperatures may be visualized as illustrated in FIGS. 6, 8, 21, 22, 27 and 28. That is, when the temperatures according to the positions in each of the directions of the first and second long sides 11*a* and 11*b* of the mold 10 and the temperatures according to the positions in each of the directions of the first and second short sides 12*a* and 12*b* are used, for example, the temperatures may be visualized as illustrated in FIG. 22. This may be displayed on a display unit so that a worker confirms the visualized temperatures.

When the molten steel is discharged from the nozzle 20, the molten steel flows in both side directions with respect to the nozzle 20 and then collides with sidewalls within the mold 10. Thus, the molten steel is branched vertically. A top surface of the molten steel, i.e., the meniscus flows by the flow of the molten steel due to the discharge of the molten steel, and thus, the flow of the meniscus varies in height. That is, the flow of the meniscus varies according to the flow form of the molten steel, and thus, the height of the meniscus for each position is determined. Also, a defect rate according to the flow of the molten steel or the meniscus may vary, and the flow state of the meniscus may be detected according to the temperature for each position of the meniscus.

The flow of the meniscus or the temperature distribution of the meniscus is to determined to be normal or abnormal according to the defect rate of the slab due to the temperature distribution of the meniscus. In more detail, in an embodiment of the present invention, the temperature distribution of the meniscus, in which the defect rate is less than 0.8%, is determined as a normal flow state, and the temperature distribution of the meniscus, in which the defect rate is greater than 0.8%, is determined as an abnormal flow state. Also, the temperature of the meniscus in which the defect rate is less than 0.8% is called a reference temperature range.

To decide the reference temperature range for determining the normal or abnormal state of the meniscus flow, a slab casting test is performed several times. That is, a defect rate of the casted slab is calculated while the temperature distribution of the meniscus varies.

The meniscus temperature distribution having a defect rate of 0.8 or less may have various temperature distributions. When temperatures measured by the plurality of temperature measurers 100 disposed to be arranged along the long sides 11*a* and 11*b* of the mold 10 are relatively compared to each other, and a difference in temperature measured by the plurality of temperature measurers 100 ranges from 15° C. to 70° C., a defect rate of the slab is less than 0.8%. In other words, when a difference between the maximum temperature and the minimum temperature of the plurality of temperature values measured by the plurality of temperature measurers 100 ranges from 15° C. to 70° C., a defect rate of the slab is less than 0.8%. That is, according to the meniscus temperature distribution having the defect rate of 0.8% or less, in the temperatures measured by the plurality of temperature measurers 100 disposed to be arranged along the direction of the long sides 11*a* and 11*b* of the mold 10, a difference between the maximum temperature and the minimum temperature ranges from 15° C. to 70° C.

Thus, the temperatures measured by the plurality of temperature measurers 100 are relatively compared to each other to determine whether the difference in temperature measured by the plurality of temperature measurers 100 satisfies the reference temperature range, thereby determining the normal or abnormal state in flow state of the meniscus. This is called a first evaluation method. Here, the reference temperature range is called a first reference temperature range. Here, the first reference temperature range used in the first evaluation method ranges from 15° C. to 70° C. That is, according to the first evaluation method, when a relative temperature difference measured by the plurality of temperature measurers 100 ranges from 15° C. to 70° C., the meniscus flow state is determined to be normal, and if out of the range, the meniscus flow state is determined to be abnormal. That is, the meniscus temperature distribution in which a difference between a temperature of the temperature measurer having the maximum temperatures and a temperature of the temperature measurer having the minimum temperature among the temperatures measured by the plurality of temperature measurers 100 ranges from 15° C. to 70° C. is the first reference temperature range.

Also, five evaluation methods are further provided in addition to the above-described first evaluation method as the method for evaluating the normal or abnormal state of the meniscus flow. Here, reference temperature ranges respectively used for the second to sixth evaluation methods are called second to sixth reference temperature ranges.

That is, during the slab casting, the flow state of the meniscus in a furnace is determined by using one evaluation method of the first to sixth evaluation methods, which will be described below.

Figure 10:
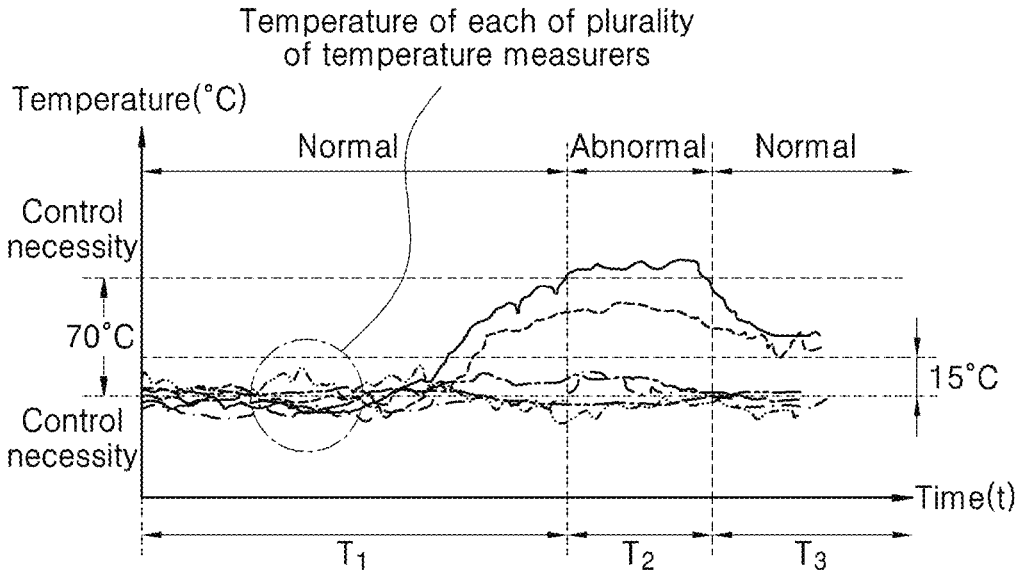
FIG. 10 is a graph illustrating an example of a normal control state when determined to be normal after the flow state of the meniscus is determined to be normal or abnormal through a first evaluation method.
Figure 11:
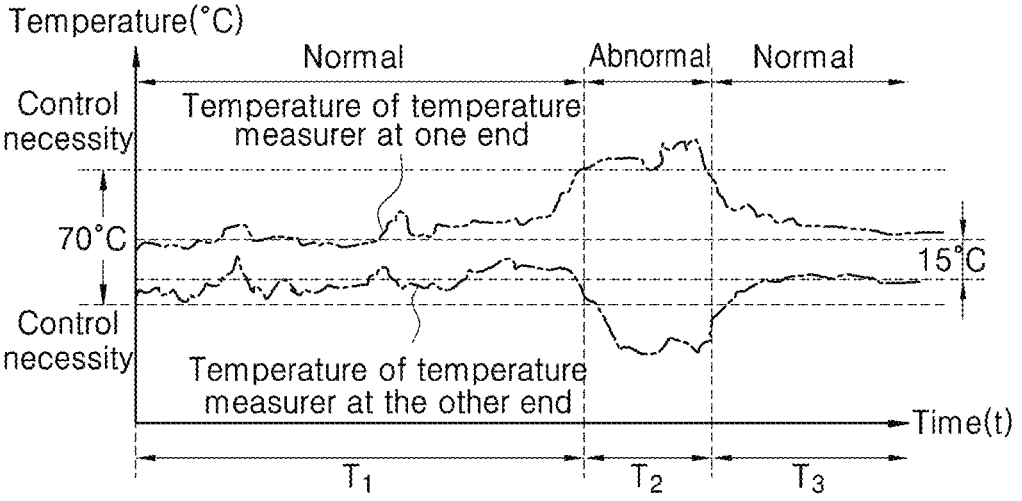
FIG. 11 is a graph illustrating an example of a normal control state when determined to be normal after the flow state of the meniscus is determined to be normal or abnormal through a second evaluation method.
Figure 12:
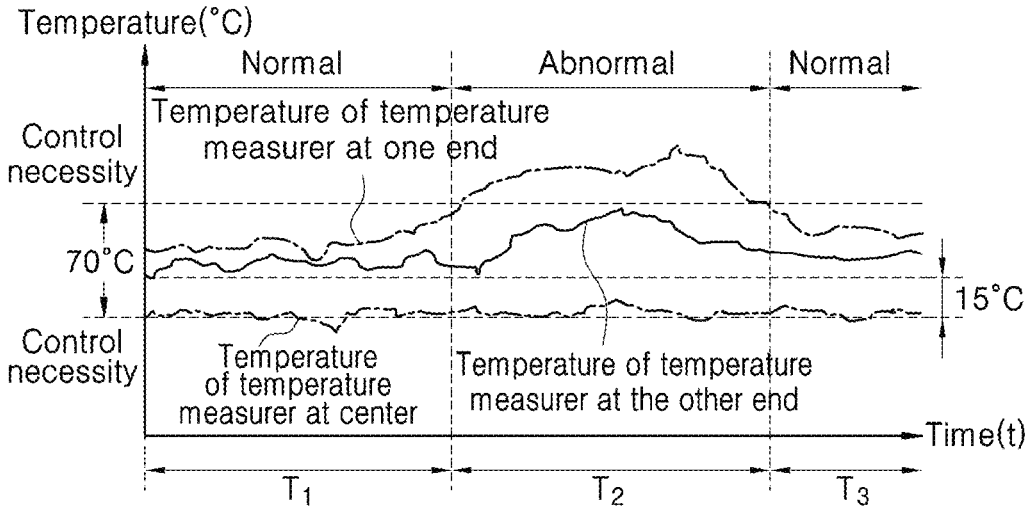
FIG. 12 is a graph illustrating an example of a normal control state when determined to be normal after the flow state of the meniscus is determined to be normal or abnormal through a third evaluation method.
Figure 13:
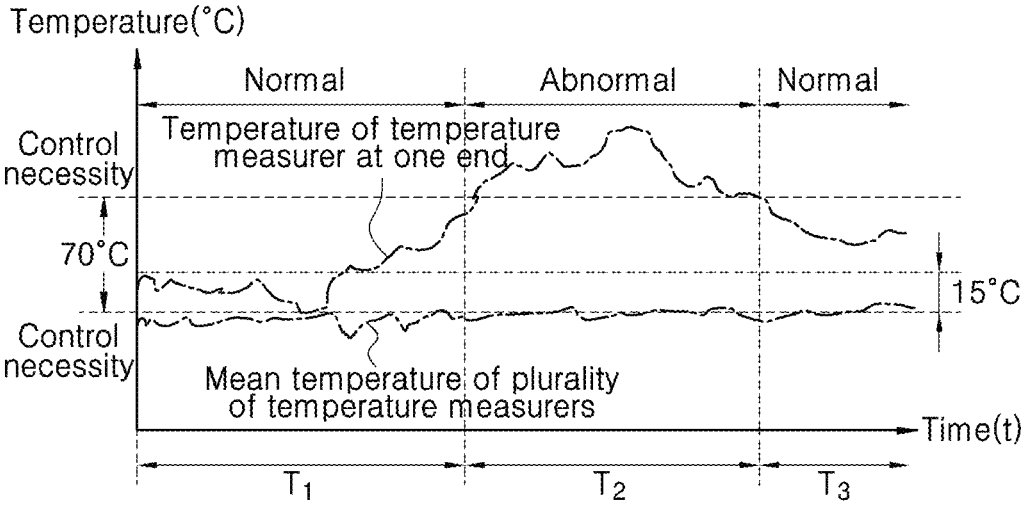
FIG. 13 is a graph illustrating an example of a normal control state when determined to be normal after the flow state of the meniscus is determined to be normal or abnormal through a fourth evaluation method.
Figure 14:
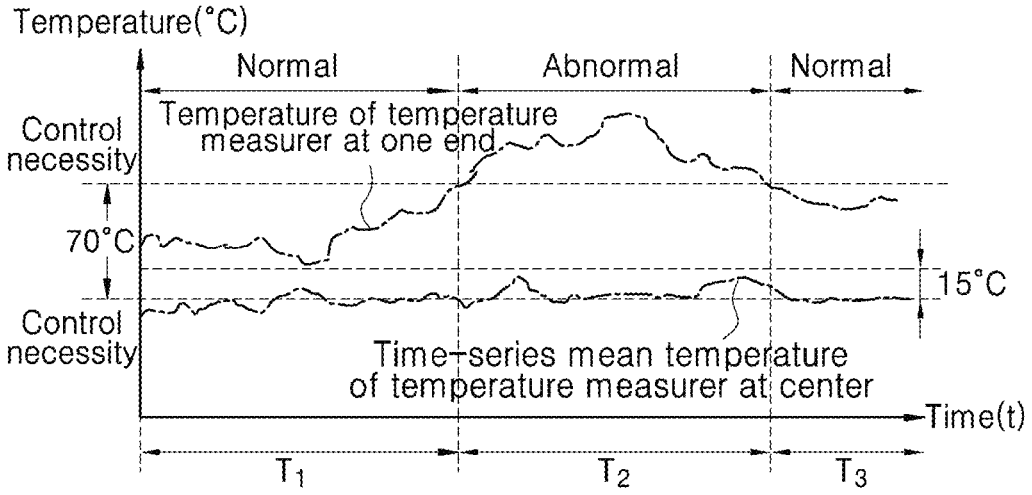
FIG. 14 is a graph illustrating an example of a normal control state when determined to be normal after the flow state of the meniscus is determined to be normal or abnormal through a fifth evaluation method.
Figure 15:
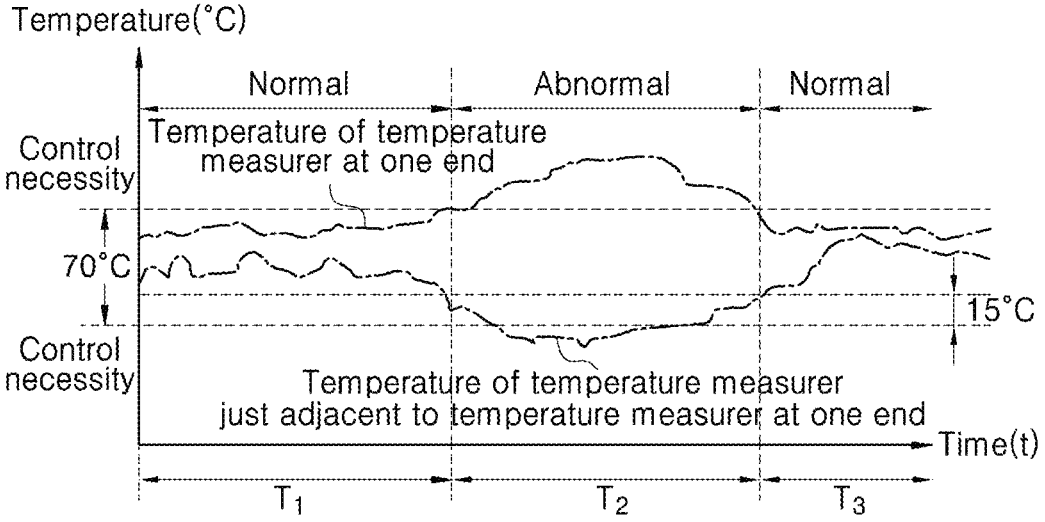
FIG. 15 is a graph illustrating an example of a normal control state when determined to be normal after the flow state of the meniscus is determined to be normal or abnormal through a sixth evaluation method.

FIG. 10 is a graph illustrating an example of a normal control state when determined to be normal after the flow state of the meniscus is determined to be normal or abnormal through a first evaluation method. FIG. 11 is a graph illustrating an example of a normal control state when determined to be normal after the flow state of the meniscus is determined to be normal or abnormal through a second evaluation method. FIG. 12 is a graph illustrating an example of a normal control state when determined to be normal after the flow state of the meniscus is determined to be normal or abnormal through a third evaluation method. FIG. 13 is a graph illustrating an example of a normal control state when determined to be normal after the flow state of the meniscus is determined to be normal or abnormal through a fourth evaluation method. FIG. 14 is a graph illustrating an example of a normal control state when determined to be normal after the flow state of the meniscus is determined to be normal or abnormal through a fifth evaluation method. FIG. 15 is a graph illustrating an example of a normal control state when determined to be normal after the flow state of the meniscus is determined to be normal or abnormal through a sixth evaluation method.

Hereinafter, a method for detecting the meniscus flow state through the first to sixth evaluation methods according to the first embodiment, a process of determining the normal or abnormal state of the meniscus flow using the same, and a flow control method will be described.

For convenience of description, seven temperature measurers 101, 102, 103, 104, 105, 106, and 107 are installed along the direction of the long sides of the mold 10. Here, the temperature measurers in order from the left side to the right side are called the first to seventh temperature measurers 101, 102, 103, 104, 105, 106, and 107, and the temperatures measured by the first to seventh temperature measurers 101, 102, 103, 104, 105, 106, and 107 are called first to seventh temperatures.

According to the first evaluation method, in the plurality of temperature measurers 101, 102, 103, 104, 105, 106, and 107, when a relative temperature difference satisfies the first reference temperature range (ranging from 15° C. to 70° C.), the present meniscus flow state is determined to be normal. That is, when a relative temperature difference measured by the first to seventh temperature measurers 101, 102, 103, 104, 105, 106, and 107 ranges from 15° C. to 70° C., it is determined that the meniscus flow is normal. That is, a difference in temperature measured by the plurality of temperature measurers 101, 102, 103, 104, 105, 106, and 107 is calculated, and whether each of the calculated temperature differences is included in the reference temperature range is compared, and then, a difference in temperature measured by the rest of the temperature measurers with respect to the temperature measurers 101, 102, 103, 104, 105, 106, and 107 is calculated to compare the temperature differences to the reference temperature range.

In more detail, a difference in temperature measured by the first temperature measurer 101 and each of the second to seventh temperature measurers 102 to 107, a difference in temperature measured by the second temperature measurer 102, the first temperature measurer 101, and the third to seventh temperature measurers 103 to 107, a difference in temperature measured by the third temperature measurer 103, the first temperature measurer 101, the second temperature measurer 102, and the fourth to seventh temperature measurers 104 to 107, a difference in temperature measured by the fourth temperature measurer 104, the first temperature measurer 101, the first to third temperature measurers 101 to 103, and the fifth to seventh temperature measurers 105 to 107, a difference in temperature measured by the fifth temperature measurer 105, the first to fourth temperature measurers 101 to 104, the sixth temperature measurer 106, and the seventh temperature measurer 107, and a difference in temperature measured by the sixth temperature measurer 106, the first to fifth temperature measurers 101 to 105, and the seventh temperature measurer 107 are calculated to compare the temperature differences to the reference temperature.

Here, when the relative temperature difference measured by the plurality of temperature measurers 101, 102, 103, 104, 105, 106, and 107 satisfy the first reference temperature range, it is determined that the meniscus flow state is normal, and when out of the first reference temperature range, it is determined that the meniscus flow state is abnormal. That is, as illustrated in FIG. 10, when the temperatures measured by the plurality of temperature measurers 100 are relatively compared to each other, if the temperature difference ranges from 15° C. to 70° C., it is determined that the meniscus flow state is in a normal flow state, and if the temperature difference is greater than 70° C. and less than 15° C., it is determined that the meniscus flow state is in an abnormal flow state. Also, when it is determined that the meniscus flow state is abnormal, an operation of the magnetic field generation unit 500 is controlled according to the meniscus flow form so that the relative temperature difference measured by the plurality of temperature measurers 101, 102, 103, 104, 105, 106, and 107 ranges from 15° C. to 70° C., thereby normalizing the meniscus flow. Here, the temperatures measured by the plurality of temperature measurers 101, 102, 103, 104, 105, 106, and 107 are relatively compared to each other to detect a meniscus position at which the temperature difference is less than 15° C. and greater than 70° C. Thus, the operation of the magnetic field generation parts 510*a*, 510*b*, 510*c*, and 510*d* is controlled at the corresponding position to normalize the meniscus flow. An increase, decrease, and intensity of current applied to the magnetic field generation parts 510*a*, 510*b*, 510*c*, and 510*d* are adjusted according to the relative temperature difference.

For example, during the continuous casting of the slab, as illustrated in FIG. 10, the relative temperature difference between the first to seventh temperatures measured by the plurality of first to seventh temperature measurers 101, 102, 103, 104, 105, 106, and 107 up to a first section $T_1$ during the slab casting ranges from 15° C. to 70° C., but the relative temperature difference between the first to sixth temperatures is greater than 70° C. and less than 15° C. Here, the meniscus flow detection unit 200 detects a meniscus flow state in a second section $T_2$ to determine the present meniscus flow to be abnormal. Also, the operation of the magnetic field generation unit 500 is controlled according to the determined abnormal meniscus flow and the meniscus flow form in the meniscus flow detection unit 200. Thus, the relative temperature difference between the first to seventh temperatures ranges from 15° C. to 70° C. Thus, the meniscus flow state in a third section $T_3$ is normal.

For example, the temperatures measured by the plurality of temperature measurers 101, 102, 103, 104, 105, 106, and 107 in the second section $T_2$ are relatively compared to each other in real-time and then converted to meniscus heights to form an image as illustrated in FIG. 7. That is, when the temperatures between the plurality of temperature measurers 101, 102, 103, 104, 105, 106, and 107 are relatively compared to each other, a temperature measured by a seventh temperature measurer 100 disposed at a right end is higher than that of the first temperature measurer 100 disposed at a left end. Here, the temperature difference exceeds 70° C. When the temperature difference is converted to a meniscus height to form an image, as illustrated in FIG. 7, the image is not symmetric to each other with respect to the center of the meniscus. For example, the meniscus at the left end has a height greater than that of the meniscus at the right end to form an asymmetric shape.

The asymmetric flow in the second section $T_2$ is maintained as the normal flow pattern up to the first section $T_1$ and then causes a strong bias flow at the right side with respect to the center of the nozzle 20 and a weak flow at the left side. In case of the abnormal flow, the meniscus flow control unit 400 may increase the current applied to the second and fourth magnetic field generation parts 510*b* and 510*d* disposed at the right side of the nozzle 20 to further increase the deceleration force when compared before being adjusted, thereby reducing the strong flow, and also, decrease the current applied to the first and third magnetic field generation parts 510*a* and 510*c* disposed at corresponding positions of the left side of the nozzle 20 to reduce the deceleration force when compared before being adjusted, thereby increasing the flow. Thus, the meniscus flow state in the third section $T_3$ is normal.

On the other hand, in case in which the strong bias flow occurs at the left side of the nozzle 20, and the weak flow occurs at the right side, the meniscus flow control unit 400 further increase the current applied to the first and third magnetic field generation parts 510*a* and 510*c* disposed at the left side of the nozzle 20 to further increase the deceleration force when compared before being adjusted, thereby reducing the strong flow, and also, decrease the current applied to the second and fourth magnetic field generation parts 510*b* and 510*d* disposed at corresponding positions of the left side of the nozzle 20, at which the relatively weak flow occurs, to reduce the deceleration force when compared before being adjusted, thereby increasing the flow. Thus, the meniscus flow state in the third section $T_3$ is normal.

According to the second evaluation method, temperature differences between the temperature measurers disposed at both ends in the plurality of temperature measurers 101, 102, 103, 104, 105, 106, and 107 are compared to each other to determine the flow state. Here, when the temperature difference between the temperature measurers disposed at both the ends ranges from 15° C. to 70° C., this is determined to be normal. That is, when a difference in temperature between the temperature measurer 101 disposed at the left end and the temperature measurer 107 disposed at the right end during the slab casting ranges from 15° C. to 70° C., it is determined that the meniscus flow state is in a normal flow state. On the other hand, when a difference in temperature is greater than 70° C. and less than 15° C., it is determined that the meniscus flow state is in an abnormal state.

For example, as illustrated in FIG. 11, during the slab casting, a temperature difference between the first temperature measurer 101 disposed at the left end and the seventh temperature measurer 107 disposed at the right end up to the first section $T_1$ may be equal to or greater than 15° C., but a temperature difference between the first temperature measurer 101 and the seventh temperature measurer 107 after the first section $T_1$ may be greater than 70° C. and less than 15° C. When a temperature difference between the first temperature measurer 101 and the seventh temperature measurer 107 after the first section $T_1$ in the second section $T_2$ is greater than 70° C. and less than 15° C., an asymmetric flow state in which a difference in height at both edges of the meniscus excessively occurs. Here, the meniscus flow detection unit 200 determines the meniscus flow to be abnormal in the second section $T_2$, and the flow control unit 400 controls the operation of the magnetic field generation unit 500 in the second section $T_2$ so that a temperature difference between the first temperature measurer 101 and the seventh temperature measurer 107 ranges from 15° C. to 70° C. Thus, the meniscus flow state in the third section $T_3$ is normal. That is, a position at which the relatively strong bias flow occurs and a position at which the weak flow occurs are determined through the comparison between the temperature measured by the first temperature measurer 101 and the temperature measured by the seventh temperature measurer 107. Accordingly, the plurality of magnetic field generation parts 510*a*, 510*b*, 510*c*, and 510*d* are individually controlled to decrease or increase the flow. Thus, the normal flow state is realized in the third section $T_2$ in which a difference between the first temperature and the ninth temperature ranges from 15° C. to 70° C.

According to the third evaluation method, the meniscus flow state is determined by using a temperature difference between the temperature measurer 104 disposed at a center in the width direction of the slab or centers of the long sides of the mold and the temperature measurers 101 and 107 disposed on both the ends among the plurality of temperature measurers 101, 102, 103, 104, 105, 106, and 107. For example, if seven temperature measurers 101, 102, 103, 104, 105, 106, and 107 are installed, when the temperature measurer disposed at the center in the width direction of the slab or the centers of the long sides 11*a* and 11*b* of the slab is the fourth temperature measurer 104, if a difference between the temperature of the first temperature measurer 101 and the temperature of the fourth temperature measurer 104 ranges from 15° C. to 70° C., and a difference between the temperature of the seventh temperature measurer 107 and the temperature of the fourth temperature measurer 104 ranges from 15° C. to 70° C., it is determined to be normal. On the other hand, if any one of the temperature difference between the fourth temperature measurer 104 and the first temperature measurer 101 and the temperature difference between the fourth temperature measurer 104 and the seventh temperature measurer 107 does not satisfy the third reference temperature range, it is determined to be abnormal.

Referring to FIG. 12, a temperature difference between the first temperature measurer 101 that is a temperature measurer disposed at a left end and the center temperature measurer (the fourth temperature measurer 104) in the first section $T_1$ during the slab casting and a temperature difference between the seventh temperature measurer 107 that is a temperature measurer disposed at the right end and the center temperature measurer (the fourth temperature measurer 104) ranges from 15° C. to 70° C. However, a temperature difference between the first temperature measurer 101 and the fourth temperature measurer 104 in the second section $T_2$ may range from 15° C. to 70° C., but a temperature difference between the seventh temperature measurer 107 and the fourth temperature measurer 104 may exceed 70° C. In this case, a height of the meniscus at the right edge is higher by a reference height than that of the meniscus at the left edge to become an asymmetric flow state. Here, the meniscus flow control unit 400 determines the meniscus flow to be abnormal in the second section $T_2$, and the flow control unit 400 controls the operation of the magnetic field generation unit 500 in the second section $T_2$ to increase the current applied to the second and fourth magnetic field generation parts 510*b* and 510*d* disposed at the right side of the nozzle 20, at which the relatively strong bias flow occurs, and thereby to further increase the deceleration force when compared before being adjusted, thereby reducing the strong flow, and also, decrease the current applied to the first and third magnetic field generation parts 510*a* and 510*c* disposed at corresponding positions of the left side of the nozzle 20, at which the relatively weak flow occurs, and thereby to reduce the deceleration force when compared before being adjusted, thereby increasing the flow. Thus, a temperature difference between the seventh temperature measurer 107 and the fourth temperature measurer 104 ranges from 15° C. to 70° C., and the heights of the meniscus are symmetrical to each other, and thus, the meniscus flow is normal.

For example, a temperature difference between the first temperature measurer 101 and the fourth temperature measurer 104 in the second section $T_2$ may range from 15° C. to 70° C., but a temperature difference between the seventh temperature measurer 107 and the fourth temperature measurer 104 may be less than 15° C. In this case, a height of the meniscus at the right edge is lower by a reference height than that of the meniscus at the left edge to become an asymmetric flow state, thereby causing the abnormal flow state. Thus, the flow control unit 400 may decrease the current applied to the second and fourth magnetic field generation parts 510*b* and 510*d* disposed at the corresponding right side of the nozzle 20, at which the relatively weak flow occurs, to decrease the deceleration force when compared before being adjusted, thereby increasing the flow or decrease the current applied to the first and third magnetic field generation parts 510*a* and 510*c* disposed at the left side of the nozzle 20, at which the relatively strong bias flow occurs, to further decrease the deceleration force when compared before being adjusted, thereby decreasing the flow.

As described above, the case in which the temperature difference between the first temperature measurer 101 and the fourth temperature measurer 104 ranges from 15° C. to 70° C., but the temperature difference between the seventh temperature measurer 107 and the fourth temperature measurer 104 exceeds 70° C. or less than 15° C. is described as an example. However, on the other hand, the temperature difference between the first temperature measurer 101 and the fourth temperature measurer 104 ranges from 15° C. to 70° C., but the temperature difference between the first temperature measurer 101 and the fourth temperature measurer 104 may exceed 70° C. or be less than 15° C. Alternatively, all the temperature difference between the first temperature measurer 101 and the fourth temperature measurer 104 and the temperature difference between the seventh temperature measurer 107 and the fourth temperature measurer 104 may exceed 70° C. or less than 15° C. In this case, all flow states are determined to be abnormal, and the flow control unit 400 controls the operation of the each of the first to fourth magnetic field generation parts 510*a*, 510*b*, 510*c*, and 501*d* through the same method as the above-described methods to normalize the meniscus flow.

According to the fourth evaluation method, the meniscus flow state is determined by using a mean temperature of the plurality of temperature measurers 101, 102, 103, 104, 105, 106, and 107 and a temperature difference of the temperature measurers disposed at both the ends. That is, when all the temperature difference between the temperature measurers disposed at both the ends and the mean temperature range from 15° C. to 70° C. that is the fourth reference temperature range, it is determined to be normal.

For example, if seven temperature measurers 101, 102, 103, 104, 105, 106, and 107 are installed, when all of the mean temperature of the seven temperature measurers 101, 102, 103, 104, 105, 106, and 107 and a difference between the temperature of the first temperature measurer 101 disposed on one end and the mean temperature and a difference between the temperature measurer 107 disposed at the other end and the mean temperature range from 15° C. to 70° C., it is determined to be normal. On the other hand, when any one of the mean temperature of the seven temperature measurers 101, 102, 103, 104, 105, 106, and 107, the difference between the temperature of the first temperature measurer 101 and the mean temperature, and the difference between the temperature measurer 107 and the mean temperature does not satisfy the fourth reference temperature range, it is determined to be abnormal.

For example, during the slab casting, all the difference between the mean temperature of the seven temperature measurers 101, 102, 103, 104, 105, 106, and 107 and the temperature of the first temperature measurer 101 and the difference between the mean temperature and the seventh temperature measurer 107 range from 15° C. to 70° C. in the first section $T_1$ and exceed 70° C. in the second section $T_2$ to become the abnormal flow state in which the meniscus at the left side of the nozzle 20 has a height greater than that of the meniscus at the right side (see FIG. 13). Thus, the meniscus flow detection unit 200 determines the meniscus flow to be abnormal to control the operation of the magnetic field generation unit 500 so that the current applied to the first and third magnetic field generation parts 510*a* and 510*c*, which are disposed at the left side of the nozzle 20 in which the height of the meniscus is relatively high, is reduced to reduce the flow.

Although only the entire mean temperature and the temperature of one temperature measurer of the temperature measurers disposed at both the ends are represented, temperatures of other temperature measurers may be represented through the same method to detect a difference between the mean temperature and the measured temperature in real-time.

Although all the difference between the mean temperature and the temperature of the first temperature measurer 101 and the difference between the mean temperature and the temperature of the seventh temperature measurer 107 exceed 70° C. in the second section, the embodiment is not limited thereto. For example, all the temperature differences may be less than 15° C. to become the abnormal state. Also, although the difference between the mean temperature and the temperature of the first temperature measurer 101 ranges from 15° C. to 70° C., the difference between the mean temperature and the temperature of the seventh temperature measurer 107 is less than 15° C. or greater than 70° C. Here, it is determined to be abnormal. On the other hand, although the difference between the mean temperature and the temperature of the seventh temperature measurer 107 ranges from 15° C. to 70° C., the difference between the mean temperature and the temperature of the first temperature measurer 101 is less than 15° C. or greater than 70° C. Here, it is determined to be abnormal.

According to the fifth evaluation method, the meniscus flow state is determined by using a difference between a time-series mean temperature of the temperature measurer 104 disposed at the center in the width direction of the slab or the center of each of the long sides of the mold 10 and the temperature of each of the temperature measurers 101 and 107 disposed on both the ends among the plurality of temperature measurers 101, 102, 103, 104, 105, 106, and 107. That is, when all differences between the temperature of each of the temperature measurers disposed at both the ends 101 and 107 and the time-series mean temperature of the temperature measurer disposed at the center range from 15° C. to 70° C., it is determined to be normal. On the other hand, if any one of a difference between the time-series mean temperature of the fourth temperature measurer 104 and the temperature of the temperature measurer disposed at one end and a difference between the time-series mean temperature of the fourth temperature measurer 104 and the temperature of the temperature measurer disposed at the other end does not satisfy the fifth reference temperature range, it is determined to be abnormal.

For example, it is determined that all a difference between the time-series mean temperature of the fourth temperature measurer 104 disposed at the center of each of the long sides 11*a* and 11*b* of the slab or the mold and the temperature of the first temperature measurer 101 disposed at one edge and a difference between the time-series mean temperature of the fourth temperature measurer 104 and the seventh temperature measurer 107 disposed at one edge range from 15° C. to 70° C. to determine the meniscus flow to be normal or abnormal.

In more detail, in the difference between the time-series mean temperature of the fourth temperature measurer 104 and the temperature of the first temperature measurer 101 and the difference between the time-series mean temperature of the fourth temperature measurer 104 and the seventh temperature measurer 107, the temperature ranges from 15° C. to 70° C. up to the first section $T_1$ (see FIG. 14). However, when the difference between the time-series mean temperature of the fourth temperature measurer 104 and the temperature of the first temperature measurer 101 and the difference between the time-series mean temperature of the fourth temperature measurer 104 and the seventh temperature measurer 107 exceed 70° C., the meniscus flow detection unit 200 determines the meniscus flow to be abnormal. Also, the flow control unit 400 controls an operation of at least one of the first to fourth magnetic field generation parts 510*a*, 510*b*, 510*c*, and 510*d* so that the difference between the time-series mean temperature and the temperature of the first temperature measurer 101 ranges from 15° C. to 70° C.

Although all the difference between the time-series mean temperature of the fourth temperature measurer 104 disposed at the center and the temperature of the first temperature measurer 101 and the difference between the time-series mean temperature of the fourth temperature measurer 104 and the temperature of the seventh temperature measurer 107 exceed 70° C. in the second section, the embodiment is not limited thereto. For example, all the temperature differences may be less than 15° C. to become the abnormal state.

Also, although the difference between the time-series mean temperature of the fourth temperature measurer 104 and the temperature of the first temperature measurer 101 ranges from 15° C. to 70° C., the difference between the time-series mean temperature of the fourth temperature measurer 104 and the temperature of the seventh temperature measurer 107 is less than 15° C. or greater than 70° C. Here, it is determined to be abnormal. Also, although the difference between the time-series mean temperature of the fourth temperature measurer 104 and the temperature of the seventh temperature measurer 107 ranges from 15° C. to 70° C., the difference between the time-series mean temperature of the fourth temperature measurer 104 and the temperature of the first temperature measurer 101 is less than 15° C. or greater than 70° C. Here, it is determined to be abnormal.

According to the sixth evaluation method, the meniscus flow state is determined by using a temperature difference between the temperature measurers 101 and 107 disposed at both the ends and the temperature measurers 102 and 106 disposed adjacent to the temperature measurers 101 and 107 among the plurality of temperature measurers 101, 102, 103, 104, 105, 106, and 107. That is, when a temperature difference between the first temperature measurer 101 disposed at one end and the second temperature measurer 102 disposed mostly adjacent to the first temperature measurer 101 ranges from 15° C. to 70° C., and a temperature difference between the seventh temperature measurer 107 disposed at the other end and the sixth temperature measurer 106 disposed mostly adjacent to the seventh temperature measurer 107 ranges from 15° C. to 70° C., the meniscus flow is determined as a normal flow pattern.

Referring to FIG. 15, a temperature difference between the temperature measurers disposed at both the ends, for example, the first temperature measurer and the second temperature measurer disposed adjacent to the first temperature measurer up to the first section during the slab casting ranges from 15° C. to 70° C. However, a temperature difference between the first temperature measurer and the second temperature measurer in the second section exceeds 70° C., and thus, the meniscus flow detection unit 200 determines this meniscus flow as an abnormal flow state. Also, the flow control unit 400 controls an operation of at least one of the first to fourth magnetic field generation parts 510*a*, 510*b*, 510*c*, and 510*d* so that the temperature difference between the first temperature measurer and the second temperature measurer ranges from 15° C. to 70° C.

According to the first embodiment of the present invention, the plurality of temperature measurers 100 may be installed on the mold 10 to detect a temperature for each position in the width direction of the meniscus and relatively compare the temperatures, thereby determining the flow state of the meniscus in real-time. Also, the evaluation method or reference for determining the meniscus flow state may be provided in plurality, and the flow state of the meniscus may be determined by using one of the plurality of evaluation methods or references in real-time. Also, the operation of the magnetic field generation unit may be controlled according to the meniscus flow state that is determined in real-time to control the meniscus to the flow state in which the occurrence of the defects is less or absent. Thus, although the mold flux is applied on the molten steel meniscus during the slab casting, the flow of the meniscus may be detected in real-time and then controlled through the meniscus control device according to the embodiment of the present invention and the meniscus flow control method using the same. Thus, the occurrence of the defects due to the meniscus flow may be reduced to improve the quality of the slab.

In the foregoing first embodiment, the structure in which whether the meniscus flow state is normal or abnormal is determined by using the difference in temperature value measured by the plurality of temperature measurers, and the temperatures of the plurality of temperature measurers are relatively compared to each other to detect the meniscus flow form is described.

The meniscus flow may vary due to various reasons such as the blocking of the nozzle, whether the external air is inserted and mixed through the sliding gate, the amount of the inert gas supplied to the nozzle, and the wearing of the nozzle, and the flow pattern may be divided into a plurality of patterns. Also, controlling of the meniscus flow according to the kind of meniscus flow patterns may be effective.

Thus, a second embodiment of the present invention provides a meniscus flow control device that controls a method for controlling a flow of meniscus according to a flow pattern of the molten steel meniscus within a mold to reduce an occurrence of defects of a slab due to the meniscus flow and a meniscus flow control method using the same.

Hereinafter, a meniscus flow control device and a meniscus flow control method according to the second embodiment of the present invention will be described with reference to FIGS. 16 to 37. Here, the duplicated contents will be omitted or simply described.

Figure 16:
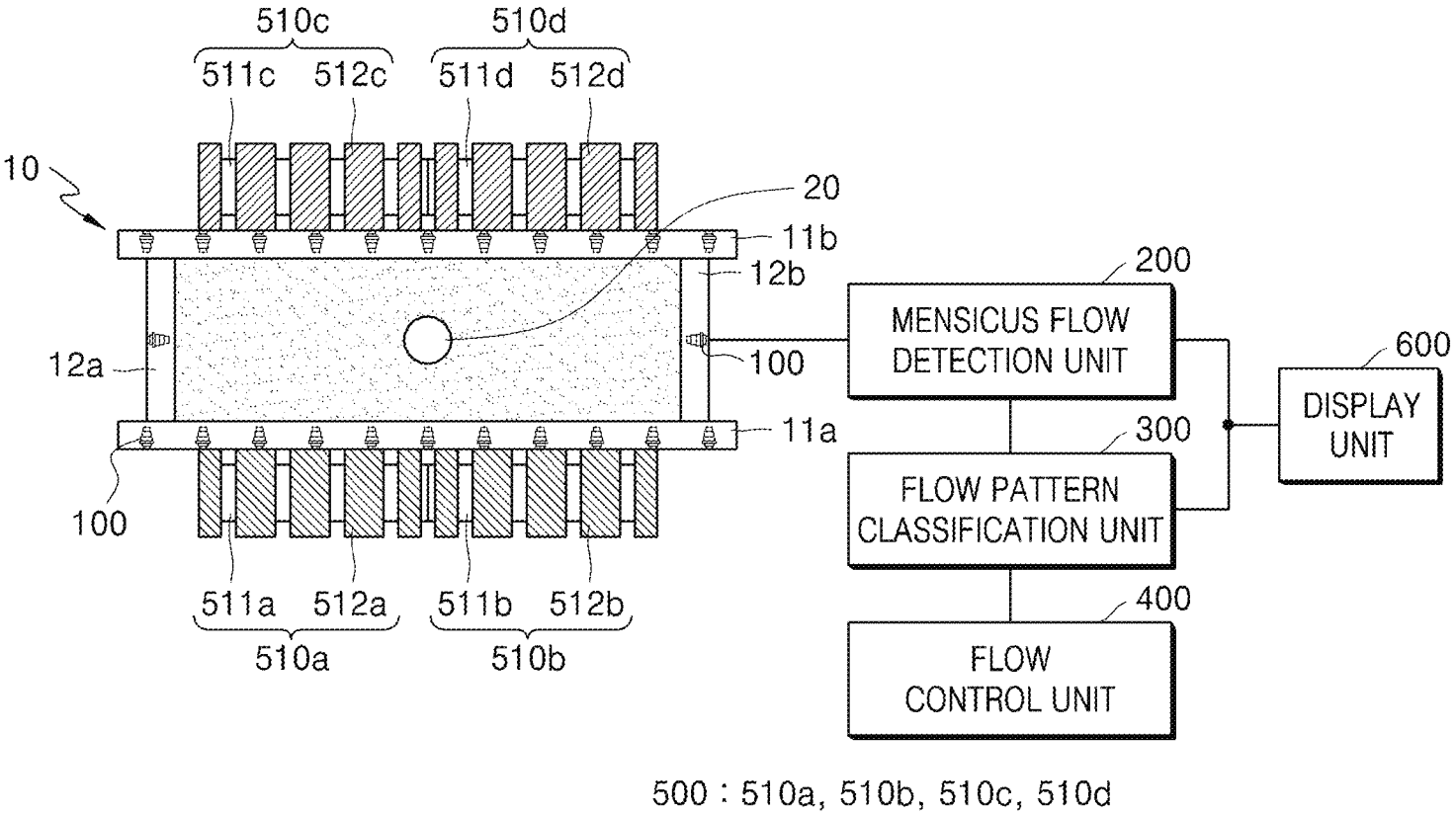
FIG. 16 is a conceptual view of a meniscus flow control device according to a second embodiment of the present invention.
Figure 17:
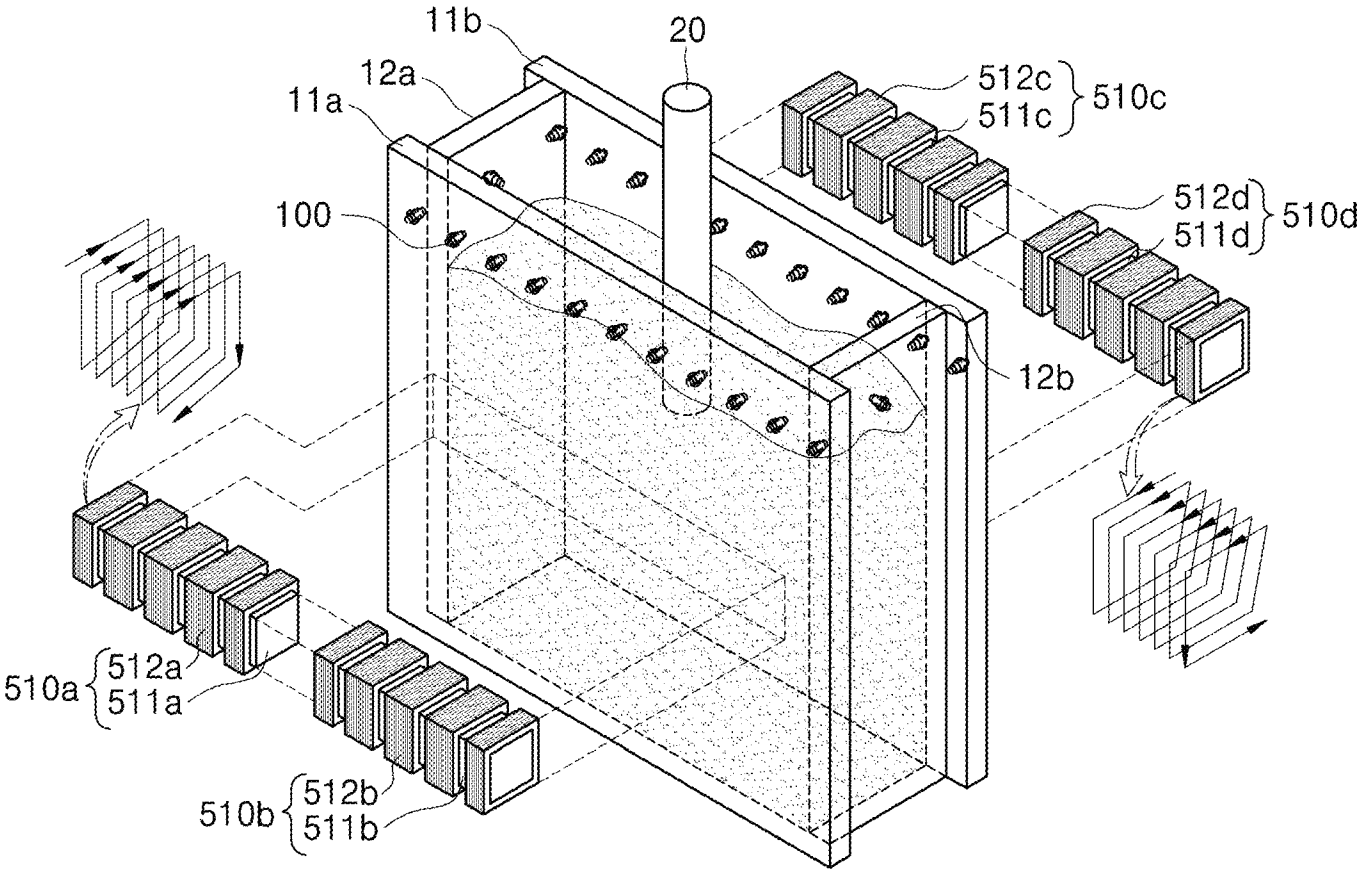
FIGS. 17 and 18 are views of a mold in which the plurality of measurers and a magnetic field generation unit.
Figure 18:
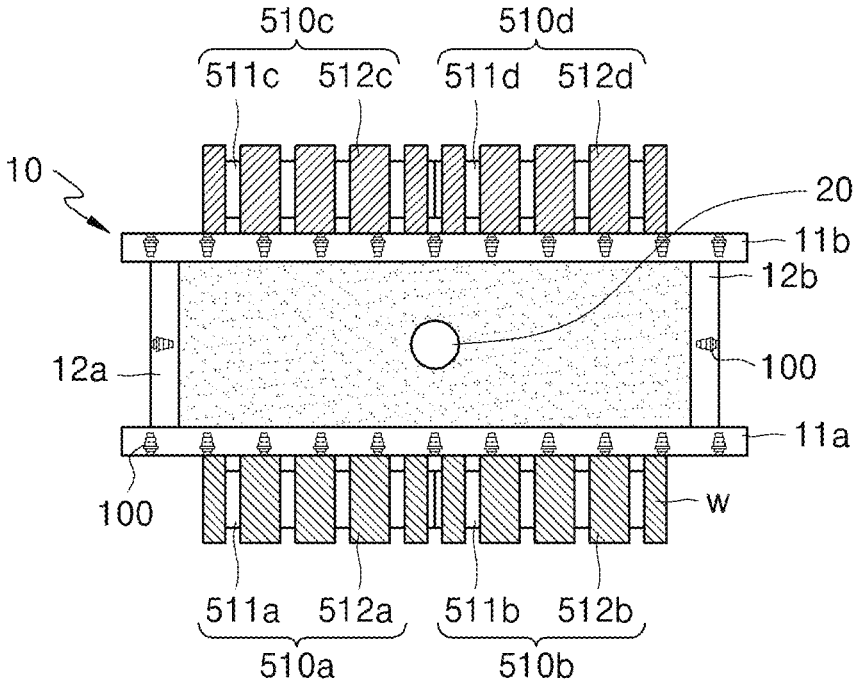
Figure 19:
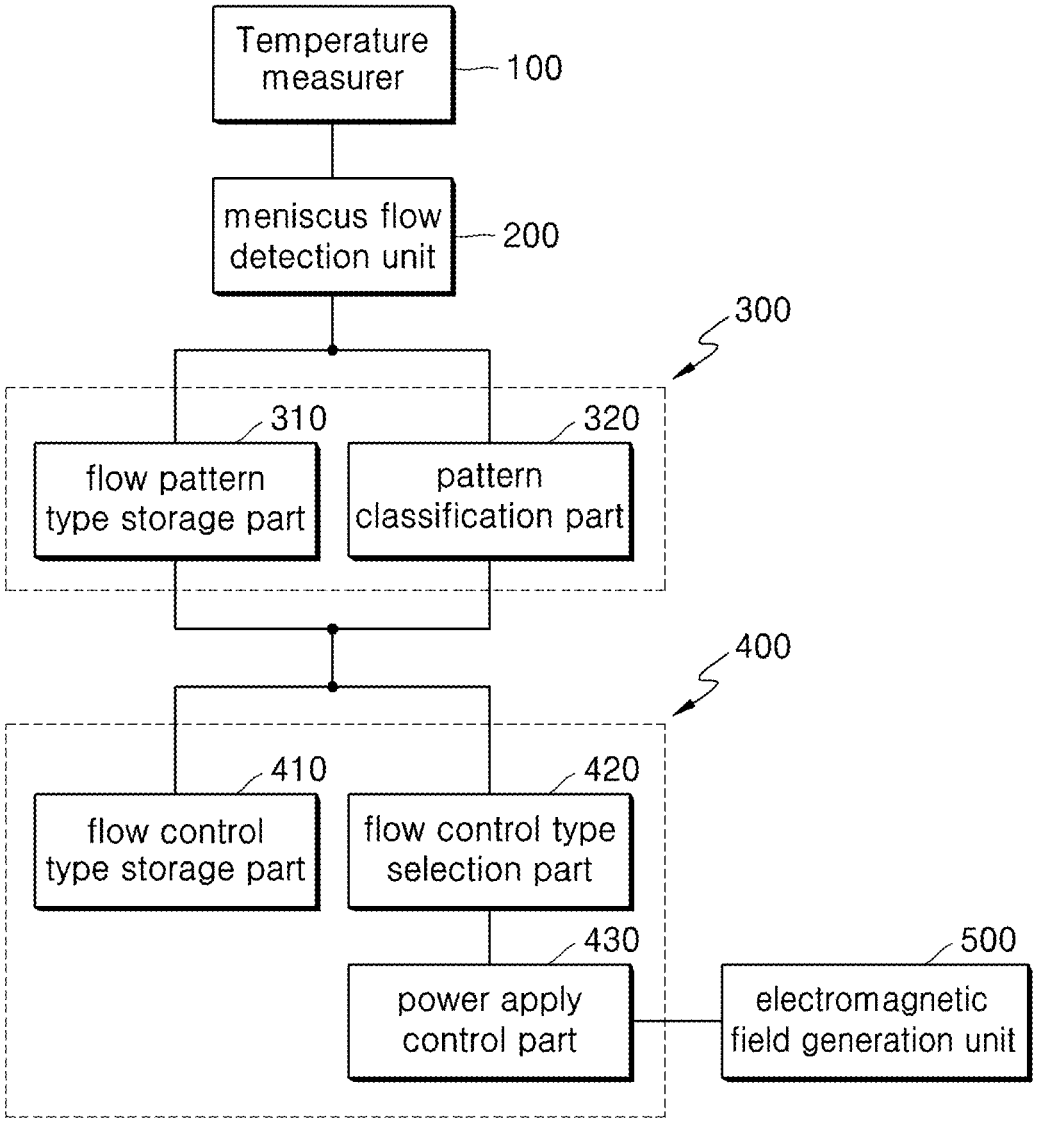
FIG. 19 is a view illustrating a state in which components of the meniscus flow control device according to an embodiment of the present invention.
Figure 20:
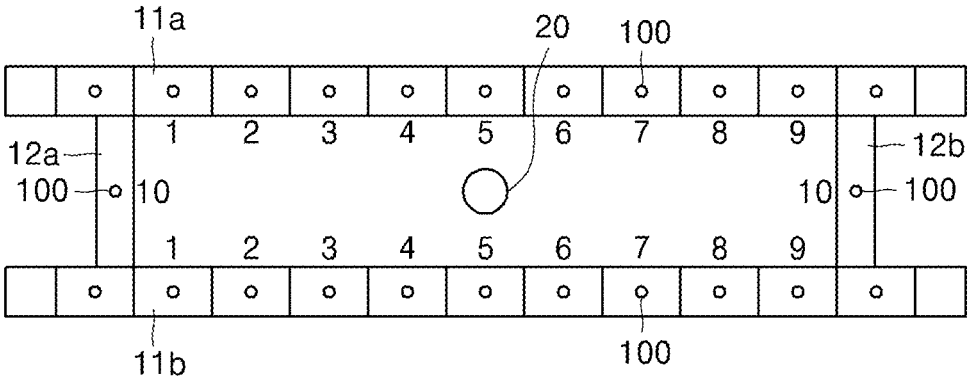
FIG. 20 is a top view illustrating a state in which a plurality of temperature measurers are respectively installed on a pair of long sides and a pair of short sides of a mold.
Figure 23:
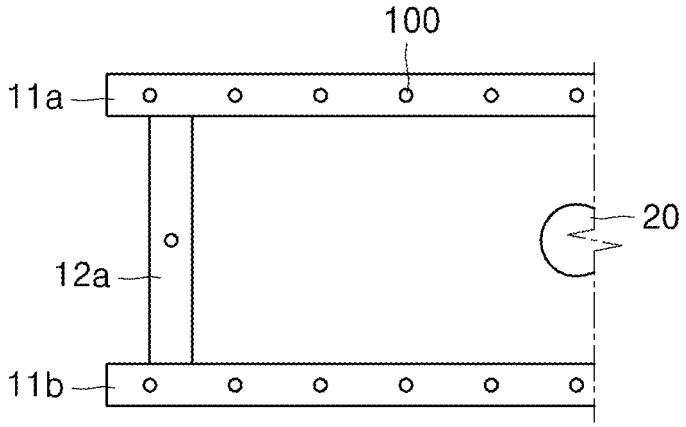
FIG. 23 is a top view illustrating a state in which the temperature measurers are respectively installed on the long and short sides of the mold.
Figure 25:
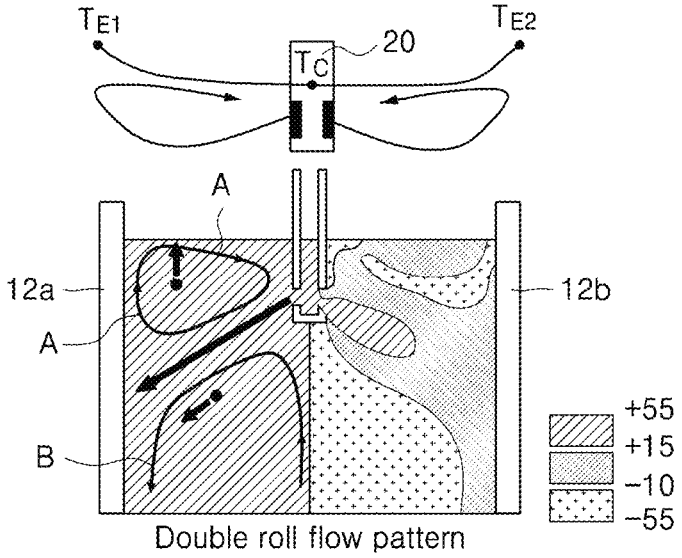
FIG. 25 is a view illustrating a double-roll flow pattern generated in an eighth flow pattern type illustrated in FIG. 24.
Figure 26:
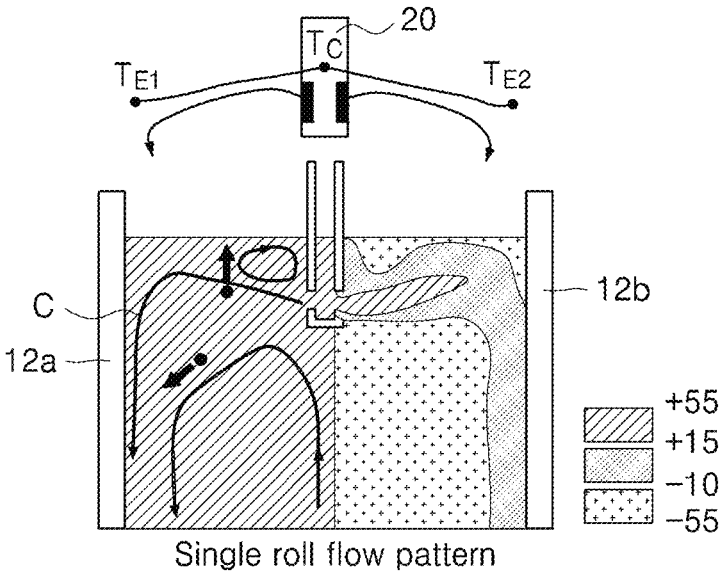
FIG. 26 is a view illustrating a single-roll flow pattern in a seventh flow pattern type illustrated in FIG. 24.
Figure 27:
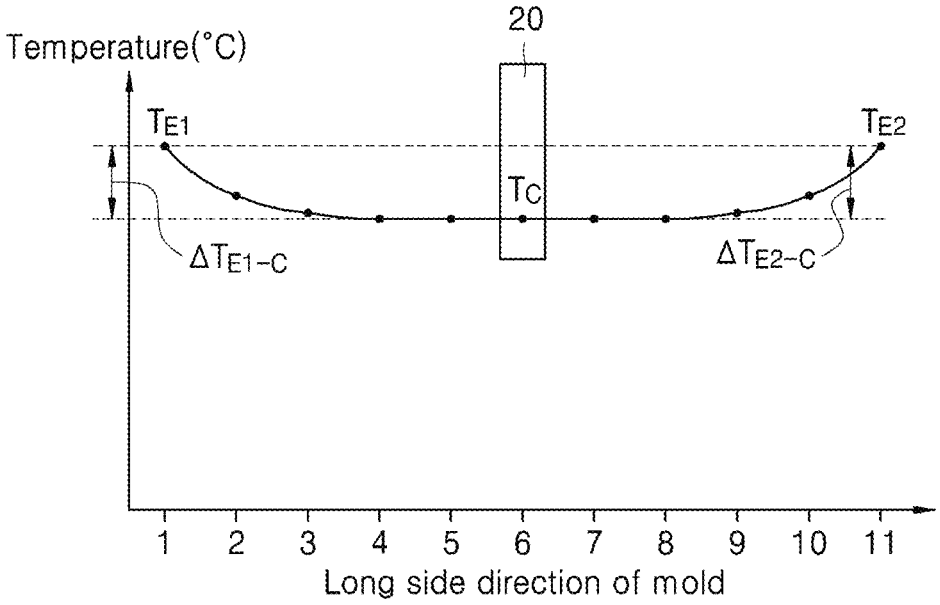
FIGS. 27 and 28 are views illustrating temperature distribution in a first flow pattern type and a second flow pattern type, which are classified to a normal flow pattern according to an embodiment of the present invention.
Figure 28:
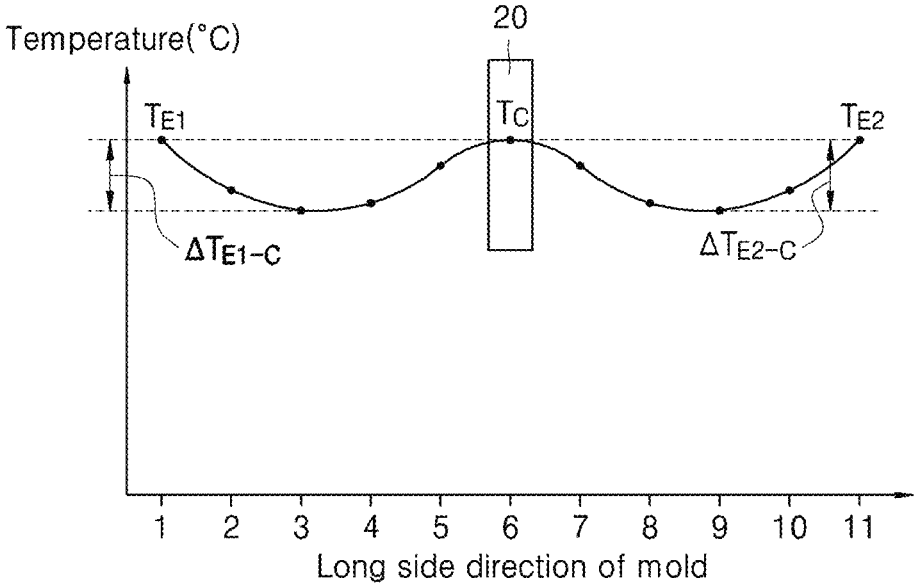
Figure 30:
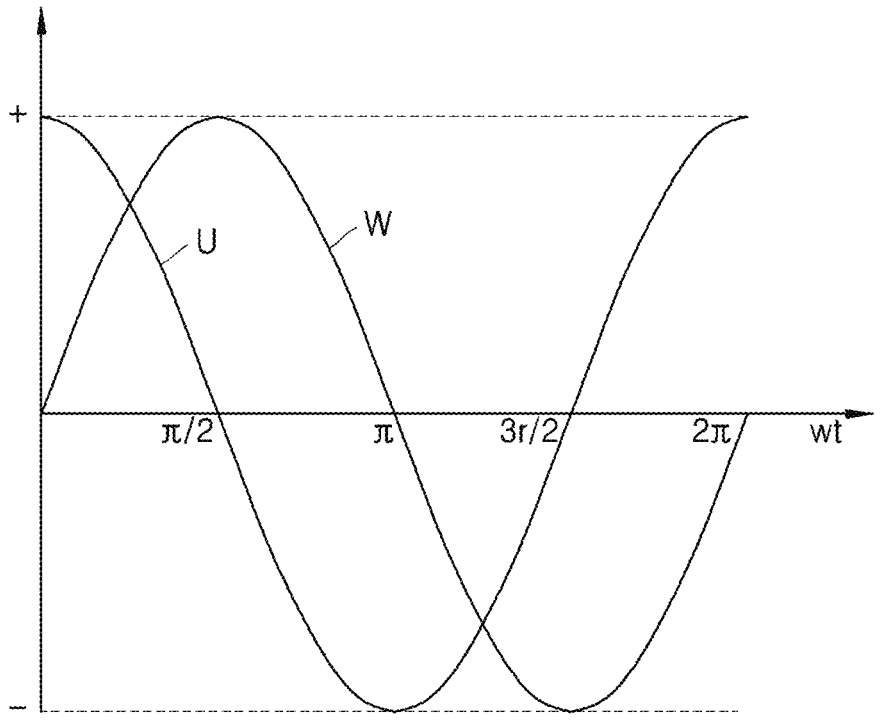
FIG. 30 is a view illustrating a phase of two-phase AC current applied to the magnetic field generation unit.
Figure 33:
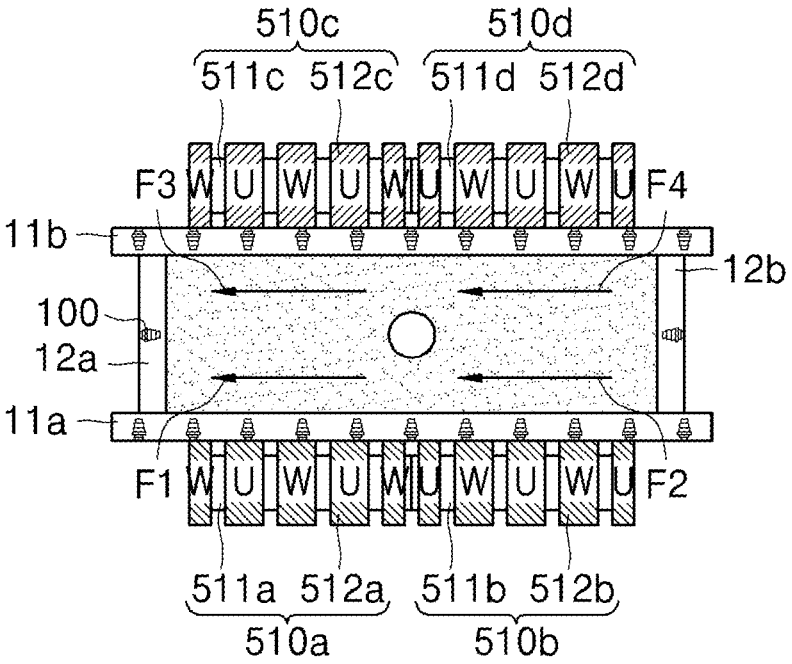
Figure 34:
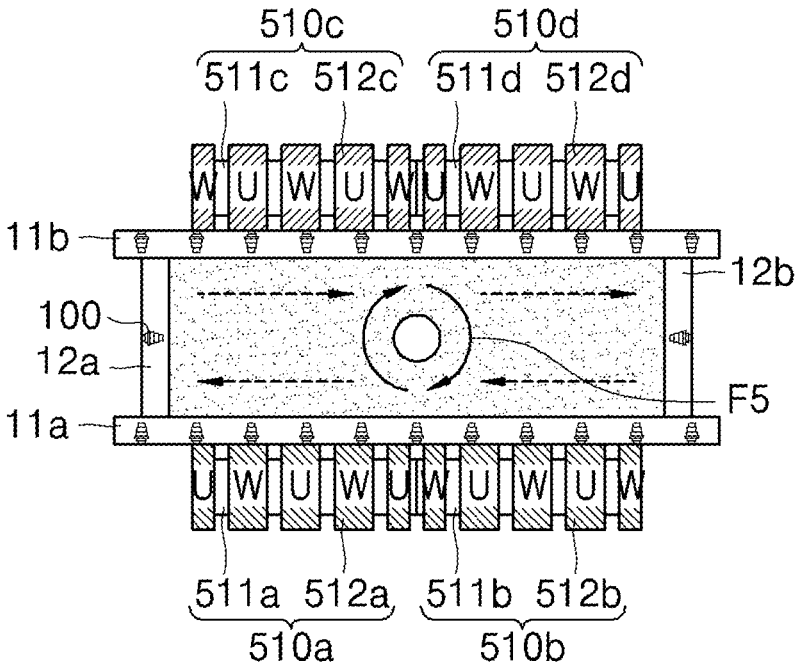
Figure 35:
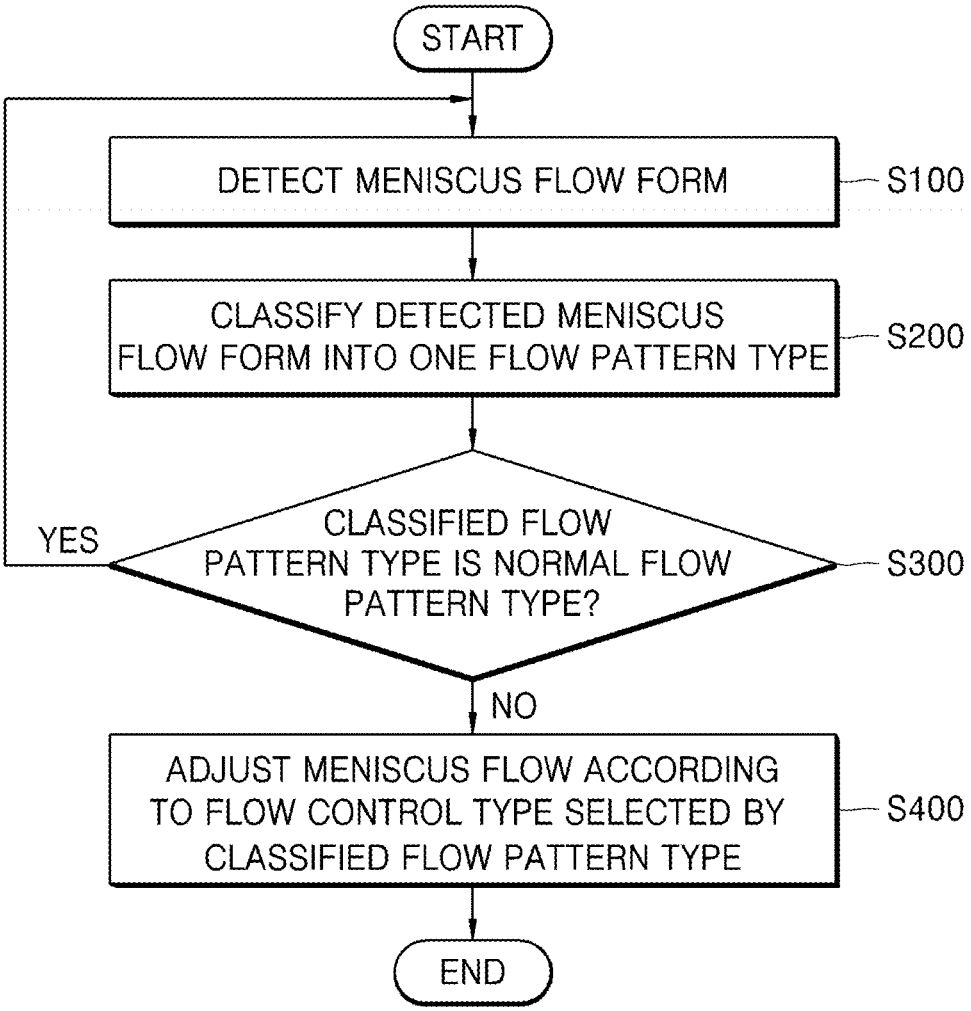
FIG. 35 is a flowchart for explaining a meniscus flow control method according to an embodiment of the present invention.
Figure 36:
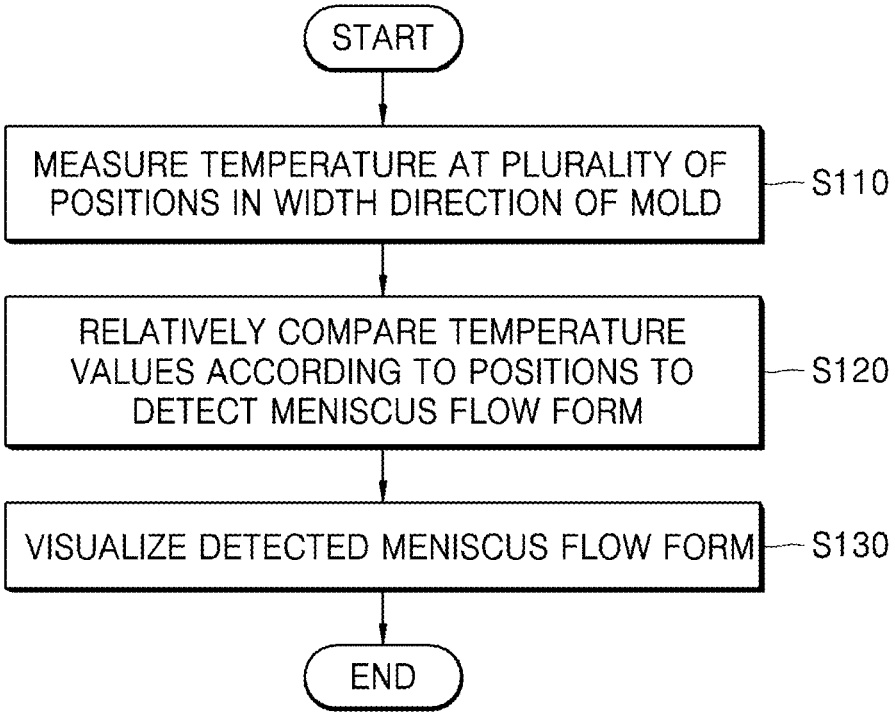
FIG. 36 is a flowchart for explaining a method for detecting a meniscus flow form in the meniscus flow control method according to an embodiment of the present invention.
Figure 37:
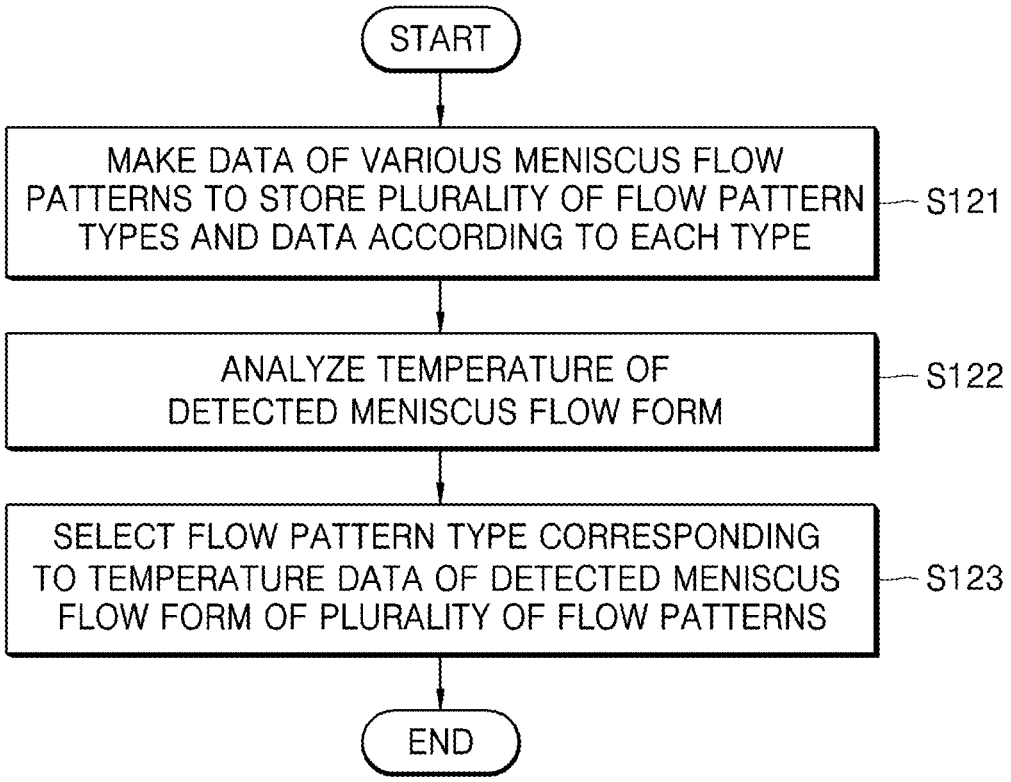
FIG. 37 is a flowchart for explaining a method for classifying the meniscus flow detected in the meniscus flow control method into one flow type according to an embodiment of the present invention.

FIG. 16 is a conceptual view of a meniscus flow control device according to a second embodiment of the present invention. FIGS. 17 and 18 are views of a mold in which the plurality of measurers and a magnetic field generation unit. FIG. 19 is a view illustrating a state in which components of the meniscus flow control device according to an embodiment of the present invention. FIG. 20 is a top view illustrating a state in which a plurality of temperature measurers are respectively installed on a pair of long sides and a pair of short sides of a mold. FIG. 21 is a graph visualizing a meniscus flow form detected by relatively representing temperatures for respective positions at the pair of long sides and the pair of short sides, which are measured by the plurality of measurers, and FIG. 22 is a three-dimensionally visualizing image. FIG. 23 is a top view illustrating a state in which the temperature measurers are respectively installed on the long and short sides of the mold. FIG. 24 is a view illustrating a plurality of flow pattern types that are previously stored or set in a flow pattern type storage part according to an embodiment of the present invention. FIG. 25 is a view illustrating a double-roll flow pattern generated in an eighth flow pattern type illustrated in FIG. 24. FIG. 26 is a view illustrating a single-roll flow pattern in a seventh flow pattern type illustrated in FIG. 24. FIGS. 27 and 28 are views illustrating temperature distribution in a first flow pattern type and a second flow pattern type, which are classified to a normal flow pattern according to an embodiment of the present invention. FIG. 29 is a view illustrating the plurality of flow pattern types that are previously stored or set in the flow pattern type storage part and according to an embodiment of the present invention and a plurality of flow control types according to the plurality of flow pattern types. FIG. 30 is a view illustrating a phase of two-phase AC current applied to the magnetic field generation unit. FIGS. 31 to 34 are views for explaining a flow direction and a rotational flow of molten steel according to the two-phase AC current applied to the magnetic field generation unit. FIG. 35 is a flowchart for explaining a meniscus flow control method according to an embodiment of the present invention. FIG. 36 is a flowchart for explaining a method for detecting a meniscus flow form in the meniscus flow control method according to an embodiment of the present invention. FIG. 37 is a flowchart for explaining a method for classifying the meniscus flow detected in the meniscus flow control method into one flow type according to an embodiment of the present invention.

Referring to FIG. 16, a casting facility including a meniscus flow control device according to a second embodiment of the present invention includes a mold 10 receiving molten steel from a nozzle 20 to primarily cool the molten steel, a plurality of temperature measurers 100 arranged and installed to be spaced apart from each other on the mold 10 in a width direction of the mold 10 to measure a temperature at each position, a magnetic field generation unit 500 installed outside the mold 10 to generate magnetic fields for allowing the molten steel within the mold 10 to flow, a meniscus flow detection unit 200 detecting a flow of the meniscus received in the mold 10, a flow pattern classification unit 300 for classifying the detected meniscus flow form into one of the plurality of flow pattern types that are previously stored or set, and a flow control unit 400 controlling an operation of the magnetic field generation unit 500 according to the classified flow pattern types to adjust the meniscus flow and thereby to control the molten steel meniscus so that the meniscus has the form of a normal flow pattern.

That is, the temperature measurers 100, the meniscus detection unit 200, the flow control unit 400, and a display unit 600 according to the second embodiment are the same as those according to the first embodiment. That is, the second embodiment is the same as the first embodiment except that the flow pattern classification unit 300 is further provided, and a method for controlling the flow of the meniscus is selected and controlled according to the classified flow pattern type in the flow control unit 400.

The meniscus flow detection unit 200 according to the second embodiment relatively represents temperature values measured by the plurality of temperature measurers 100 according to positions in a width direction of the mold 10 or the molten steel meniscus and converts the temperature value to a relative height for each position of the molten steel meniscus, thereby detecting the meniscus flow form.

The process and method for detecting the meniscus flow form by using the plurality of measured temperature values transmitted from the plurality of temperature measurers 100 in the meniscus flow detection unit 200 will be described below in more detail. As illustrated in FIGS. 16, 17, and 20, the plurality of temperature measurers 100 are installed along an extension direction of a pair of long sides (a first long side 11*a* and a second long side 11*b*) and a pair of short sides (a first short side 12*a* and a second short side 12*b*) of the mold 10, respectively. Reference numerals 1 to 10 written along the extension direction of the first and second long sides 11*a* and 11*b* and the first and second short sides 12*a* and 12*b* represent numbers of the plurality of temperature measurers 100 installed at the first and second long sides 11*a* and 11*b* and the first and second short sides 12*a* and 12*b*. That is, the plurality of temperature measurers 100 that are respectively installed at the first and second long sides 11*a* and 11*b* of the mold 10 may be called first to seventh temperature measurers in order, for example, from a left side to a right side, and the plurality of temperature measurers 100 installed at each of the first and second short sides 12*a* and 12*b* may be called a tenth temperature measurer. Although one temperature measurer (i.e., the tenth temperature measurer) is installed at each of the first and second short sides 12*a* and 12*b* in this embodiment, the embodiment is not limited thereto. For example, a plurality of temperature measurers 100 may be installed along the extension direction of the short sides 12*a* and 12*b*.

As described above in the first embodiment, the plurality of temperature measurers 100 are installed at the first and second long sides 11*a* and 11*b* and first and second short sides 12*a* and 12*b* of the mold 10 to measure a temperature for each position. Here, the measured temperature is different according to a height of the meniscus. Thus, a form (or a type) of the entire meniscus may be detected by using a difference in temperature measured by the plurality of temperature measurers 100. Thus, the temperature values measured by the plurality of temperature measurers 100 disposed to be arranged in the width direction of the mold 10 or the meniscus are represented for each position. Here, since the temperatures are different according to heights of the meniscus. Thus, when the temperature values are relatively compared to each other, the relative heights of the meniscus may be detected. Thus, when the temperature values measured by the plurality of temperature measurers 100 are relatively compared to each other, the height of the meniscus for each position may be relatively determined to detect the meniscus flow form.

Also, when the position-variable temperatures in each of the directions of the first and second long sides 11*a* and 11*b* of the mold 10 are shown by using a graph, for example, the temperatures may be visualized as illustrated in FIG. 21, and the graph may be displayed on the display unit 600 to allow a worker to confirm the temperatures. Also, when the temperatures according to the positions in each of the directions of the first and second long sides 11*a* and 11*b* of the mold 10 and the temperatures according to the positions in each of the directions of the first and second short sides 12*a* and 12*b* are used, the temperatures may be visualized as illustrated in FIG. 22. This may be displayed on the display unit so that the worker confirms the visualized temperatures.

The flow pattern classification unit 300 compares the detected meniscus flow form to the flow pattern type that is previously set or stored to compare and classify whether the detected meniscus flow form corresponds to any one of the flow pattern types. Here, the flow pattern classification unit 300 classifies and determines whether it is a flow pattern (hereinafter, a normal flow pattern) having low possibility in occurrence of defects or whether it is a flow pattern (hereinafter, an abnormal flow pattern) having high possibility of occurrence of defects. Here, the normal flow pattern is a meniscus flow pattern having a defect rate of 0.8% or less, and the abnormal flow pattern is a meniscus flow pattern having a defect rate exceeding 0.8%. The flow pattern classification unit 300 includes a flow pattern type storage part 310 that forms temperature data including a plurality of kinds of flow pattern shapes that occur during the slab casting to store the plurality of flow pattern types and a pattern classification part 320 that compares the detected meniscus flow forms and the plurality of stored flow pattern types to each other to classify, define, or determine the detected meniscus flow patterns into one of the plurality of flow pattern types (see FIG. 19).

The plurality of flow pattern types are stored in the flow pattern type storage part 310 as described above. The plurality of flow pattern types are divided according to a difference between a minimum temperature and a maximum temperature (i.e., a meniscus temperature deviation $\Delta T_{H-L}$) of the plurality of measured temperature values and a relationship between each of temperatures $T_{E1}$ and $T_{E2}$ at both edges of the meniscus, which are measured by the temperature measurers 100 disposed at both outermost sides, of the plurality of measured temperature values and a center temperature $T_c$ measured by the temperature measurer 100 installed at a central portion of the meniscus at which the nozzle 20 is disposed. Hereinafter, a temperature difference $\Delta T_{H-L}$ between the minimum temperature and the maximum temperature of the temperature values for respective positions, which are measured by the plurality of temperature measurers 100, is called the meniscus temperature deviation $\Delta T_{H-L}$. Also, the center temperature $T_c$ is a temperature measured at a center in the width direction of the meniscus, i.e., a temperature measured by one of the temperature measurer corresponding to the nozzle or the temperature measurer disposed at both sides of the corresponding temperature measurer.

In a temperature distribution in one extension direction of the meniscus, when the meniscus temperature deviation $\Delta T_{H-L}$ is within a predetermined range, the temperature $T_{E1}$ and $T_{E2}$ at both the edges are higher than the temperature $T_c$ of the meniscus or equal to the temperature $T_c$ (within ±error range), and temperature deviations (hereinafter, a first temperature deviation $\Delta T_{E1-C}$ and a second temperature deviation $\Delta T_{E2-C}$) between each of the temperatures $T_{E1}$ and $T_{E2}$ at both the edges and the center temperature $T_c$, the molten steel may stably flow to cast a slab that prevents defects due to the flow from occurring. In more detail, a slab having a defect rate of 0.8 or less may be casted.

Here, when the meniscus temperature deviation $\Delta T_{H-L}$ is too large or small, since the defects due to the meniscus flow occur, the meniscus temperature deviation $\Delta T_{H-L}$ has to range from a first predetermined value to a second predetermined value that is greater than the first predetermined value. That is, the meniscus temperature deviation $\Delta T_{H-L}$ has to range from a first reference value $T_1$ to a second reference value $T_2$. The first and second reference values $T_1$ and $T_2$ may be obtained through several operations performed by the person skilled in the art according to compositions of the molten steel and conditions of the manufacturing facility.

Hereinafter, the range from first reference value $T_1$ and the second reference value $T_2$ is called a reference deviation. Also, that the meniscus temperature deviation $\Delta T_{H-L}$ satisfies the reference deviation represents that the meniscus temperature deviation $\Delta T_{H-L}$ has a value ranging from the first reference value $T_1$ to the second reference value $T_2$. On the other hand, that the meniscus temperature deviation $\Delta T_{H-L}$ does not satisfy the reference deviation represents that the meniscus temperature deviation $\Delta T_{H-L}$ is less than the first reference value $T_1$ or exceeds the second reference value $T_2$. For example, when the first temperature is 50° C., and the second reference value is 100° C., the reference deviation ranges from 50° C. to 100° C. (50° C. reference deviation 100° C.). Also, to cast the slab that is capable of preventing the defects due to the meniscus flow from occurring, the difference between the minimum temperature and the maximum temperature of the temperature values measured for each position of the meniscus during the casting, i.e., the meniscus temperature deviation $\Delta T_{H-L}$ has to range from the first reference value $T_1$ to the second reference value $T_2$ (e.g., ranging from 50° C. to 100° C.).

Also, to prevent the defects due to the meniscus flow from occurring, the temperatures $T_{E1}$ and $T_{E2}$ at both the edges of the meniscus may be greater than or equal to the center temperature $T_C$. Here, a difference between each of the temperatures $T_{E1}$ and $T_{E2}$ at both the edges and the center temperature $T_c$, i.e., the temperature deviations $\Delta T_{E1-C}$ and $\Delta T_{E2-C}$ have to be less than a predetermined value. Here, both the edges of the meniscus are temperatures of edge areas that are the most adjacent to the short sides 12*a* and 12*b* of the mold 10 within the mold 10, i.e., temperatures measured by the temperature measurers 100, which are respectively disposed adjacent to the first short side 12*a* and the second short side 12*b*, of the plurality of temperature measurers 100 installed to be arranged in the width direction of the mold 10. In other words, the temperatures are temperatures measured by the temperature measurers 100, which are disposed at the outermost positions of both sides, of the plurality of temperature measurers 100, i.e., temperatures at both the ends adjacent to the first short side 12*a* and the second short side 12*b*.

Hereinafter, a temperature of the meniscus, which is measured by the outermost temperature measurer 100 adjacent to an edge of the meniscus or one end of the meniscus adjacent to the first short side 12*a* or adjacent to the first short side 12*a*, is called a first edge temperature $T_{E1}$, and a temperature of the meniscus, which is measured by the outermost temperature measurer 100 adjacent to an edge of the meniscus or the other end of the meniscus adjacent to the second short side 12*b* or adjacent to the first short side 12*a*, is called a second edge temperature $T_{E2}$. As described above, to prevent the defects due to the meniscus flow from occurring, each of the first edge temperature $T_{E1}$ and the second edge temperature $T_{E2}$ has to be greater than or equal to the center temperature $T_c$, and each of a difference value (hereinafter, a first temperature deviation $\Delta T_{E1-C}$) between the first edge temperature $T_{E1}$ and the center temperature $T_c$ and a difference value (hereinafter, a second temperature deviation $\Delta T_{E2-C}$) between the second edge temperature $T_{E2}$ and the center temperature $T_c$ have to be less than a predetermined value. A reference value that is less than the predetermined value that has to satisfy each of the first temperature deviation $\Delta T_{E1-C}$ and the second temperature deviation $\Delta T_{E2-C}$ is a temperature value for dividing or classifying the plurality of flow pattern types. Thus, hereinafter, to classify the flow pattern types, a value compared to each of the first temperature deviation $\Delta T_{E1-C}$ and the second temperature deviation $\Delta T_{E2-C}$ is called a third reference value $T_3$ that serves as a reference value of each of the first temperature deviation $\Delta T_{E1-C}$ and the second temperature deviation $\Delta T_{E2-C}$.

Based on the above-described definition, according to the present invention, to minimize or prevent the occurrence of the defects of the slab due to the flow of the molten steel or the meniscus, when the meniscus temperature deviation $\Delta T_{H-L}$ satisfies the reference deviation (i.e., ranging from the first reference value $T_1$ to the second reference value $T_2$), each of the first edge temperature $T_{E1}$ and the second edge temperature $T_{E2}$ has to be greater than or equal to the center temperature $T_c$, the first temperature deviation $T_{E1-C}$ has to be less than the third reference value $T_3$, and the second temperature deviation $\Delta T_{E2-C}$ has to be less than the third reference value $T_3$. Also, the flow pattern satisfying the above-described conditions is defined as a normal flow pattern.

That is, in an embodiment of the present invention, the plurality of flow pattern types of the plurality of flow pattern types are defined as the normal flow patterns. That is, when all the first edge temperature $T_{E1}$ and the second edge temperature $T_{E2}$ are greater than the center temperature $T_c$, and each of the first temperature deviation $T_{E1-C}$ and the second temperature deviation $T_{E2-C}$ is less than the third reference value $T_3$, the flow pattern type is defined as a first flow pattern type. Also, when all the first edge temperature $T_{E1}$ and the second edge temperature $T_{E2}$ are equal to the center temperature $T_c$, and each of the first temperature deviation $T_{E1-C}$ and the second temperature deviation $T_{E2-C}$ is less than the third reference value $T_3$, the flow pattern type is defined as a second flow pattern type.

Here, "that at least one of the first edge temperature $T_{E1}$ and the second edge temperature $T_{E2}$ is equal to the center temperature $T_c$" may include a ±error. This does not represent that each of the first edge temperature $T_{E1}$ and the second edge temperature $T_{E2}$ is completely equal to the center temperature $T_c$, but represent that each of the first edge temperature $T_{E1}$ and the second edge temperature $T_{E2}$ is similar to the center temperature $T_c$ within ±error.

When the present meniscus flow form of the molten steel is one of the first flow pattern type and the second flow pattern type, the flow of the meniscus is in a very stable flow state. Here, a suitable meniscus speed and temperature may be secured to provide a flow state in which possibility of occurrence of defects is low, or a defect rate of the slab is less than 0.8. Thus, when the meniscus flow form is a form of each of the first flow pattern type and the second flow pattern type, the defects due to the flow does not occur, or the defect rate is minimized to 0.8 or less. Also, when the operation of the magnetic field generation unit 500 is not separately changed, the detected flow pattern shape is one of the first and second flow pattern types, current applied to the magnetic field generation units 500 disposed at both sides of the nozzle are the same.

On the other hand, when defects occur in the slab due to the flow of the molten steel and the meniscus, in the flow pattern of the meniscus or the temperature of the meniscus, the meniscus temperature deviation $\Delta T_{H-L}$ is out of the range of the first reference value $T_1$ to the second reference value $T_2$ (i.e., ranging from the first reference value $T_1$ to the second reference value $T_2$), each of the first and second edge temperatures $T_{E1}$ and $T_{E2}$ is less than the center temperature $T_c$, the first temperature deviation $T_{E1-C}$ exceeds the third reference value $T_3$, or the second temperature deviation $\Delta T_{E2-C}$ exceeds the third reference value $T_3$ (third to tenth flow pattern types of FIG. 24).

In an embodiment of the present invention, the plurality of flow pattern types of the plurality of flow pattern types are defined as the abnormal flow patterns (the third to tenth flow pattern types). That is, when at least one of the first edge temperature $T_{E1}$ and the second edge temperature $T_{E2}$ is greater than the center temperature $T_c$, and a flow pattern type, in which at least one of the first temperature deviation $T_{E1-C}$ and the second temperature deviation $T_{E2-C}$ exceeds the third reference value $T_3$, is defined as a third flow pattern type, a fourth flow pattern type, or an eighth flow pattern type. Also, a flow pattern type, in which one of the first edge temperature $T_{E1}$ and the second edge temperature $T_{E2}$ exceeds the third reference value $T_3$, is defined as the third flow type or the fourth flow pattern type, and a flow pattern type, in which all the first edge temperature $T_{E1}$ and the second edge temperature $T_{E2}$ exceeds the third reference value $T_3$, is defined as the eighth flow pattern type. Also, when a value is higher than the third reference value $T_3$ is defined as the fourth reference value $T_4$, if one of the first edge temperature $T_{E1}$ and the second edge temperature $T_{E2}$, which exceed the third reference value $T_3$, exceeds the fourth reference value $T_4$, the one of the first edge temperature $T_{E1}$ and the second edge temperature $T_{E2}$ is defined as the third flow pattern. Also, when one of the first edge temperature $T_{E1}$ and the second edge temperature $T_{E2}$, which exceed the third reference value $T_3$, exceeds the third reference value $T_3$, the one of the first edge temperature $T_{E1}$ and the second edge temperature $T_{E2}$ is defined as the fourth flow pattern type in case of the fourth reference value $T_4$ or less.

The third flow pattern type and the fourth flow pattern type may be meniscus flow forms occurring when a bias flow of the molten steel is serious due to blocking of one discharge hole of both discharge holes of the nozzle 20, through which the molten steel is discharged. Also, when the flows having the third and fourth flow pattern types occur, a stream or flow having a vortex shape may occur, and thus, the possibility of the occurrence of the defects may very increase. Also, the eighth flow pattern type is a meniscus flow form occurring when a double-roll flow in which the molten steel discharged from the nozzle is vertically branched to flow (see reference symbols A and B of FIG. 25) occurs as illustrated in FIG. 25 due to the blocking of both the discharge holes of the nozzle 20. When the eighth pattern occurs, the stream or flow having the vortex shape occurs, and thus, the possibility of the occurrence of the defects very increases.

Also, one of the first edge temperature $T_{E1}$ and the second edge temperature $T_{E2}$ is less than the center temperature $T_c$, and the other one is greater than the center temperature $T_c$. Also, a flow pattern type, in which one of first temperature deviation $T_{E1-C}$ and the second temperature deviation $T_{E2-C}$ exceeds the third reference value $T_3$, is defined as a fifth flow pattern type or a sixth flow pattern type.

Also, when a value is higher than the third reference value $T_3$ is defined as the fourth reference value $T_4$, if one of the first edge temperature $T_{E1}$ and the second edge temperature $T_{E2}$, which exceed the third reference value $T_3$, exceeds the fourth reference value $T_4$, the one of the first edge temperature $T_{E1}$ and the second edge temperature $T_{E2}$ is defined as the fifth flow pattern. Also, when one of the first edge temperature $T_{E1}$ and the second edge temperature $T_{E2}$, which exceed the third reference value $T_3$, exceeds the third reference value $T_3$, the one of the first edge temperature $T_{E1}$ and the second edge temperature $T_{E2}$ is defined as the sixth flow pattern type in case of the fourth reference value $T_4$ or less.

The fifth flow pattern type is a flow pattern that is a single-roll flow and a bias flow, in which the external air is inserted and mixed through the sliding gate controlling the communication of the nozzle 20 between the tundish and the mold 10, an amount of Ar supplied to the nozzle 20 is not controlled, and the wearing of the nozzle 20 occurs to allow the molten steel discharged from the nozzle to flow C downward (see FIG. 26). Slag from the molten steel may be inserted and mixed due to the fifth flow pattern type to cause the defects. Also, the sixth flow pattern type is a flow pattern in which a downstream flow occurs to one side or the other side with respect to a center of the meniscus, or a slow meniscus speed occurs. Also, the sixth flow pattern type is a flow pattern forming a weak single-roll and bias flow when compared to the fifth flow pattern type. Thus, the temperature of the meniscus is significantly reduced, and thus, the possibility of the occurrence of the defects having a hole shape significantly increases.

Also, a flow pattern type, in which the meniscus temperature deviation $\Delta T_{H-L}$ satisfies a range from the first reference value $T_1$ to the second reference value $T_2$, and the first and second edge temperatures $T_{E1}$ and $T_{E2}$ are less than the center temperature, is defined as a seventh flow pattern type. A flow pattern type as a different pattern type, in which the meniscus temperature deviation $\Delta T_{H-L}$ is less than the first reference value $T_1$, and each of the first and second edge temperatures $T_{E1}$ and $T_{E2}$ is equal to the center temperature $T_c$ or similar to the center temperature $T_c$ within the ±error range to form a gentle flow, is defined as a ninth flow pattern type. Also, a flow pattern type, in which one of the first edge temperature $T_{E1}$ and the second edge temperature $T_{E2}$ is less than the center temperature $T_c$, and the other one is equal to the center temperature $T_c$ or similar to the center temperature within the ±error range, is defined as the tenth flow pattern type.

The seventh flow pattern is similar to the fifth flow pattern type in aspect of generation. The seventh flow pattern type is a flow pattern occurring by the single-roll and strong bias flow due to the external air is inserted and mixed through the sliding gate controlling the communication of the nozzle 20 between the tundish and the mold 10, an amount of Ar supplied to the nozzle 20 is not controlled, and the wearing of the nozzle 20. Also, the mixing of the slag into the molten steel occurs by the seventh flow pattern type to form the single-roll flow pattern, and thus, defects occur.

Here, the ninth flow pattern type is a very gentle flow having a flat meniscus in which the flow does not occur nearly. Like the sixth flow pattern type, in the ninth flow pattern type, a downstream flow occurs to one side or the other side with respect to a center of the meniscus, or a slow meniscus speed occurs. When the ninth flow pattern type occurs, the temperature of the meniscus may significantly decrease, and thus, the defects having the hole shape may occur. Also, the tenth flow pattern type is a flow in which the very gentle flow having the flat meniscus and the single-roll flow are combined with each other. Thus, the defects having the hole shape may occur by this flow.

As described above, in the present invention, the meniscus flow pattern type is classified into ten types (see FIG. 24), and the first and second flow pattern types of the ten types are normal pattern types in which the defect rate is low, and the third and tenth flow pattern types are abnormal pattern types in which the defect rate is high. Also, the first to tenth flow pattern types classified into described above and data thereof are previously stored or set in the flow pattern storage part 310. A process of detecting a meniscus pattern shape from the flow pattern type storage part 310 in which the first to tenth flow pattern types are stored is classified into one of the first to tenth flow pattern types will be described below. When the detected meniscus flow pattern does not correspond to the meniscus flow pattern data stored in the flow pattern type storage part 300, the present meniscus flow pattern and quality of a slab according to the present meniscus flow pattern are tracked, and then the tracked data are stored in the flow pattern type storage part. Then, the flow pattern type storage part 310 is continuously updated.

The flow pattern shape detected by the meniscus flow detection unit 200 and the first to tenth flow pattern types stored in the flow pattern type storage part 310 are contrasted or compared to each other in the pattern classification unit 320 to classify the flow pattern shape detected during the slab casting as one pattern of the first to tenth flow pattern types.

That is, a temperature for each meniscus position (for each position in the width direction of the slab) of the flow pattern shape detected in the pattern classification unit 320 is analyzed to select and classify a flow pattern type that corresponds to the analyzed temperature data or a flow pattern type satisfied by the analyzed temperature data. In detail, a difference between the minimum temperature and the maximum temperature, i.e., the meniscus temperature deviation $\Delta T_{H-L}$, the first and second edge temperatures $T_{E1}$ and $T_{E2}$, and the meniscus center temperature $T_c$ of the temperatures for positions of the detected flow pattern shape are analyzed to select and classify a flow pattern type satisfied by each of the meniscus temperature deviation $\Delta T_{H-L}$, the first and second edge temperatures $T_{E1}$ and $T_{E2}$, the first temperature deviation $\Delta T_{E1-C}$, and the second temperature deviation $\Delta T_{E2-C}$. That is, one of the first to tenth flow pattern types is selected according to whether the meniscus temperature deviation $\Delta T_{H-L}$ of the detected flow pattern shape satisfies or is out of the reference deviation, whether the first and second edge temperatures $T_{E1}$ and $T_{E2}$ are equal to or greater or less than the meniscus center temperature $T_c$, or whether each of the first and second temperature deviations $T_{E1}$ and $\Delta T_{E2-C}$ is less than or equal to the third reference value $T_3$ and then is classified into one of the normal flow pattern and the abnormal flow pattern.

For example, in the detected meniscus flow pattern, when the first temperature deviation $\Delta T_{E1-C}$ satisfies the reference deviation, each of the first and second edge temperatures $T_{E1}$ and $T_{E2}$ is greater than the center temperature $T_c$, and each of the first temperature deviation $\Delta T_{E1-C}$, and the second temperature deviation $\Delta T_{E2-C}$ is less than the third reference value $T_3$, the meniscus flow pattern is classified into one of the first and second flow pattern types. Here, when each of the first and second edge temperatures $T_{E1}$ and $T_{E2}$ is greater than the center temperature $T_c$, the meniscus flow pattern is classified into the first flow pattern type, and when each of the first and second edge temperatures $T_{E1}$ and $T_{E2}$ is equal to the center temperature $T_c$ or is similar to the center temperature $T_c$ within the ±error range, the meniscus flow pattern is classified into the second flow pattern type.

Also, when defects occur in the slab due to the flow of the molten steel and the meniscus, in the flow pattern of the meniscus or the temperature of the meniscus, when the meniscus temperature deviation $\Delta T_{H-L}$ is out of the range of the first reference value $T_1$ to the second reference value $T_2$ (i.e., ranging from the first reference value $T_1$ to the second reference value $T_2$), each of the first and second edge temperatures $T_{E1}$ and $T_{E2}$ is less than the center temperature $T_c$, the first temperature deviation $T_{E1-C}$ exceeds the third reference value $T_3$, or the second temperature deviation $\Delta T_{E2-C}$ exceeds the third reference value $T_3$, the meniscus flow pattern is classified into one of the third to tenth flow pattern types.

That is, a flow pattern type, in which the meniscus temperature deviation $\Delta T_{H-L}$ is out of the reference deviation, at least one of the first and second edge temperatures $T_{E1}$ and $T_{E2}$ is greater than the center temperature, and at least one of the first temperature deviation $T_{E1-C}$ and the second temperature deviation $T_{E2-C}$ exceeds the third reference value $T_3$, is classified into the third, fourth, or eighth flow pattern type. Here, when one of the first and second temperature deviations $\Delta T_{E1-C}$ and $\Delta T_{E2-C}$ exceeds the third reference values $T_3$, the meniscus flow pattern is classified into one of the third and fourth flow pattern types, and when all the first and second temperature deviations $\Delta T_{E1-C}$ and $\Delta T_{E2-C}$ exceed the third reference values $T_3$, the meniscus flow pattern is classified into the eighth flow pattern type. Also, when one of the first and second temperature deviations $\Delta T_{E1-C}$ and $\Delta T_{E2-C}$ exceeds the third reference values $T_3$, and the edge temperature exceeding the third reference value $T_3$ exceeds the fourth reference value $T_4$ while exceeding the third reference value $T_3$, the meniscus flow pattern is classified into the third flow pattern type. Also, when the edge temperature exceeding the third reference value $T_3$ is less than the fourth reference value $T_4$ while exceeding the third reference value $T_3$, the meniscus flow pattern is classified into the fourth flow pattern type.

For another example, a flow pattern type, in which one of the first edge temperature $T_{E1}$ and the second edge temperature $T_{E2}$ of the detected flow pattern is less than the center temperature $T_c$, the other one is greater than the center temperature $T_c$, and one of first temperature deviation $T_{E1-C}$ and the second temperature deviation $T_{E2-C}$ exceeds the third reference value $T_3$, is classified into the fifth flow pattern type or the sixth flow pattern type. Here, when the first or second temperature deviation $\Delta T_{E1-C}$ or $\Delta T_{E2-C}$ exceeds the fourth reference values $T_4$ while exceeding the third reference value $T_3$, the meniscus flow pattern is defined as the fifth flow pattern type. When the first or second temperature deviation $\Delta T_{E1-C}$ or $\Delta T_{E2-C}$ is less than the fourth reference values $T_4$ while exceeding the third reference value $T_3$, the meniscus flow pattern is defined as the sixth flow pattern type. Also, a flow pattern type, in which the meniscus temperature deviation $\Delta T_{H-L}$ of the detected flow pattern satisfies a range from the first reference value $T_1$ to the second reference value $T_2$, and the first and second edge temperatures $T_{E1}$ and $T_{E2}$ are less than the center temperature $T_c$, is defined as the seventh flow pattern type.

Also, a flow pattern type, in which the meniscus temperature deviation $\Delta T_{H-L}$ of the detected meniscus flow pattern is less than the first reference value $T_1$, and each of the first and second edge temperatures $T_{E1}$ and $T_{E2}$ is equal to the center temperature $T_c$ or similar to the center temperature $T_c$ within the ±error range to form a gentle flow, is defined as the ninth flow pattern type.

Also, a flow pattern type, in which one of the first edge temperature $T_{E1}$ and the second edge temperature $T_{E2}$ is less than the center temperature $T_c$, and the other one is equal to the center temperature $T_c$ or similar to the center temperature within the ±error range, is classified into the tenth flow pattern type.

In the second embodiment of the present invention, the meniscus flow form detected through the above-described methods is classified into one flow pattern type. In the pattern classification according to the embodiment, the meniscus flow form detected by using the temperature values measured by the plurality of temperature measurers 100 installed on the first and second long sides 11*a* and 11*b* is classified into one flow pattern type. Here, the meniscus flow form having the relatively large meniscus temperature deviation of the meniscus flow form detected and measured by the plurality of temperature measurers 100 installed along the first long side 11*a* and the meniscus flow form detected and measured by the plurality of temperature measurers 100 installed along the second long side 11*b* is classified into one flow pattern type to transmit the classified flow pattern type to the flow control unit 400. Also, power or current is applied to the magnetic field generation unit 500 so that the molten steel flow occurs in the flow pattern type classified in the flow control unit 400.

As described in the first embodiment, the magnetic field generation unit 500 generates magnetic fields to allow the molten steel to flow by the magnetic fields and is controlled by the flow control unit 400. As illustrated in FIGS. 1, 16, 17, and 18, the magnetic field generation unit 500 includes, for example, the plurality of magnetic field generation parts 510*a*, 510*b*, 510*c*, and 510*d*.

The first to fourth magnetic generation parts 510*a*, 510*b*, 510*c*, and 510*d* includes core members 511*a*, 511*b*, 511*c*, and 511*d* extending in a direction of the long sides 11*a* and 11*b* of the mold 10 and a plurality of coil members 512*a*, 512*b*, 512*c*, and 512*d* respectively wound around outer surfaces of the core members 511*a*, 511*b*, 511*c*, and 511*d* and spaced apart from each other in the extension direction of the core members 511*a*, 511*b*, 511*c*, and 511*d*, respectively.

Here, a direction in which the coil member 512*a* of the first magnetic field generation part 510*a* is wound around the core member 511*a* is the same as that in which the coil member 512*b* of the second magnetic field generation part 510*b* is wound around the core member 511*b*, and a direction in which the coil member 512*c* of the third magnetic field generation part 510*c* is wound around the core member 511*a* is the same as that in which the coil member 512*d* of the fourth magnetic field generation part 510*d* is wound around the core member 511*d*. Also, a direction in which the coil members 512*a* and 512*b* of the first and second magnetic field generation parts 510*a* and 510*b* are wound around the core members 511*a* and 511*b* is opposite to that in which the coil members 512*c* and 512*d* of the third and fourth magnetic field generation parts 510*c* and 510*d* are wound around the core members 511*c* and 511*d*.

For example, as illustrated in FIG. 17, the direction in which the coil member 512*a* of the first magnetic field generation part 510*a* is wound around the core member 511*a* and the direction the coil member 512*b* of the second magnetic field generation part 510*b* is wound around the core member 511*b* are a clockwise direction, and the direction in which the coil member 512*c* of the third magnetic field generation part 510*c* is wound around the core member 511*c* and the direction in which the coil member 512*d* of the fourth magnetic field generation part 510*d* is wound around the core member 511*d* are a counterclockwise direction.

Alternatively, the coil members 512*a* and 512*b* of the first and second magnetic field generation parts 510*a* and 510*b* may be wound in the counterclockwise direction, and the coil members 512*c* and 512*d* of the third and fourth magnetic field generation parts 510*c* and 510*d* may be wound in the clockwise direction.

Although the description with respect to the directions in which the coil members 512*a*, 512*b*, 512*c*, and 512*d* of the first to fourth magnetic field generation parts 510*a*, 510*b*, 510*c*, and 510*d* are wound around the core members 511*a*, 511*b*, 511*c*, and 511*d* is omitted in the description of the meniscus flow control device according to the first embodiment, its description may be equally applied.

In general, the temperature of the molten steel is about 1500° C. in case of carbon steel, and a curie temperature is about 800° C. Since the molten steel is greater than the curie temperature, the molten steel does not have magnetic properties. However, since the molten steel is affected by the magnetic fields due to Lorentz force, a relationship between conductivity σ, a relative speed V between the molten steel and the magnetic fields, and the magnetic field density B will be expressed by following Equation (1).

Equation (1)

$$F=\sigma\cdot B2\cdot V \tag{1}$$

The flow control unit 400 controls power or current applied to the magnetic field generation unit 500 according to the meniscus flow pattern classified in the flow pattern classification unit 300 to adjust magnetic fields within the molten steel to realize a normal flow pattern.

A multiphase or two-phase AC voltage is applied to the magnetic field generation unit having an electromagnet shape installed along the extension direction of the long sides 11*a* and 11*b* of the mold 10 (see FIG. 30) to form movable magnetic fields, and the flow of the molten steel is adjusted by the movable magnetic fields. As illustrated in FIG. 19, the flow control unit 400 includes a flow control type storage part 410 in which power apply conditions of the magnetic field generation unit 500, i.e., a plurality of flow control types are stored according to kinds of meniscus pattern types classified in the flow pattern classification unit 300, a flow control type selection part 420 selecting one of the plurality of flow control types to maintain or adjust the classified flow pattern type to the normal flow pattern, and a power apply control part 430 applying power to the magnetic field generation unit 500 according to the type selected in the flow control type selection part 420.

A flow control type for adjusting each of the flow pattern types stored in at least the flow pattern type storage part 310 to the normal flow pattern is set or stored in the flow control type storage part 410. That is, flow control types (i.e., first to sixth control types) with respect to third to tenth flow pattern types are set or stored so that the third to tenth flow pattern types, which are abnormal patterns, are adjusted as one of the first and second flow pattern types.

The flow control types stored in the flow control type storage part 410 are changed according to the applying method of the magnetic fields. That is, there is an applying method for generating the molten steel flow in which the magnetic fields horizontally moving along the direction of the long sides move from the short sides 12*a* and 12*b* of the mold 10 in a direction in which the nozzle 20 is disposed, i.e., in a direction opposite to a direction in which the molten steel is discharged from the nozzle 20 to give breaking force to the discharge stream of the molten steel in the nozzle 20. In this specification, the applying method is expressed as an "EMLS", an "EMLS mode", or "magnetic field applying by the EMLS mode" (EMLS: electromagnetic level stabilizer). When the magnetic fields are formed in the magnetic field generation unit 500 in the EMLS mode, the molten steel flow speed of the molten steel meniscus within the mold 10 may be reduced. According to the other magnetic field applying method, there is a method for giving the acceleration force of the molten steel discharged from the nozzle 20. There is a method in which the magnetic fields horizontally moving along the direction of the long sides 11*a* and 11*b* of the mold move from the nozzle 20 in a direction of the short sides 12*a* and 12*b* of the mold 20, i.e., in the same direction as the molten steel discharge direction of the nozzle 20 to give the acceleration force to the molten steel discharge stream. In this specification, the applying method is expressed as an "EMLA", an "EMLA mode", or "magnetic field applying by the EMLA mode" (EMLA: electromagnetic level accelerating). When the magnetic field generation unit 500 generates magnetic fields in the above-described EMLA mode, the molten steel discharge stream is accelerated from the nozzle 20. Thus, the discharge stream collides with walls of the short sides 12*a* and 12*b* of the mold 10, and then, the molten steel is vertically branched along the short sides 12*a* and 12*b*. Here, the molten steel branched to flow upward flows from the positions of the short sides 12*a* and 12*b* of the mold 10 in the direction of the nozzle 20 on the molten steel meniscus. There is a method in which the molten steel within the mold 10 horizontally rotates by using the nozzle 20 as a center as further another magnetic field applying method. In detail, there is a method in which the magnetic fields horizontally moving along the long sides 11*a* and 11*b* of the mold 10 move in opposite directions along the relative long sides to generate a molten steel flow that horizontally rotates along a solidification interface. In this specification, the applying method is expressed as an "EMRS", an "EMRS mode", or "magnetic field applying by the EMRS mode".

As described above, the EMRS, the EMRS mode, or the magnetic field applying by the EMRS mode is changed according to an applying order of a U phase and a W phase when AC current is applied to each of the coil members 512*a*, 512*b*, 512*c*, and 512*d* respectively constituting the first to fourth magnetic field generation parts. The order is changed at every angle of 90° (π/2).

The power apply control part 430 adjusts power, i.e., an AC voltage applied to the plurality of magnetic field generation parts 510*a*, 510*b*, 510*c*, and 510*d* according to the flow control type selected in the flow control type selection part 420. In more detail, when the AC voltage is applied to the coil members 512*a*, 512*b*, 512*c*, and 512*d* respectively constituting the first to fourth magnetic field generation parts 510*a*, 510*b*, 510*c*, and 510*d*, the AC voltage is applied while the AC voltage having the U phase and the W phase are successively switched with respect to the plurality of coil members 512*a*, 512*b*, 512*c*, and 512*d*. Here, the phase change may be changed at an angle of 90°.

Figure 32:
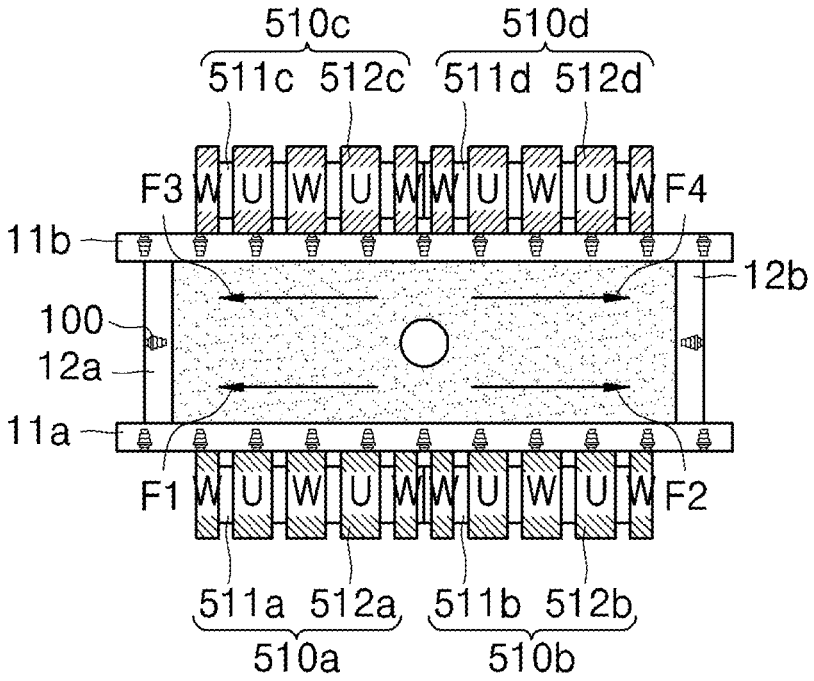

For example, in the first and second magnetic field generation parts 510*a* and 510*b* installed outside the first long side 11*a*, when the current is applied to the plurality of coil members 512*a* constituting the first magnetic field generation part 510*a*, the current is applied in order of the U phase, the W phase, the U phase, the W phase, and the U phase from the first short side 12*a* in the direction of the nozzle 20. When the current is applied to the plurality of coil members 512*b* constituting the second magnetic field generation part 510*b*, the current is applied in order of the U phase, the W phase, the U phase, the W phase, and the U phase from the second short side 12*b* in the direction of the nozzle 20. In more details, when the plurality of coil members 512*a* of the first magnetic field generation part 510*a* successively disposed from the first short side 12*a* in the direction of the nozzle 20 are the first to fifth coil members 512*a*, power having the U phase, the W phase, the U phase, the W phase, and the U phase are applied to the first, second, third, fourth, and fifth coil members 512*a*, respectively. Also, when the plurality of coil members 512*b* of the second magnetic field generation part 510*b* successively disposed from the second short side 12*b* in the direction of the nozzle 20 are the first to fifth coil members 512*b*, power having the U phase, the W phase, the U phase, the W phase, and the U phase are applied to the first, second, third, fourth, and fifth coil members 512*b*, respectively. Thus, the magnetic fields move in the direction from the nozzle 20 to the first short side 12*a* along the extension direction of the core member 511*a* of the first magnetic field generation part 510*a* and in the direction from the nozzle 20 to the second short side 12*b* along the extension direction of the core member 511*b* of the second magnetic field generation part 510*b*. Thus, induction current is generated in the molten steel. The molten steel receives driving force followed and induced in the moving direction of the magnetic fields due to the force (Lorentz force) applied to the induction current from the magnetic fields. As illustrated in FIG. 32, the molten steel flows in the direction from the nozzle 20 to the both short side.

Figure 31:
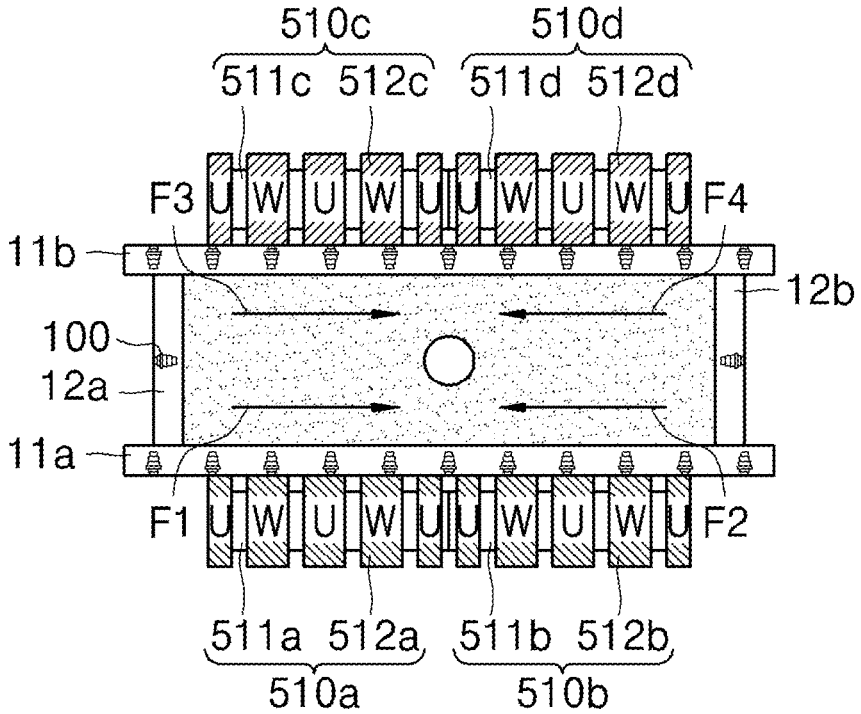
FIGS. 31 to 34 are views for explaining a flow direction and a rotational flow of molten steel according to the two-phase AC current applied to the magnetic field generation unit.

Similarly, in the third and fourth magnetic field generation parts 510*c* and 510*d* installed outside the second long side 11*b*, when the current is applied to the plurality of coil members 512*c* constituting the third magnetic field generation part 510*a* and 510*c*, the current is applied in order of the U phase, the W phase, the U phase, the W phase, and the U phase from the first short side 12*a* in the direction of the nozzle 20. When the current is applied to the plurality of coil members 512*d* constituting the fourth magnetic field generation part 510*d*, the current is applied in order of the U phase, the W phase, the U phase, the W phase, and the U phase from the second short side 12*b* in the direction of the nozzle 20. That is, when the plurality of coil members 512*c* of the third magnetic field generation part 510*c* successively disposed from the first short side 12*a* in the direction of the nozzle 20 are the first to fifth coil members 512*c*, the power having the U phase, the W phase, the U phase, the W phase, and the U phase are applied to the first, second, third, fourth, and fifth coil members 512*c*, respectively. Also, when the plurality of coil members 512*b* of the fourth magnetic field generation part 510*d* successively disposed from the second short side 12*b* in the direction of the nozzle 20 are the first to fifth coil members 512*d*, the power having the U phase, the W phase, the U phase, the W phase, and the U phase are applied to the first, second, third, fourth, and fifth coil members 512*d*, respectively. Thus, the magnetic fields move from the first short side 12*a* in the direction of the nozzle 20 along the extension direction of the core member 511*c* of the fourth magnetic field generation part 510*d* and move from the second short side 12*b* in the direction of the nozzle 20 along the extension direction of the core member 511*d* of the fourth magnetic field generation part 510*d*. Thus, induction current is generated in the molten steel. The molten steel receives driving force followed and induced in the moving direction of the magnetic fields due to the force (Lorentz force) applied to the induction current from the magnetic fields. As illustrated in FIG. 31, the molten steel flows from both end sides to the directions F3 and F4 of the nozzle.

The magnetic fields move from the short sides 12*a* and 12*b* in the direction of the nozzle 20 in the first and second magnetic field generation part 510*a* and 510*b* and the third and fourth magnetic field generation parts 510*c* and 510*d*. This is an EMLS magnetic field applying method. Here, the molten steel moves from both the short sides 12*a* and 12*b* in the direction of the nozzle. Here, since the flow direction of the molten steel and the discharge direction of the molten steel discharged from the discharge hole of the nozzle 20 are different from each other, the flow speed of the molten steel is decelerated. Also, according to the magnetic field applying method, as illustrated in FIG. 31, the magnetic field movement of the EMLS mode occurs in each of the first and third magnetic field generation parts 510*a* and 510*c* and the second and fourth magnetic field generation parts 510*b* and 510*d*, which are disposed on both sides with respect to the center of the nozzle 20.

For another example, in the first and second magnetic field generation parts 510*a* and 510*b* installed outside the first long side 11*a*, when the current is applied to the plurality of coil members 512*a* constituting the first magnetic field generation part 510*a*, the current is applied in order of the W phase, the U phase, the W phase, the U phase, and the W phase from the first short side 12*a* in the direction of the nozzle 20. When the current is applied to the plurality of coil members 512*b* constituting the second magnetic field generation part 510*b*, the current is applied in order of the W phase, the U phase, the W phase, the U phase, and the W phase from the second short side 12*b* in the direction of the nozzle 20. In more details, when the plurality of coil members 512*a* of the first magnetic field generation part 510*a* successively disposed from the first short side 12*a* in the direction of the nozzle 20 are the first to fifth coil members 512*a*, power having the W phase, the U phase, the W phase, the U phase, and the W phase are applied to the first, second, third, fourth, and fifth coil members 512*a*, respectively. Also, when the plurality of coil members 512*b* of the second magnetic field generation part 510*b* successively disposed from the second short side 12*b* in the direction of the nozzle 20 are the first to fifth coil members 512*b*, the power having the W phase, the U phase, the W phase, the U phase, and the W phase are applied to the first, second, third, fourth, and fifth coil members 512*b*, respectively. Thus, the magnetic fields move from the first short side 12*a* in the direction of the nozzle 20 along the extension direction of the core member 511*a* of the first magnetic field generation part 510*a* and move from the second short side 12*b* in the direction of the nozzle 20 along the extension direction of the core member 511*b* of the second magnetic field generation part 510*b*. Thus, induction current is generated in the molten steel. The molten steel receives driving force followed and induced in the moving direction of the magnetic fields due to the force (Lorentz force) applied to the induction current from the magnetic fields. As illustrated in FIG. 32, the molten steel flows from both end sides to the directions F1 and F2 of the nozzle.

Also, in the third and fourth magnetic field generation parts 510*c* and 510*d* installed outside the second long side 11*b*, when the current is applied to the plurality of coil members 512*c* constituting the third magnetic field generation part 510*c*, the current is applied in order of the W phase, the U phase, the W phase, the U phase, and the W phase from the first short side 12*a* in the direction of the nozzle 20. When the current is applied to the plurality of coil members 512*d* constituting the fourth magnetic field generation part 510*d*, the current is applied in order of the W phase, the U phase, the W phase, the U phase, and the W phase from the second short side 12*b* in the direction of the nozzle 20. That is, when the plurality of coil members 512*c* of the third magnetic field generation part 510*c* successively disposed from the first short side 12*a* in the direction of the nozzle 20 are the first to fifth coil members 512*c*, power having the W phase, the U phase, the W phase, the U phase, and the W phase are applied to the first, second, third, fourth, and fifth coil members 512*c*, respectively. Also, when the plurality of coil members 512*b* of the fourth magnetic field generation part 510*d* successively disposed from the second short side 12*b* in the direction of the nozzle 20 are the first to fifth coil members 512*d*, the power having the W phase, the U phase, the W phase, the U phase, and the W phase are applied to the first, second, third, fourth, and fifth coil members 512*d*, respectively. Thus, the magnetic fields move in the direction from the nozzle 20 to the first short side 12*a* along the extension direction of the core member 511*c* of the fourth magnetic field generation part 510*d* and in the direction from the nozzle 20 to the second short side 12*b* along the extension direction of the core member 511*d* of the fourth magnetic field generation part 510*d*. Thus, induction current is generated in the molten steel. The molten steel receives driving force followed and induced in the moving direction of the magnetic fields due to the force (Lorentz force) applied to the induction current from the magnetic fields. As illustrated in FIG. 32, the molten steel flows in the direction from the nozzle 20 to the both short side.

The magnetic fields move in the direction from the nozzle 20 to the short sides 12*a* and 12*b* in the first and second magnetic field generation part 510*a* and 510*b* and the third and fourth magnetic field generation parts 510*c* and 510*d*. This is an EMLA magnetic field applying method. Here, the molten steel moves in the direction from the nozzle 20 to the both short side. Here, since the flow direction of the molten steel and the discharge direction of the molten steel discharged from the discharge hole of the nozzle 20 are the same, the flow speed of the molten steel is accelerated. Also, according to the magnetic field applying method, as illustrated in FIG. 32, the magnetic field movement of the EMLA mode occurs in each of the first and third magnetic field generation parts 510*c* and the second and fourth magnetic field generation parts 510*b* and 510*d*, which are disposed on both sides with respect to the center of the nozzle 20.

As described above, the magnetic fields flows to the first and second magnetic field generation parts 510*a* and 510*b* disposed in both the sides with respect to the center of the nozzle 20 in the same direction, and the magnetic fields flows to the third and fourth magnetic field generation parts 510*c* and 510*d* disposed in both the sides with respect to the center of the nozzle 20 in the same direction. Thus, power is applied to both the sides with respect to the center of the nozzle 20 in the EMLS mode so that the molten steel is decelerated at both the sides of the nozzle 20 as illustrated in FIG. 31, and power is applied to both the sides with respect to the center of the nozzle 20 in the EMLA mode so that the molten steel is decelerated at both the sides of the nozzle 20 as illustrated in FIG. 32.

However, the embodiment is not limited thereto. For example, in both side directions of the nozzle 20, the magnetic fields may be formed in the EMLA mode at one of one side and the other side and in the EMLS mode at the other one. For example, the magnetic fields are formed in the EMLA mode at each of the first and third magnetic field generation parts 510*a* and 510*c* disposed on one side of the nozzle 20 and in the EMLS mode at each of the second and fourth magnetic field generation parts 510*b* and 510*d*. For this, as illustrated in FIG. 33, current is applied to the first to fifth coils 512*a* of the first magnetic field generation part 510*a* in order of the W phase, the U phase, the W phase, the U phase, the W phase, current is applied to the first to fifth coils 512*c* of the third magnetic field generation part 510*c* in order of the W phase, the U phase, the W phase, the U phase, the W phase, current is applied to the first to fifth coils 512*b* of the second magnetic field generation part in order of the W phase, the U phase, the W phase, the U phase, the W phase, and current is applied to the first to fifth coils 512*d* of the fourth magnetic field generation part in order of the W phase, the U phase, the W phase, the U phase, the W phase.

On the other hand, the magnetic fields are formed in the EMLS mode at each of the first and third magnetic field generation parts 510*a* and 510*c* disposed on one side of the nozzle 20 in the direction from the first short side 12*a* to the nozzle 20 and in the EMLA mode at each of the second and fourth magnetic field generation parts 510*b* and 510*d* disposed at the other side of the nozzle 20 in the direction from the nozzle 20 to the second short side 12*b*. For this, as illustrated in FIG. 33, current is applied to the first to fifth coils 512*a* of the first magnetic field generation part 510*a* in order of the U phase, the W phase, the U phase, the W phase, the U phase, current is applied to the first to fifth coils 512*c* of the third magnetic field generation part 510*c* in order of the U phase, the W phase, the U phase, the W phase, the U phase, current is applied to the first to fifth coils 512*c* of the second magnetic field generation part 510*b* in order of the W phase, the U phase, the W phase, the U phase, the W phase, and current is applied to the first to fifth coils 512*d* of the fourth magnetic field generation part 510*d* in order of the U phase, the W phase, the U phase, the W phase, the U phase.

The molten steel may rotatable. For this, the magnetic field movement directions are different from each other at the first and second magnetic field generation parts 510*a* and 510*b* disposed in both the sides with respect to the center of the nozzle 20, the magnetic field movement directions are different from each other at the magnetic fields flows to the third and fourth magnetic field generation parts 510*c* and 510*d*, the magnetic field movement directions are different from each other at the magnetic fields flows to the first and third magnetic field generation parts 510*a* and 510*c*, and the magnetic field movement directions are different from each other at the magnetic fields flows to the second and fourth magnetic field generation parts 510*b* and 510*d*. For example, when the EMLS mode, the EMLA mode, the EMLA mode, and the EMLS mode are applied to the first, second, third, and fourth magnetic field generation parts 510*a*, 510*b*, 510*c*, and 510*d*, respectively, the magnetic fields rotates to allow the molten steel to flow (F5) as illustrated in FIG. 34.

The magnetic field applying method of the first to fourth magnetic field generation parts 510*a*, 510*b*, 510*c*, and 510*d* and the deceleration, the acceleration, and the rotation state of the molten steel according to the applying method, which are described with reference to FIGS. 31 to 34 are equally applied to the first to fourth magnetic field generation parts 510*a*, 510*b*, 510*c*, and 510*d* of the meniscus flow control device, which are described with reference to FIG. 1 according to the first embodiment to control the molten steel.

The first and second flow pattern types are the normal flow patterns. When the detected meniscus flow type is one of the first and second flow pattern types, the flow conditions at the present state, i.e., the current applying method or the magnetic field movement mode are maintained at the first to fourth magnetic field generation parts 510*a*, 510*b*, 510*c*, and 510*d*.

To adjust the abnormal pattern such as the third to tenth flow pattern types to one normal pattern of the first and second flow pattern types, the movement of the magnetic fields has to be changed in direction, accelerated, decelerated, or rotated. Also, the control of the movement direction, acceleration, deceleration, or rotation of the magnetic fields is differently adjusted according to the third to tenth flow pattern types.

When the magnetic fields move from the center of the meniscus, i.e., the nozzle in a direction of both ends of the meniscus, i.e., a direction of the short sides, the magnetic fields move in the same direction as the flow of the molten steel discharged from both the discharge holes to cause the acceleration. On the other hand, when the magnetic fields move from the short sides 12*a* and 12*b* to the nozzle 20, the magnetic fields move in a direction opposite to that in which the flow of the molten steel discharged from the nozzle to cause the deceleration. Also, when the magnetic fields rotate with respect to the center of the meniscus, i.e., the center of the nozzle 20, rotation force occurs on the meniscus. The above-described movement direction and the rotation movement of the magnetic fields are adjusted according to the phase change of the current applied to the first to fourth magnetic field generation parts 510*a*, 510*b*, 510*c*, and 510*d*, and the deceleration, acceleration, and rotation of the magnetic fields are changed according to the density of the magnetic fields due to the intensity of the applied current density.

Hereinafter, when the detected meniscus flow form is classified into one of the abnormal flow pattern types, a method for switching the detected meniscus flow form to one normal flow pattern of the first and second flow pattern types will be described in detail.

The third and fourth flow pattern types are bias flow pattern types, which occur by blocking both the discharge holes of the nozzle 20. That is, the third and fourth flow pattern types are patterns in which the bias flow occurs from one of one side and the other side to the center of the nozzle 20. Here, the third flow pattern type corresponds to a case in which a relative strong bias flow occurs when compared to the fourth flow pattern, and the fourth flow pattern type corresponds to a case in which a relative weak bias flow occurs when compared to the third flow pattern type.

When the detected meniscus flow pattern is classified into the third and fourth flow pattern types, the magnetic fields are formed to reduce (decelerate) the flow of the molten steel in all both directions. That is, like the second flow type of FIG. 29, the magnetic fields are formed in the EMLS mode at the first and third magnetic field generation parts 510*a* and 510*c* so that the molten steel moves from the first short side 12*a* in the direction of the nozzle 20, and the magnetic fields are formed in the EMLS mode at the second and fourth magnetic field generation parts 510*c* and 510*d* so that the molten steel moves from the second short side 12*b* in the direction of the nozzle 20. Here, as described above, in the third and fourth flow pattern types, the first and second temperature deviations $\Delta T_{E1-C}$ and $\Delta T_{E2-C}$ are greater than the third reference value. Here, the first and second temperature deviations $\Delta T_{E1-C}$ and $\Delta T_{E2-C}$ are different from each other. That is, the second temperature deviation $\Delta T_{E2-C}$ is greater than the first temperature deviation $\Delta T_{E1-C}$, or the first temperature deviation $\Delta T_{E1-C}$ is greater than the second temperature deviation $\Delta T_{E2-C}$. Thus, the higher current density is generated at the magnetic field generation part having the larger temperature deviation to relatively increase the deceleration. For example, when the second temperature deviation $\Delta T_{E2-C}$ is greater than the first temperature deviation $\Delta T_{E1-C}$, the current density applied to the second and fourth magnetic field generation parts 510*b* and 510*d* is greater than that applied to the first and third magnetic field generation parts 510*a* and 510*c*.

For another example, when the detected flow pattern shape is classified into the eighth flow pattern type, like the fifth flow control type, the magnetic fields are formed so that the flow of the molten steel is reduced (decelerated) in all both directions of the nozzle. Here, since the first temperature deviation $\Delta T_{E1-C}$ and the second temperature deviation $\Delta T_{E2-C}$ are the same or similar to each other within the ±error range, the deceleration at both sides are the same or similar to each other. That is, the magnetic fields are applied in the EMLS mode to each of the first and third magnetic field generation parts 510*a* and 510*c*, and the magnetic fields are applied in the EMLS mode to each of the second and fourth magnetic field generation parts 510*b* and 510*d*. Thus, the current density applied to each of the first and third magnetic field generation parts 510*a* and 510*c* and the current applied to each of the second and fourth magnetic field generation parts 510*b* and 510*d* are the same or similar to each other.

Also, the detected flow pattern shape causes flows different from each other at one side and the other side of the nozzle 20. Since one edge temperature (one of $T_{E1}$ and $T_{E2}$) is less than the center temperature $T_c$, the other edge temperature (one of the $T_{E1}$ and $T_{E2}$) is greater than the center temperature $T_c$, if being classified into the fifth and sixth flow pattern types, like the third flow control type of FIG. 29, the molten steel flow speed is accelerated in an area in which the edge temperature is less then the center temperature, whereas the molten steel flow speed is decelerated in an area in which the edge temperature (one of $T_{E1}$ and $T_{E2}$) is greater then the center temperature. For example, when the first edge temperature $T_{E1}$ is less than the center temperature $T_c$, and the second edge temperature $T_{E2}$ is greater than the center temperature, the magnetic fields are formed in the EMLA mode in the first and third magnetic field generation parts 510*a* and 510*c* disposed at one side (i.e., a left side) of the nozzle 20 and formed in the EMLS mode in the second and fourth magnetic field generation parts 510*b* and 510*d* disposed at the other side (i.e., a right side) of the nozzle 20. Thus, the molten steel moves from the nozzle 20 in the direction of the first short side 12*a* and moves from the second short side 12*b* in the direction of the nozzle to accelerate the molten steel flow speed at one side (i.e., the left side) of the nozzle 20 and decelerate at the other side (i.e., the right side) of the nozzle 20.

Here, in the fifth and sixth flow pattern types, the first and second temperature deviations $\Delta T_{E1-C}$ and $\Delta T_{E2-C}$ are greater than the third reference value $T_3$, and the relatively large temperature deviation of the first and second temperature deviations $\Delta T_{E1-C}$ and $\Delta T_{E2-C}$ of the fifth flow pattern type is greater than the relatively large temperature deviation of the first and second temperature deviations $\Delta T_{E1-C}$ and $\Delta T_{E2-C}$ of the sixth flow pattern type. For example, the second temperature deviation of the first and second temperature deviations $\Delta T_{E1-C}$ and $\Delta T_{E2-C}$ of the fifth flow pattern type is large, and the second temperature deviation of the first and second temperature deviations $\Delta T_{E1-C}$ and $\Delta T_{E2-C}$ of the sixth flow pattern type is large. Here, the second temperature deviation $\Delta T_{E2-C}$ of the fifth flow pattern type is to greater than the second temperature deviation $\Delta T_{E2-C}$ of the sixth flow pattern type. Thus, when the detected flow pattern shape is classified into the fifth flow pattern type, if the flow pattern shape, in which the current density applied to the second and fourth magnetic field generation parts 510*b* to 510*d* is detected, classified into the sixth flow pattern type, the current density is greater than that applied to the second and fourth magnetic field generation parts 510*b* and 510*d*. Thus, when the detected flow pattern shape is classified into the fifth flow pattern type, the molten steel moves from the second short side 12*b* in the direction of the nozzle 20 to cause the deceleration by which the flow speed decreases. When the detected flow pattern shape is classified into the sixth flow pattern type, the molten steel moves from the second short side 12*b* in the direction of the nozzle 20 to cause the deceleration by which the flow speed increases.

Also, when the detected flow pattern shape is classified into the seventh flow pattern type, like the fourth flow control type of FIG. 29, the molten steel is accelerated in all both the directions of the nozzle 20. In the seventh flow pattern type, since the first and second temperature deviations $\Delta T_{E1-C}$ and $\Delta T_{E2-C}$ are the same or similar to each other within the ±error range, the acceleration at both the sides of the nozzle 20 are the same or similar to each other. That is, the magnetic fields are applied in the EMLA mode to each of the first and third magnetic field generation parts 510*a* and 510*c*, and the magnetic fields are applied in the EMLA mode to each of the second and fourth magnetic field generation parts 510*b* and 510*d*. Thus, the current density applied to each of the first and third magnetic field generation parts 510*a* and 510*c* and the current applied to each of the second and fourth magnetic field generation parts 510*b* and 510*d* are the same or similar to each other.

Also, when the detected flow pattern shape is classified into the ninth flow pattern type, like the sixth flow control type of FIG. 29, the molten steel rotates like the sixth control type to activate the meniscus. For example, when the EMLS mode, the EMLA mode, the EMLA mode, and the EMLS mode are applied to the first, second, third, and fourth magnetic field generation parts 510*a*, 510*b*, 510*c*, and 510*d*, respectively, the magnetic fields rotates to allow the molten steel to flow as illustrated in FIG. 34.

Also, when the detected flow pattern shape is classified into the tenth flow pattern type, the magnetic fields are formed in the EMLA mode at both sides from the nozzle 20 to accelerate the flow speed of the molten steel in both the directions. Here, the acceleration at the relatively large value of the first and second temperature deviations $\Delta T_{E1-C}$ and $\Delta T_{E2-C}$ is relatively large.

Hereinafter, a meniscus flow control method according to the second embodiment of the present invention will be described with reference to FIGS. 16 to 37.

Referring to FIG. 35, a meniscus flow control method according to the second embodiment of the present invention includes a process (S100) of detecting a flow state of a molten steel meniscus charged into a mold in rear-time, a process (S200) of classifying or determining the detected meniscus flow form according to one type of a plurality of flow pattern types that are previously set or stored, a process (S300) of determining whether the classified flow pattern type is a normal flow pattern or an abnormal flow pattern, and a process (S400) of detecting a meniscus flow form again in real-time while maintaining the present flow pattern when the classified flow pattern type is the normal flow pattern and adjusting the meniscus flow in a different method according to the classified flow pattern type when the classified flow pattern type is the abnormal flow pattern to adjust the meniscus flow to the normal flow form.

In an embodiment of the present invention, a temperature in a direction of long sides 11*a* and 11*b* of a mold 10 is measured to detect the flow form of the molten steel meniscus through the temperature difference. As illustrated in FIG. 36, the flow form detection process (S100) according to an embodiment includes a process (S110) of measuring a temperature through a plurality of temperature measurers 100 installed to be spaced apart from each other and arranged in a width direction of the mold 10, a process (S120) of relatively comparing the temperature values for each positions, which are measured by the plurality of temperature measurers 100 to each other to detect the meniscus flow pattern, and a process (S130) of visualizing or displaying the detected meniscus flow pattern on a display unit 600.

A process and method for detecting the meniscus flow form will be described below in more detail. The temperature is measured through the plurality of temperature measurers 100 respectively installed at a pair of long sides 11*a* and 11*b* and the pair of short sides 12*a* and 12*b*. The temperature values measured through the plurality of temperature measurers 100 vary according to the flow state of the meniscus at measured time points. That is, the temperature values vary according to the flow state of the molten steel within the mold 10. The temperature value measured at a position at which the height of the meniscus is relatively high is greater than that measured at different positions. This is done because the more a distance between the height of the molten steel meniscus and the temperature measurer 100 decreases, the more the temperature measured by the temperature measurer 100 increases, whereas the distance increases, the temperature decreases.

When the temperatures are measured through the plurality of temperature measurers 100, the temperature values for respective positions in the width direction of the meniscus are relatively represented in the meniscus flow detection unit 200 to convert the temperature values into relative heights for respective positions of the molten steel meniscus, thereby detecting the meniscus flow form. Also, when the temperature values according to the position are expressed as a graph, the temperature values are two-dimensionally visualized as illustrated in FIG. 21 or three-dimensionally visualized as illustrated in FIG. 22 and then displayed on the display unit 600.

When the meniscus flow form is detected at the present casting state, the detected meniscus flow form is classified into one of the plurality of flow pattern types, which are previously set or stored, in the flow pattern classification unit 300. That is, the detected meniscus flow pattern is classified into one of first to tenth types of FIG. 24 according to a meniscus temperature deviation ΔTE1-L, first and second edge temperatures $T_{E1}$ and $T_{E2}$, a center temperature $T_c$, and first and second temperature deviations $\Delta T_{E1-C}$ and $\Delta T_{E2-C}$.

Referring to FIG. 37, the process (S200) of classifying or determining the detected meniscus flow form to one type of a plurality of flow pattern types that are previously set or stored includes a process (S121) of making data including the temperature values of the various meniscus flow patterns to store or previously set the temperature data according to the flow pattern types in the flow pattern type storage part 410, a process (S122) of analyzing the temperature data including the detected meniscus flow form, and a process (S123) of selecting and classifying flow pattern type corresponding to the temperature data including the detected meniscus flow form of the plurality of flow pattern types.

The process of classifying or determining the detected meniscus flow form into one type of the plurality of flow pattern types that are previously set or stored will be described below in more detail. Here, the plurality of temperature values measured by the plurality of temperature measurers 100 in the direction of the first long sides 11*a* are analyzed, and then the meniscus temperature deviation $\Delta T_{H-L}$ and the plurality of temperature values measured by the plurality of temperature measurers 100 in the direction of the first long sides 11*a* are analyzed. Then, when the meniscus temperature deviation $\Delta T_{H-L}$ is compared, the flow pattern types are classified by using the temperature data at the long sides having the relatively large temperature deviation $\Delta T_{H-L}$ of the large meniscus temperature deviation $\Delta T_{H-L}$ measured along the first long sides and the large meniscus temperature deviation $\Delta T_{H-L}$ measured along the second long sides.

Thereafter, when the classified meniscus flow form is one of the first and second flow pattern types that are the normal flow patterns, the flow control unit 400 maintains the present flow state. That is, like the first flow control type of FIG. 29, the flow control unit maintains a state in which the magnetic fields move from each of the first and second short sides to the nozzle. Also, the same current is applied to the first and third magnetic field generation part 510*a* and 510*c* disposed on one side with respect to a center of the nozzle and the second and fourth magnetic field generation parts 510*b* and 510*d* disposed at the other side to maintain the same intensity of the magnetic fields.

On the other hand, when the classified meniscus flow form is one of the third to tenth flow pattern types that are abnormal flow patterns, the flow control unit 400 controls the meniscus flow form through one of the second to seventh flow control types to provide the normal flow pattern.

For example, when the discharge hole of the nozzle 20 is blocked to generate a bias flow like the third flow pattern type while the meniscus is maintained in the normal flow pattern like the first flow pattern type, a strong bias flow is generated in the other side of the one side and the other side with respect to the center of the nozzle 20, and a weak flow is generated at the one side. Here, the magnetic fields having the EMLS mode are formed at each of the first and third magnetic field generation parts 510*a* and 510*c* and the second and fourth magnetic field generation parts 510*b* and 510*d* like the second flow control type of FIG. 29. Here, the current applied to the second and fourth magnetic field generation parts 510*b* and 510*d* disposed at the right side of the nozzle 20, which correspond to the other side of the nozzle, at which the relatively strong bias flow is generated, increase to further increase the deceleration force when compared before being adjusted, thereby reducing the strong flow, and also, the current applied to the first and third magnetic field generation parts 510*a* and 510*c* disposed at corresponding positions of the left side of the nozzle 20 decreases to reduce the deceleration force when compared before being adjusted, thereby increasing the flow.

For another example, when an amount of Ar in the nozzle 20 increases, or external air is inserted and mixed while being maintained in the normal flow pattern like the first flow pattern type, the molten steel flow ascending to the nozzle 20 increases to allow the meniscus flow pattern to become the seventh flow pattern type. When the detected flow pattern shape is classified into the seventh flow pattern type, the magnetic fields having the EMLA mode are formed at both the directions of the nozzle 20 like the fourth flow control pattern to accelerate the flow speed of the molten steel. That is, the magnetic fields move from the first and third magnetic field generation parts 510*a* and 510*c* to the nozzle 20 in the direction of the first short sides 12*a* to accelerate the molten steel and move from the second and fourth magnetic field generation parts 510*b* and 510*d* in the direction of the second short sides 12*b* to accelerate the molten steel.

For another example, when wearing of the nozzle 20 increases to increase a size of the discharge hole and decrease the flow intensity while being maintained in the normal flow pattern like the first flow pattern type, the detected or classified flow pattern becomes the ninth flow pattern type. Here, the electromagnetic rotation force is applied so that the molten steel meniscus rotates with respect to the nozzle 20 to activate the flow of the meniscus. That is, the magnetic field movement directions are different from each other at the first and second magnetic field generation parts 510*a* and 510*b* disposed in both the sides with respect to the center of the nozzle 20, the magnetic field movement directions are different from each other at the magnetic fields flows to the third and fourth magnetic field generation parts 510*c* and 510*d*, the magnetic field movement directions are different from each other at the magnetic fields flows to the first and third magnetic field generation parts 510*a* and 510*c*, and the magnetic field movement directions are different from each other at the magnetic fields flows to the second and fourth magnetic field generation parts 510*b* and 510*d*, thereby rotating the molten steel.

According to the second embodiment of the present invention, the plurality of temperature measurers 100 may be installed on the mold 10 to detect the temperature for each position in the width direction of the meniscus and relatively compare the temperatures to convert the temperature into the relative height, thereby determining the flow state of the meniscus. Also, the detected meniscus flow form may be classified to one of the plurality of previously stored flow pattern types, and the magnetic fields within the mold may be controlled according to the classified flow pattern type to control the flow of the molten steel that is operating to a normal flow pattern in which the possibility of the occurrence of the defects of the slab is less or absent. Thus, the molten steel meniscus may be visualized in real-time, and when it is determined to be the abnormal flow pattern, the flow of the molten steel may be controlled in real-time to prevent the defects due to the flow from occurring and improve the quality of the slab.

In the meniscus flow control devices according to the first and second embodiment, the plurality of temperature measurers 100 are disposed at the same interval. However, the spaced distance between the plurality of temperature measurers 100 is not limited to the same interval. For example, the spaced distance between the plurality of temperature measurers 100 may vary according to areas in the extension direction of the long sides 11*a* and 11*b* of the mold. That is, the distances between the plurality of temperature measurers 100 on an area (central portion) disposed directly below the nozzle 20 is greater than that between the plurality of temperature measurers 100 on an area except for the central portion. This is done for a reason for visualizing the meniscus flow form regardless of the width of the slab.

Hereinafter, a meniscus flow control device according to a modified example of the first and second embodiments of the present invention will be described with reference to FIGS. 38 to 45. Here, the contents duplicated according to the first and second embodiments will be omitted or simply described.

Figure 38:
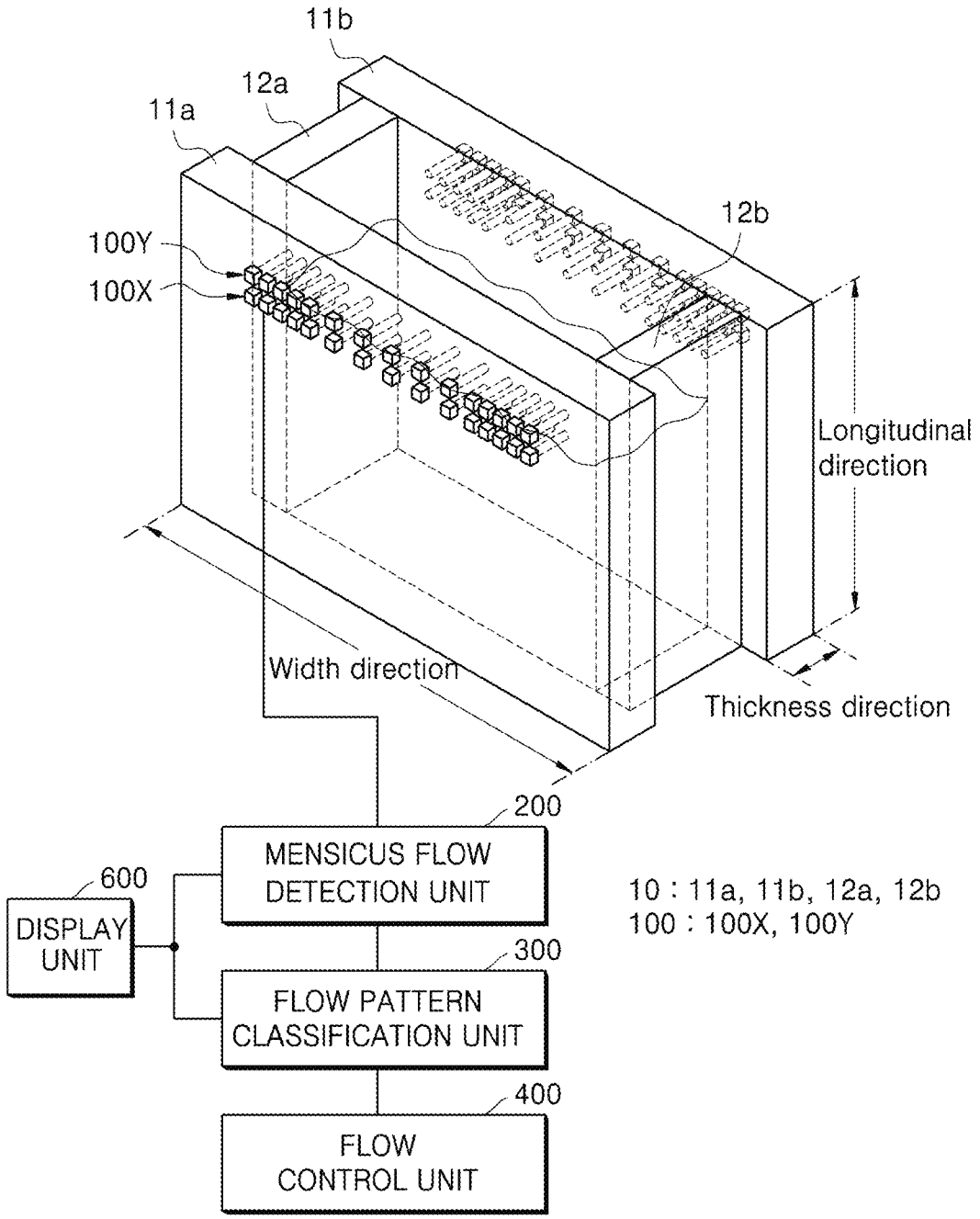
FIG. 38 is a perspective view of a mold in which a meniscus visualizing device is installed according to a modified example of an embodiment.
Figure 39:
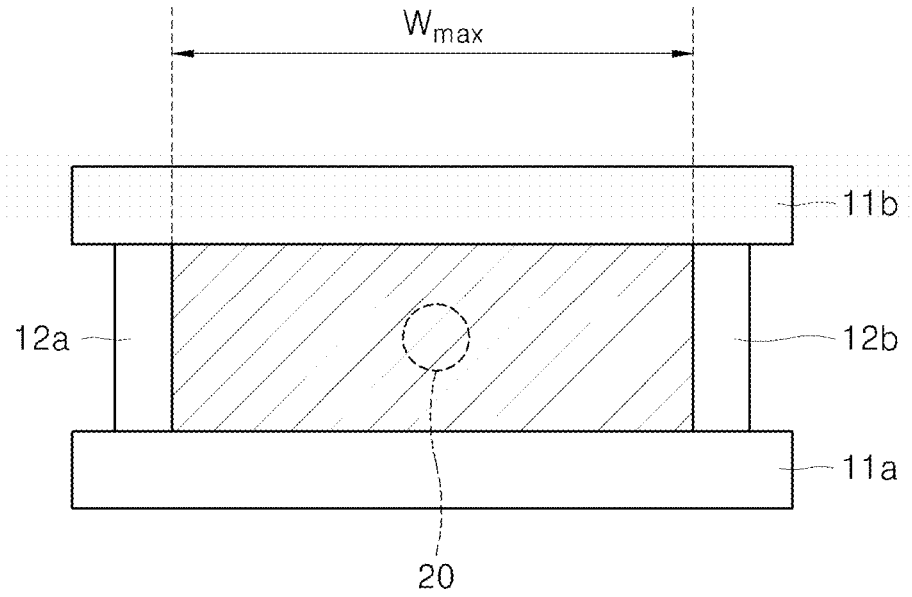
FIGS. 39 and 40 are views for explaining a fixed width area and a variable width area defined by the mold.
Figure 40:
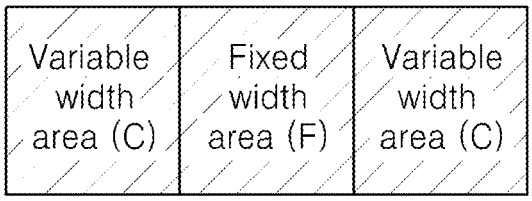
Figure 41:
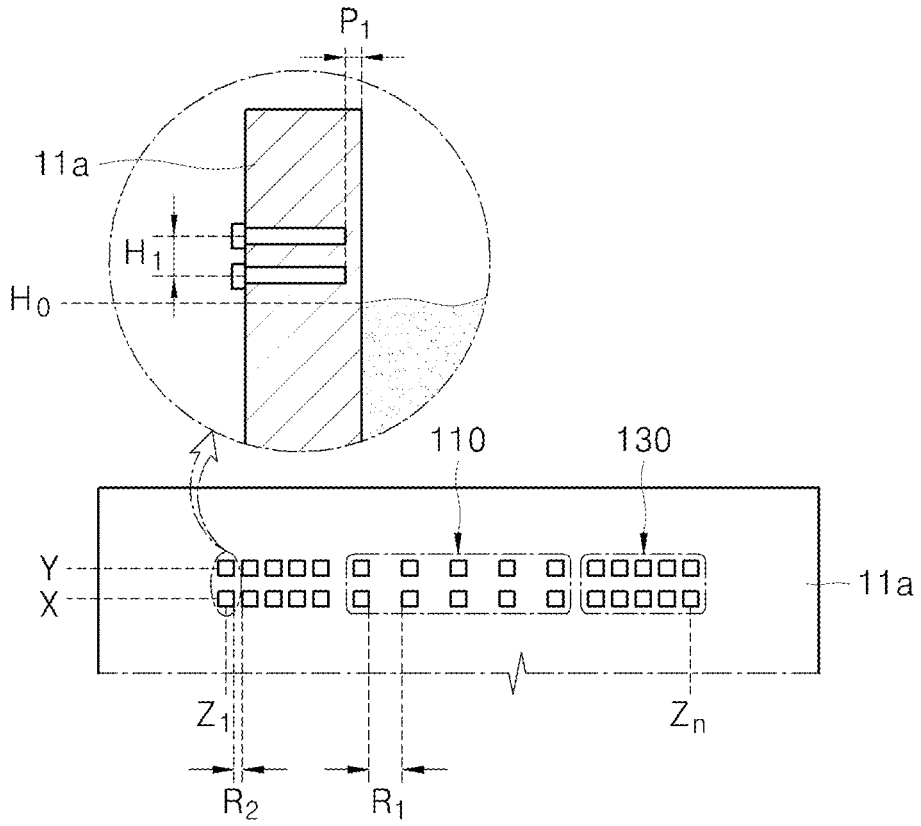
FIG. 41 is a front view for explaining an arrangement of the temperature measurers illustrated in FIG. 38.

FIG. 38 is a perspective view of a mold in which a meniscus visualizing device is installed according to a modified example of an embodiment, FIGS. 39 and 40 are views for explaining a fixed width area and a variable width area defined by the mold, FIG. 41 is a front view for explaining an arrangement of the temperature measurers illustrated in FIG. 38, and FIGS. 42 to 44 are views for explaining an arrangement of the temperature measurers according to a modified example of the present invention. Also, FIG. 45 is a plan view for explaining the arrangement of the temperature measures illustrated in FIG. 38.

Referring to FIGS. 38 to 41, a meniscus flow control device according to the second embodiment of the present invention includes a plurality of temperature measurers 100 in which a spaced distance between a plurality of first temperature measurers 110 disposed on a fixed width area F of a mold 10 is greater than that between second temperature measurers 130 disposed on a variable width area C disposed outside the fixed width area F, a meniscus flow detection unit 200 detecting a flow of a molten steel meniscus by using the temperatures measured by the plurality of first temperature measurers 110 and the plurality of second temperature measurers 130, a magnetic field generation unit 500 (see FIGS. 1 and 16) installed outside the mold 10 to generate magnetic fields for allowing the molten steel within the mold 10, and a flow control unit 400 controlling the operation of magnetic field generation unit 500 according to the meniscus state detected in the meniscus flow detection unit 200 to adjust a flow of the meniscus so that the molten steel meniscus has a normal flow pattern shape.

Also, according to the second embodiment, the meniscus flow control device further include a flow pattern classification unit 300 for classifying the detected meniscus flow form into one flow pattern type of the plurality of flow pattern types that are previously stored or previously set. The flow control unit 400 may control an operation of the magnetic field generation unit 500 according to the classified flow pattern type to adjust the meniscus flow so that the molten steel meniscus has the normal flow pattern shape.

Here, although the magnetic field generation unit 500 constituted by a plurality of magnetic field generation parts 510*a*, 510*b*, 510*c*, and 510*d* is not illustrated in FIG. 38 so as to illustrate the first and second temperature measurers, the magnetic field generation unit 500 according to the first and second embodiments may be equally applied to the meniscus flow control device according to the modified example.

Thereafter, a width direction of the long sides 11*a* and 11*b* represents a horizontal direction or a width direction of a slab, and a longitudinal direction of the long sides 11*a* and 11*b* represents a vertical direction or a drawing direction of the slab. Also, a thickness direction of the long sides 11*a* and

11*b* represents a direction from an outer surface that is exposed outside to an inner surface coming into contact with the molten steel, i.e., a direction from the outside to the inside.

A fixed width area F of the mold 10 is a fixed area, of which a width is not changed, of a casting width defined by the mold 10. In detail, the fixed width area F includes an area (a central portion) disposed directly below the nozzle 20 with respect to a maximum width $W_{max}$ of the casting width. When the maximum width $W_{max}$ is 100, the fixed width area F represents an area having a width of about 10 to about 15 from a center of the maximum width to both ends. Also, a variable width area C of the mold 10 is a variable area, of which a width varies, of the casting width defined by the mold 10. In detail, the variable width area C does not include the area (the central portion) disposed directly below the nozzle 20 with respect to a maximum width $W_{max}$ of the casting width. The variable width area C represents a remaining area except for the fixed width area F. As described, the casting width is divided into the fixed width area F and the variable width area C. The casting width is determined according to a size of the variable width area C. Here, to easily measure the temperature of the molten steel to match the casting width that varies by the variable width area C, a temperature measurer arrangement according to an embodiment of the present invention is provided.

The plurality of temperature measurers 100 may be disposed to form a plurality of columns X and Y and a plurality of rows Z1 to Zn on one surface of the long sides 11*a* and 11*b*. Here, the plurality of columns X and Y are formed in the width direction of the long sides 11*a* and 11*b*, and the plurality of rows Z1 to Zn are formed in the longitudinal direction of the long sides 11*a* and 11*b*. The temperature measurers 100 are disposed in a line along the rows Z1 and Zn formed in the longitudinal direction of the long sides 11*a* and 11*b*. Here, the plurality of temperature measurers 100 may be divided into a first temperature measurer 110 disposed on the fixed width area F of the mold 10 and a second temperature measurer 130 disposed on the variable width area C of the mold regardless of the columns X and Y and the rows Z1 to Zn. Thus, a plurality of temperature values may be measured at specific positions in the width direction of the long sides 11*a* and 11*b*.

Hereinafter, the column of the temperature measurer 100*x* disposed at a height adjacent to the meniscus of the molten steel is referred to as a first column X, and the column of the temperature measurer 100*y* disposed above the temperature measurer 100*x* is referred to as a second column Y. Here, although the temperature measurers are arranged with two rows, the temperature measurers may be arranged with two rows or more.

The temperature measurers 100*x* defining the first row X may be disposed on an outer surface of each of the long sides 11*a* and 11*b*, for example, at the same height on a front surface. For example, the first row X may be disposed at the same height in a range of 50 mm upward to 50 mm downward from a meniscus H0. The more the temperature measurers 100*x* are adjacent to the meniscus of the molten steel, the more the temperature measurement results are accurate. Thus, it is preferable that the temperature measurers are disposed in the range of 5 mm upward to 5 mm downward from the meniscus of the molten steel within the above-described range. Also, the temperature measurers defining the first row X may be disposed at positions spaced a distance of 35 mm from the inner surface of each of the long sides 11*a* and 11*b* coming into contact with the molten steel. More preferably, the temperature measurers defining the first row X may be disposed at positions spaced a distance of 12 mm from the inner surface of each of the long sides 11*a* and 11*b* coming into contact with the molten steel. That is, to more accurately measure the temperature, the temperature measurers defining the first row X may be disposed adjacent to the molten steel.

The second row Y may be spaced a predetermined distance H1 upward from the first row X, for example, spaced a distance of 5 to 15 mm from the first row X. Also, the temperature measurers 100*y* defining the second row Y may be disposed at the same height from the front surface of each of the long sides 11*a* and 11*b*. For example, the first row X may be disposed at the same height within a range of 50 mm upward to 50 mm downward from the meniscus.

The plurality of temperature measurers 100 defining the first row X and the second row Y may be disposed in a range H1 of 59 mm upward to 50 mm downward from the meniscus H0 of the molten steel. Also, the plurality of temperature measurers 100 defining the first row X and the second row Y may be disposed to be spaced a predetermined distance P1, for example, 60 mm to 70 mm from the inner surface of each of the long sides 11*a* and 11*b* coming into contact with the molten steel. This is done because the accuracy of the measurement results is deteriorated as the temperature measurers 100 are away from the molten steel.

A spaced distance R1 (hereinafter, referred to as a first spaced distance) between the first temperature measurers 110 disposed on the fixed width area F is greater than that R2 (hereinafter, referred to as a second spaced distance) between the second temperature measurers 130 disposed on the variable width area C. That is, as illustrated in FIG. 41, the first temperature measurers 110 are disposed to be spaced the first spaced distance R1 from each other, and the second temperature measurers 130 are disposed to be spaced the second spaced distance R2, which is less than the first spaced distance R1, from each other. It is seen that the second temperature measurers 130 are denser than the first temperature measurers 110 on the mold 10.

Here, each of the first spaced distance R1 and the second spaced distance R2 may be a fixed value. Since the second temperature measurers 130 are disposed to be spaced the second spaced distance R2, which is less than the first spaced distance R1, from each other, when the short sides 12*a* and 12*b* move to change the casting width, the temperature of the molten steel may be more accurately measured regardless of the width to be adjusted.

Here, the first spaced distance R1 between the first temperature measurers 110 adjacent to each other and disposed on the fixed width area F may have a value of 55 to 300 mm. When the first spaced distance R1 exceeds a value of 300 mm, it is difficult to accurately measure the temperature of the molten steel on the fixed width area F. When less than a value of 55 mm, although the temperature is accurately measured, installation costs may increase. That is, the first temperature measurers 110 measure the temperature of the molten steel on the fixed width area F in which the casting width is not changed. Thus, the first temperature measurers 110 are units for measuring the temperature of the molten steel with the mold 10 always therebetween, the first temperature measurers 110 may be spaced a distance of 55 to 300 mm from each other.

Also, the first spaced distance R2 between the second temperature measurers 130 adjacent to each other and disposed on the variable width area C may have a value of 10 to 50 mm. When the second spaced distance R2 exceeds a value of 50 mm, it is difficult to easily change the casting width, and thus, it is difficult to easily and accurately measure the temperature of the molten steel on the variable width area C. That is, when a distance between the second temperature measurers 130 adjacent to each other exceeds 50 mm, if the short sides 12*a* and 12*b* are disposed between the second temperature measurers 130 to define the casting width, it is impossible to measure the temperature on an area from the second temperature measurers 130 to the short sides 12*a* and 12*b*. Thus, the temperature of the molten steel is not accurately measured. Also, the second spaced distance R2 has a value of 10 to 20 mm. Since the second temperature measurers 130 are disposed to be spaced the second spaced distance R2 from each other to more accurately measure the temperature of the molten steel.

As described above, numerical limitation of a distance between the first row X and the second row Y and a depth of the temperature measurer in each row is for more accurately visualizing the meniscus of the molten steel by accurately measuring the temperature of the molten steel.

Figure 42:
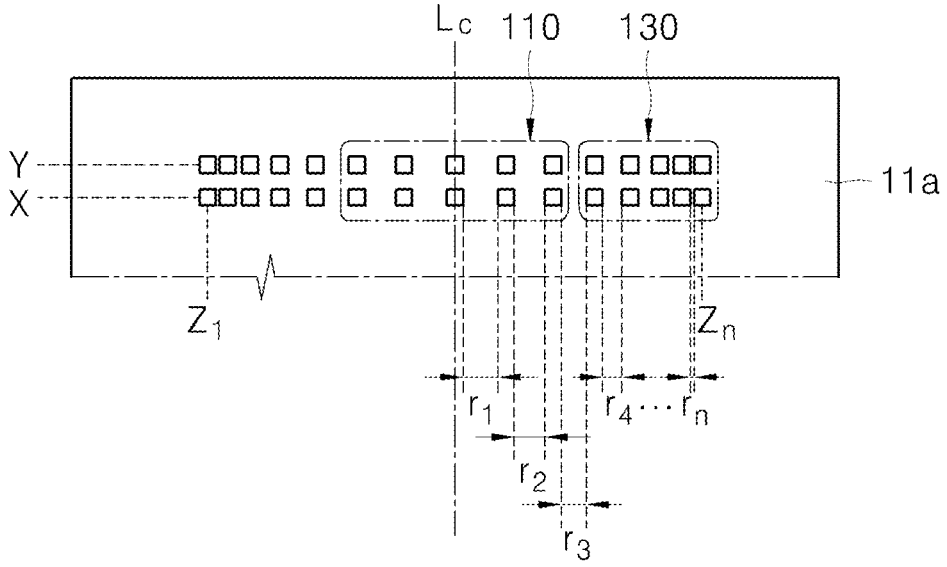
FIGS. 42 to 44 are views for explaining an arrangement of the temperature measurers according to a modified example of the present invention.
Figure 43:
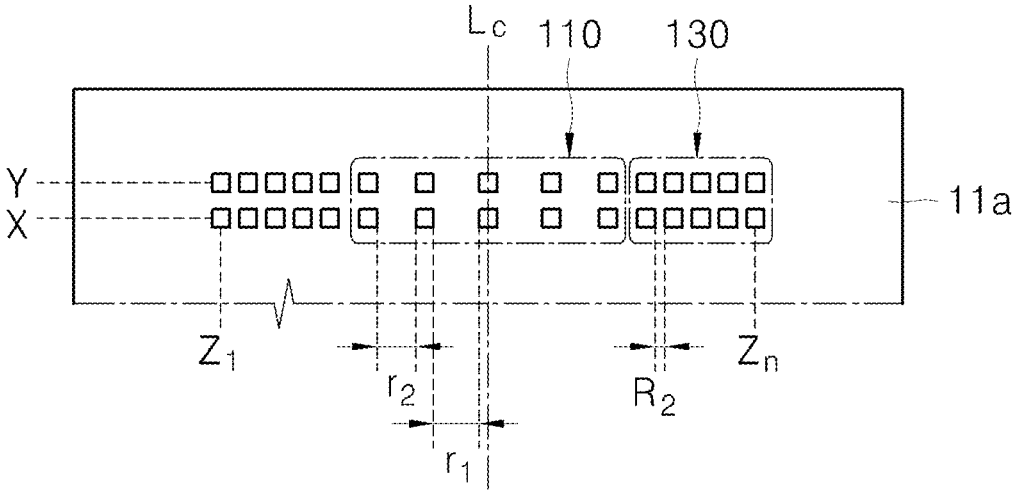
Figure 44:
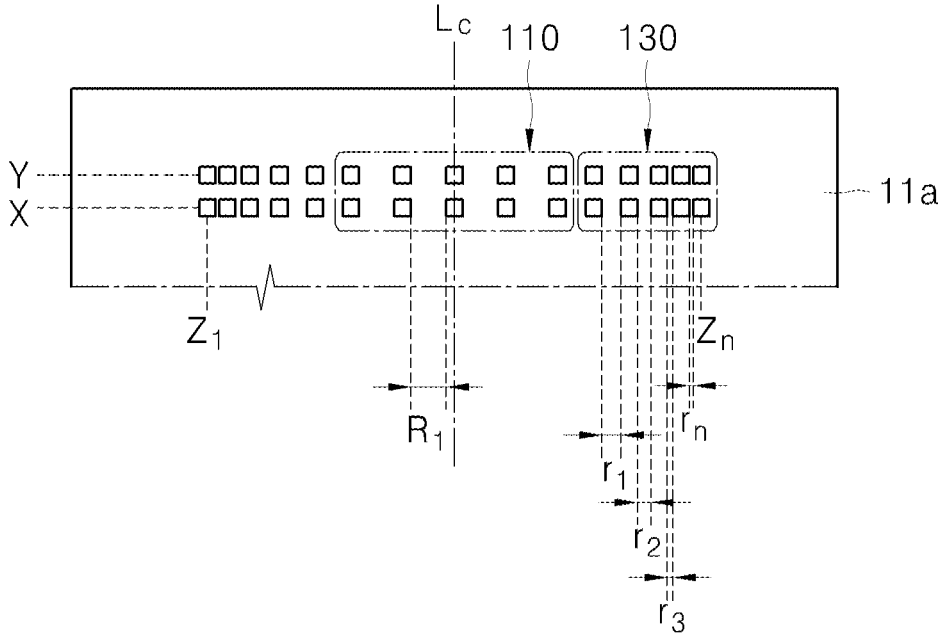
Figure 45:
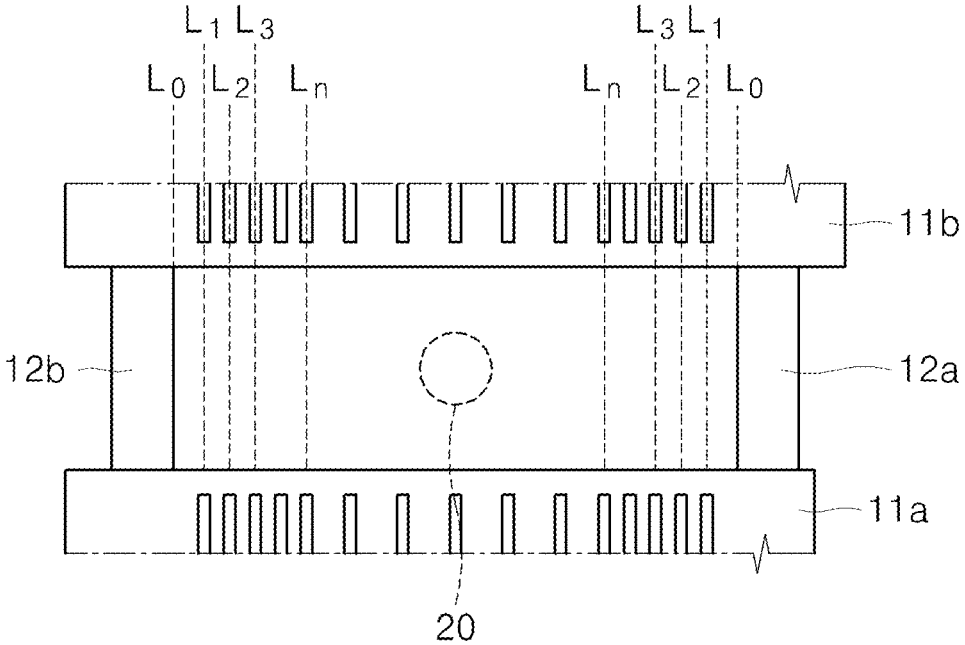
FIG. 45 is a plan view for explaining the arrangement of the temperature measurers illustrated in FIG. 38.

As illustrated in FIGS. 42 to 44, the plurality of temperature measurers 100 may be disposed to be gradually reduced in spaced distance between the temperature measurers 100 outward from the center in the width direction of the long side 11*a* and 11*b*. That is, referring to FIG. 42, each of the spaced distances between the temperature measurers 100 may be gradually reduced outward from a central line Lc in the width direction of the long side 11*a* and 11*b* in order of r1, r2, r3, r4, and m. This means that the spaced distance values on the fixed width area F and the variable width area C are not fixed. As described above, when the plurality of temperature measurers 100 are provided, the plurality of temperature measurers 100 are densely disposed outward from the central portion that is disposed directly below the nozzle 20. Thus, the temperature at an outer portion outward from the central portion on the casting width may be accurately measured.

Also, the plurality of temperature measurers 100 may be disposed to be gradually reduced in spaced distance between the first temperature measurers 110 outward from the center in the width direction of the long side 11*a* and 11*b* on the fixed width area F. That is, referring to FIG. 43, the spaced distances between the first temperature measurers 110 on the fixed width area F are reduced in order of r1 and r2, and the second temperature measurers 130 on the variable width area C may be disposed at the same spaced distance as that between the second temperature measurers in the above-described embodiment. As described above, since the spaced distances between the first temperature measurers 110 on the fixed width area F are gradually reduced outward from the central portion, an error in temperature measurement value of the molten steel on the fixed width area F may be reduced.

Also, the plurality of temperature measurers 100 may be disposed to be gradually reduced in spaced distance between the second temperature measurers 130 outward from the center in the width direction of the long side 11*a* and 11*b* on the variable width area C. That is, referring to FIG. 44, the spaced distances between the second temperature measurers 130 on the variable width area C are reduced in order of r1, r2, r3, and m, and the first temperature measurers 110 on the fixed width area F may be disposed at the same spaced distance as that between the first temperature measurers 110 in the above-described embodiment. As described above, since the spaced distances between the second temperature measurers 130 on the variable width area C are gradually reduced outward from the central portion, the temperature of the molten steel may be easily measured and more accurately measured regardless of the casting width.

The temperature of the molten steel within the mold 10 may be accurately measured regardless of the width values of the casting width defined by the mold 10 through the arrangement of the plurality of temperature measurers 100 according to the foregoing modified example. That is, as illustrated in FIG. 45, although the short sides 12*a* and 12*b* coming into contact with the molten steel are inserted up to the distances $L_0$, L1, L2, L3, and Ln due to the movement of the short sides 12*a* and 12*b* to change the casting width, since the temperature measurers 130 for measuring the temperature of the molten steel on the variable width area C in which the casting width varies are disposed denser than the temperature measurers 110 disposed on the fixed width area F, the temperature of the molten steel may be accurately measured. Also, the temperature measurers 130 for measuring the temperature of the molten steel on the variable width area C may measure the temperature of the molten steel regardless of the casting width to significantly reduce the error in measured temperature of the molten steel.

When the plurality of temperature measurers are installed on the mold through the above-described arrangement, the temperature of the molten steel may be measured at each position, and the meniscus of the molten steel may be visualized.

Hereinafter, a meniscus flow detection or meniscus flow visualization method due to the arrangement of the plurality of temperature measurers 100 according to the modified example will be described.

First, the plurality of rows and the plurality of columns are arranged along the width direction of the mold, and the temperature of the molten steel is measured by using the plurality of temperature measurers 100, which are disposed to be reduced in spaced distance on the variable width area C rather than the fixed width area F with respect to the casting width. Here, since the plurality of temperature measurers are arranged in a row in the width direction of the mold, the temperature of the molten steel may be measured in the width direction of the mold. In addition, since the plurality of temperature measurers are arranged in a column in the longitudinal direction of the mold, the temperature of the molten steel may be measured in the longitudinal direction of the mold.

When the temperature of the molten steel is measured through the plurality of temperature measurers, the control unit may form data for visualizing the meniscus of the molten steel by using the temperatures measured by the temperature measurers. Here, the temperatures measured in the row, i.e., the temperature values measured by the plurality of temperature measurers disposed in each row may be operated to calculate a mean temperature value in each row. When the mean temperature value in each row is calculated, one temperature value in each row along the width direction of the mold, i.e., a mean temperature value may be provided.

As described above, one or more temperature values may be measured at the same meniscus height and the same casting width point through the temperature measurers defining the plurality of columns and the plurality of rows, and the temperature values may be converted into the mean temperature value to more accurately visualize the meniscus shape.

Also, since heat flux is measured by using the temperature value in the thickness direction of the long sides 11*a* and 11*b*, an initial nonuniform solidification may be confirmed through a distribution of the heat flux in the width direction.

Also, since the temperature measurers are installed to be reduced in spaced distance outward from the central portion of the mold 10 on the area divided in the width direction of the long sides 11*a* and 11*b*, the temperature of the molten steel may be accurately measured regardless of the casting width, and also, the meniscus shape may be stably visualized regardless of the casting width. In the process of visualizing the meniscus of the molten steel, the mean temperature value for each column may be relatively represented and then converted into a relative height for each position of the molten steel meniscus and three-dimensionally visualized as illustrated in FIG. 22. This may be displayed on a display unit (not shown) so that a worker confirms the 3D image.

As described above, after the meniscus of the molten steel is visualized, the meniscus flow pattern of the molten steel may be determined, and the flow control unit adjusts the flow of the molten steel into a pattern in which the defects of the slab are prevented from occurring.

As described above, since the molten steel meniscus may be visualized in real-time, the flow pattern of the molten steel may be determined through the meniscus shape of the molten steel to control the flow of the molten steel in real-time, thereby preventing the defects due to the flow from occurring and improving the quality of the slab.

The meniscus flow control device and control method according to the first and second embodiment and the modified example were described above. However, the present invention is not limited thereto. For example, the first and second embodiments and the modified example may be mutually combined with each other to constitute the meniscus flow control device and control the meniscus flow. That is, at least one of the second embodiment and the modified example may be applied to the first embodiment, at least one of the first embodiment and the modified example may be applied to the second embodiment, or at least one of the first and second embodiments may be applied to the modified example to constitute the meniscus flow control device and control the meniscus flow.

Although the present invention has been described with reference to the accompanying drawings and foregoing embodiments, the present invention is not limited thereto and also is limited to the appended claims. Thus, it is obvious to those skilled in the art that the various changes and modifications can be made in the technical spirit of the present invention.

INDUSTRIAL APPLICABILITY

A meniscus flow control device and a meniscus flow control method using the same according to embodiments of the present invention may visualize a flow of molten steel within a mold and control a meniscus flow using the same. In more detail, a normal or abnormal state of a meniscus flow may be easily monitored to reduce an occurrence of defects of the meniscus flow. Also, the flow of the meniscus may be adjusted according to a flow pattern shape of the molten steel meniscus within the mold to reduce the occurrence of the defects of a slab due to the meniscus flow and visualize the meniscus shape regardless of a width of the slab.

The invention claimed is:

1. A method of controlling a meniscus flow in a mold into which a molten steel is poured, the method comprising:

providing a plurality of temperature measurers at predetermined intervals along a width direction of a mold, the temperature measurers including a first edge temperature measurer, a center temperature measurer and a second edge temperature measurer disposed at one end portion, a center portion, and the other end portion of the mold, respectively;

providing a magnetic field generation unit outside the mold;

measuring temperature values in real-time using the temperature measurers, the measured temperature values including a first edge temperature value measured by the first edge temperature measurer, a center temperature value measured by the center temperature measurer and a second edge temperature value measured by the second edge temperature measurer;

analyzing the measured temperature values to detect a meniscus flow form;

classifying the detected meniscus flow form into one of a plurality of predetermined meniscus flow pattern types to determine a classified meniscus flow pattern type corresponding to the detected meniscus flow form; and when the classified meniscus flow pattern type is abnormal, operating the magnetic field generation unit according to the classified meniscus flow pattern type so as to adjust an abnormal flow state to be normal.

2. The meniscus flow control method of claim 1, wherein the analyzing comprises:

calculating a temperature differences between a maximum temperature value and a minimum temperature value among the measured temperature values; and comparing whether or not the temperature difference is in a reference temperature range.

3. The meniscus flow control method of claim 1, wherein the analyzing comprises: comparing the center temperature value with the first edge temperature value and the second edge temperature value, respectively.

4. The meniscus flow control method of claim 1, wherein the analyzing comprises:

calculating temperature differences between the center temperature value and the first edge temperature value, and between the center temperature value and the second edge temperature value; and comparing whether each of the temperature differences is in a reference temperature range.

5. The meniscus flow control method of claim 1, further comprising: storing a plurality of predetermined meniscus flow pattern types, wherein the classifying comprises: choosing one from the stored predetermined meniscus flow pattern types.

6. The meniscus flow control method of claim 1, further comprising: storing a plurality of meniscus flow control types, wherein the operating comprises: choosing one from the stored meniscus flow control types according to the classified meniscus flow pattern type.

7. The meniscus flow control method of claim 1, wherein the analyzing comprises:

calculating a first temperature difference between a maximum temperature value and a minimum temperature value among the measured temperature values; and comparing whether or not the first temperature difference is in a first reference temperature range;

comparing the center temperature value with the first edge temperature value and the second edge temperature value, respectively; and calculating second temperature differences between the center temperature value and the first edge temperature value, and between the center temperature value and the second edge temperature value; and comparing whether each of the second temperature differences is in a second reference temperature range.

* * * * *